US011837117B2

(12) United States Patent
Williams

(10) Patent No.: US 11,837,117 B2
(45) Date of Patent: Dec. 5, 2023

(54) ADVERTISING WING HITCH FRAME CONNECTOR

(71) Applicant: Lawrence V. Williams, Aurora, CO (US)

(72) Inventor: Lawrence V. Williams, Aurora, CO (US)

( * ) Notice: Subject to any disclaimer, the term of this patent is extended or adjusted under 35 U.S.C. 154(b) by 0 days.

(21) Appl. No.: 17/979,609

(22) Filed: Nov. 2, 2022

(65) Prior Publication Data

US 2023/0140377 A1 May 4, 2023

Related U.S. Application Data

(60) Provisional application No. 63/360,881, filed on Nov. 4, 2021.

(51) Int. Cl.

| | |
|---|---|
| ***G09F 7/20*** | (2006.01) |
| ***G09F 21/04*** | (2006.01) |
| ***G09F 7/22*** | (2006.01) |
| *G09F 7/18* | (2006.01) |

(52) U.S. Cl.

CPC ..... *G09F 7/20* (2013.01); *G09F 7/22* (2013.01); *G09F 21/042* (2020.05); *G09F 21/048* (2013.01); *G09F 2007/1847* (2013.01); *G09F 2007/1865* (2013.01)

(58) Field of Classification Search

CPC . G09F 7/20; G09F 7/22; G09F 21/042; G09F 21/048; G09F 2007/1847; G09F 2007/1865; G09F 7/18; G09F 2007/1843; F16M 11/26; F16M 11/32; F16M 13/00; F16M 13/02

USPC ..... 224/521, 309, 314, 320, 321, 329; 403/109.1; 248/354.1, 475.1, 476, 477, 248/489, 456, 226.11, 227.2, 231.71, 248/231.61

See application file for complete search history.

(56) References Cited

U.S. PATENT DOCUMENTS

| | | | | |
|---|---|---|---|---|
| 1,376,247 | A * | 4/1921 | Ridgeway | A47K 3/003 4/577.1 |
| 2,628,803 | A * | 2/1953 | Krewson | A61M 16/06 248/172 |
| 3,525,461 | A * | 8/1970 | Bronson | B60R 9/058 70/229 |
| 4,809,724 | A * | 3/1989 | Fuser | A47C 7/66 248/514 |
| 7,143,458 | B2 * | 12/2006 | Slater, Jr. | A61F 5/3769 128/845 |
| 8,950,344 | B2 * | 2/2015 | Lewis | A61G 13/101 5/507.1 |
| 9,010,000 | B1 * | 4/2015 | Rodriguez | G09F 21/048 40/592 |

(Continued)

FOREIGN PATENT DOCUMENTS

| | | | | |
|---|---|---|---|---|
| GB | 2274011 A | * | 7/1994 | G09F 21/04 |
| GB | 2324190 A | * | 10/1998 | G09F 21/04 |

*Primary Examiner* — Cassandra Davis

(74) *Attorney, Agent, or Firm* — Leyendecker & Lemire, LLC

(57) ABSTRACT

An advertising wing hitch frame connector is described. Embodiments of the connector include a first attach and detachable arm and a second attach and detachable arm each adapted to couple to an object. In one instance, the object may be a frame including a plurality of adjustable legs. In another instance, the object may be a modified trailer hitch.

14 Claims, 59 Drawing Sheets

(56) References Cited

U.S. PATENT DOCUMENTS

| | | | | |
|---|---|---|---|---|
| 11,176,852 | B2 * | 11/2021 | Mosby | G09F 17/00 |
| 2009/0242724 | A1 * | 10/2009 | Do Camo | G09F 7/04<br>248/560 |
| 2016/0035257 | A1 * | 2/2016 | Likas | G09F 17/00<br>40/591 |

* cited by examiner

W 16
16A
15
16B
16
W
L 7J
4C
3G
3I
3H
3F
3J
3K
3E

7J;
3I;
3B;

6E

6E;
6F
7J'

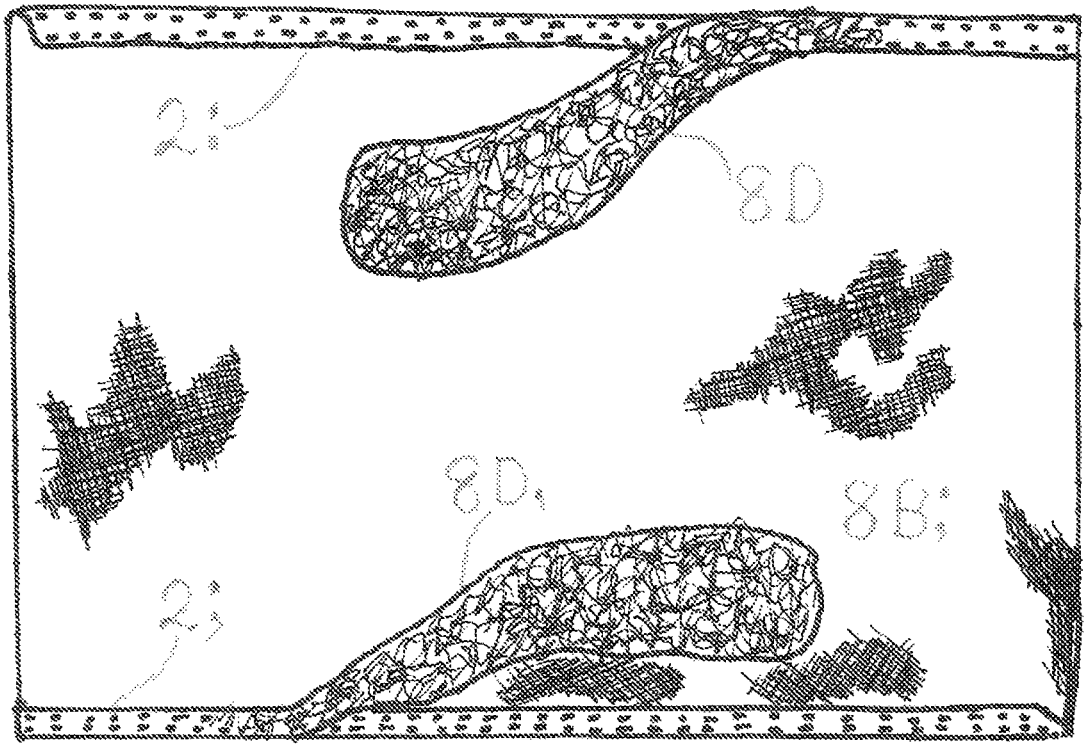
FIG 31
FIG 32
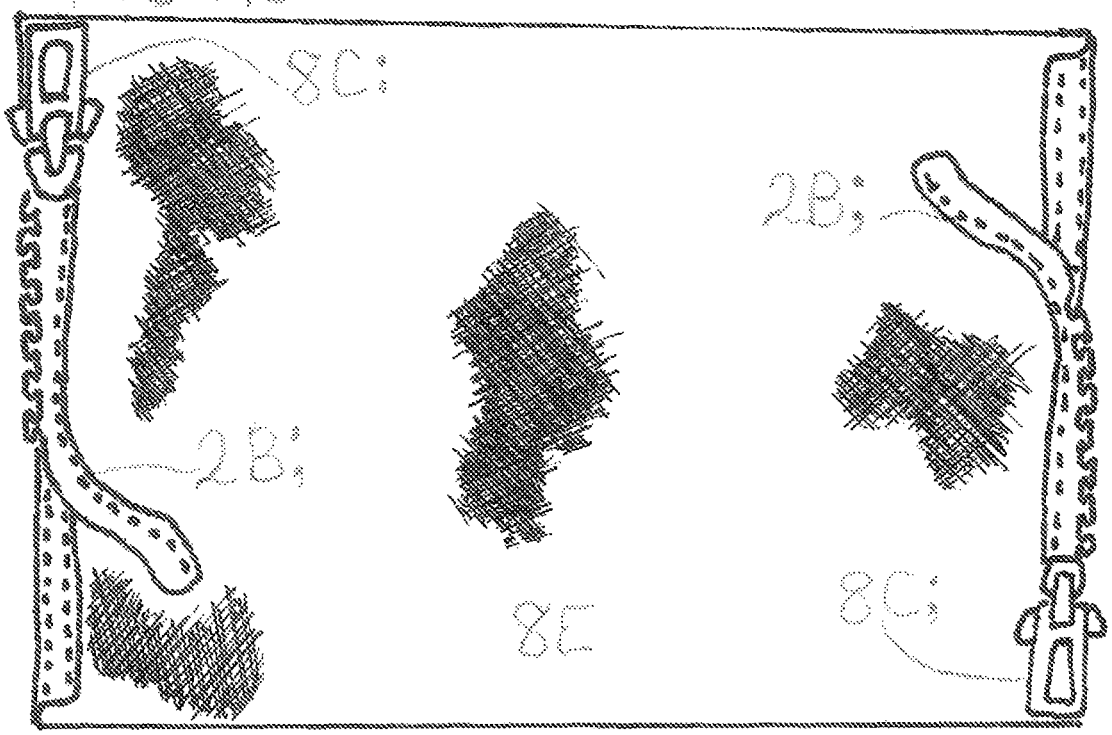

FIG 55
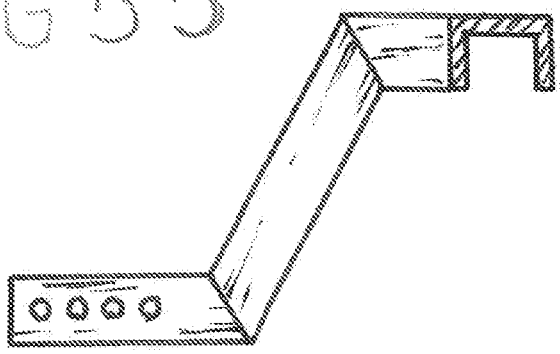
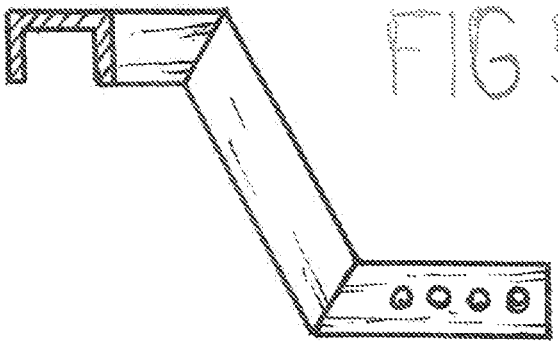
FIG 56

ADVERTISING WING HITCH FRAME CONNECTOR

CROSS-REFERENCE TO RELATED APPLICATION

This application claims the benefit of U.S. Provisional Application No. 63/360,881, filed Nov. 4, 2021.

BACKGROUND

There are devices that advertise directly on top of the hood of a car such as: U.S. Design Pat. D639,340 issued Jun. 7, 2011 patentee, Martin; U.S. design Pat. D777,258, issued Jan. 24, 2017 to patentee Strempack; U.S. Design Pat. D878,467, issued Mar. 17, 2020 to patentee Hornsby; and U.S. design Pat. D567,876, issued Apr. 29, 2008 to patentee Kammy Au. These devices lack the ability to attach to the back bed of a truck or pull bumper of a vehicle or trike motor cycle.

There is a need for a device that can attach and advertise to more than just the hood of a car there is a need to directly advertise from a pull hitch, as well as from the back bed of a truck or other modes of transportation.

BRIEF DESCRIPTION OF THE DRAWINGS

FIG. 31 illustrates a connective means.

FIG. 32 illustrates a connective means.

FIG. 44D illustrates the advertising wing having a steel strip attached to the bottom.

FIG. 55 illustrates a right side view of the hitch frame connector.

FIG. 56 illustrates a left side view of the hitch frame connector.

DETAILED DESCRIPTION

Figure 1:
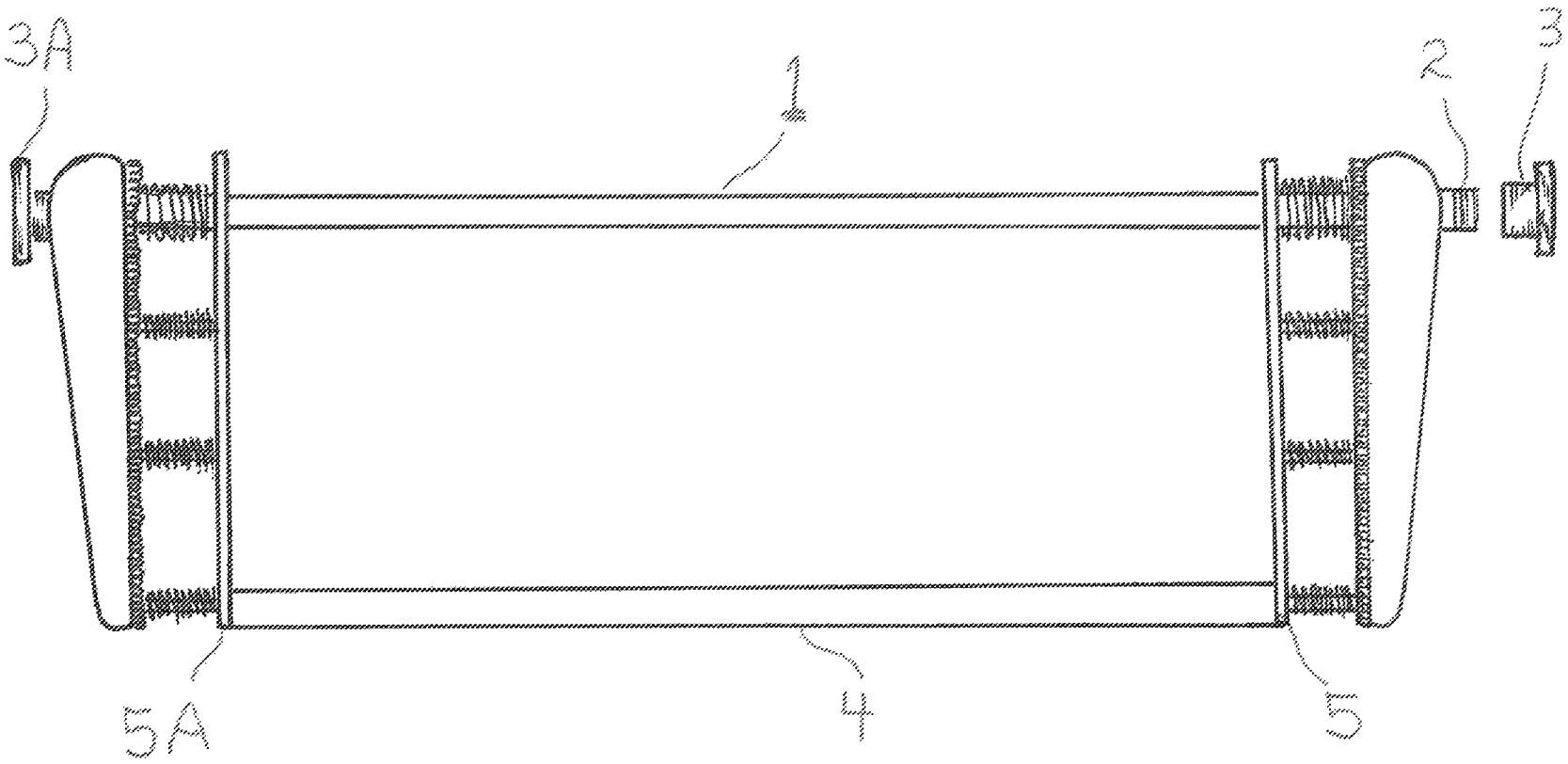
FIG. 1 illustrates the invention.
Figure 2:
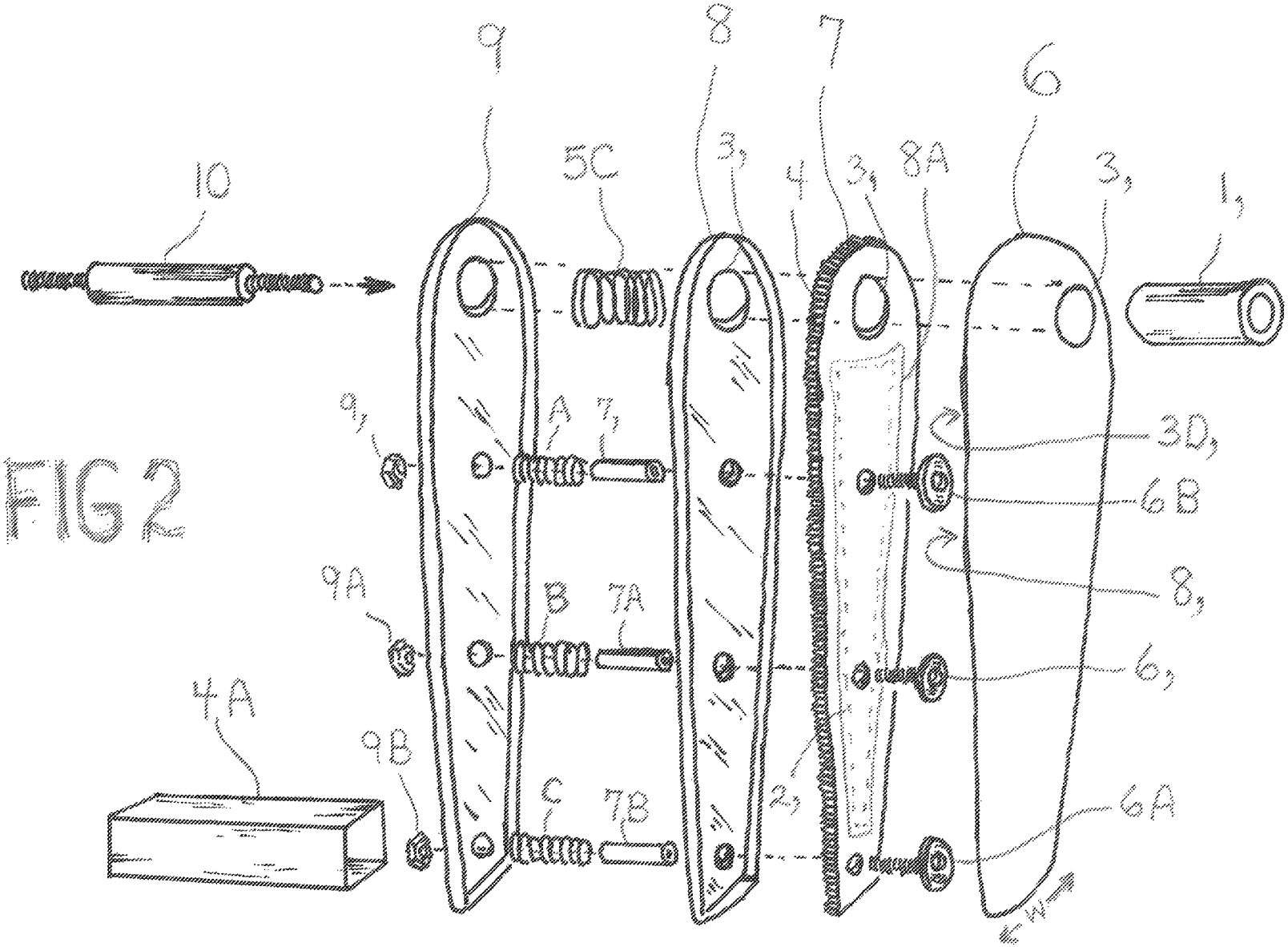
FIG. 2 illustrates the right side of the invention and its parts.
Figure 3:
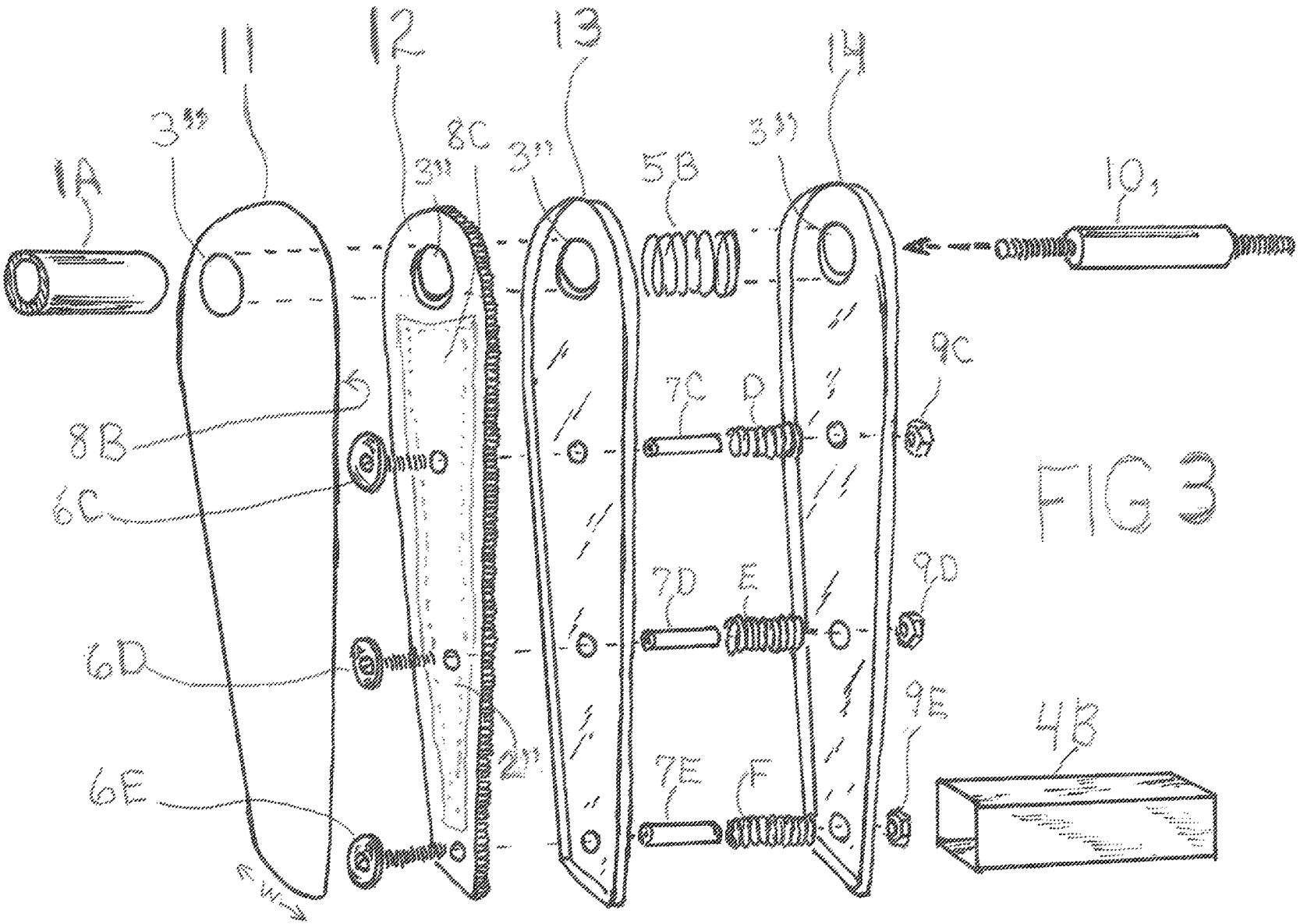
FIG. 3 illustrates the left side of the invention and its parts.
Figure 4:
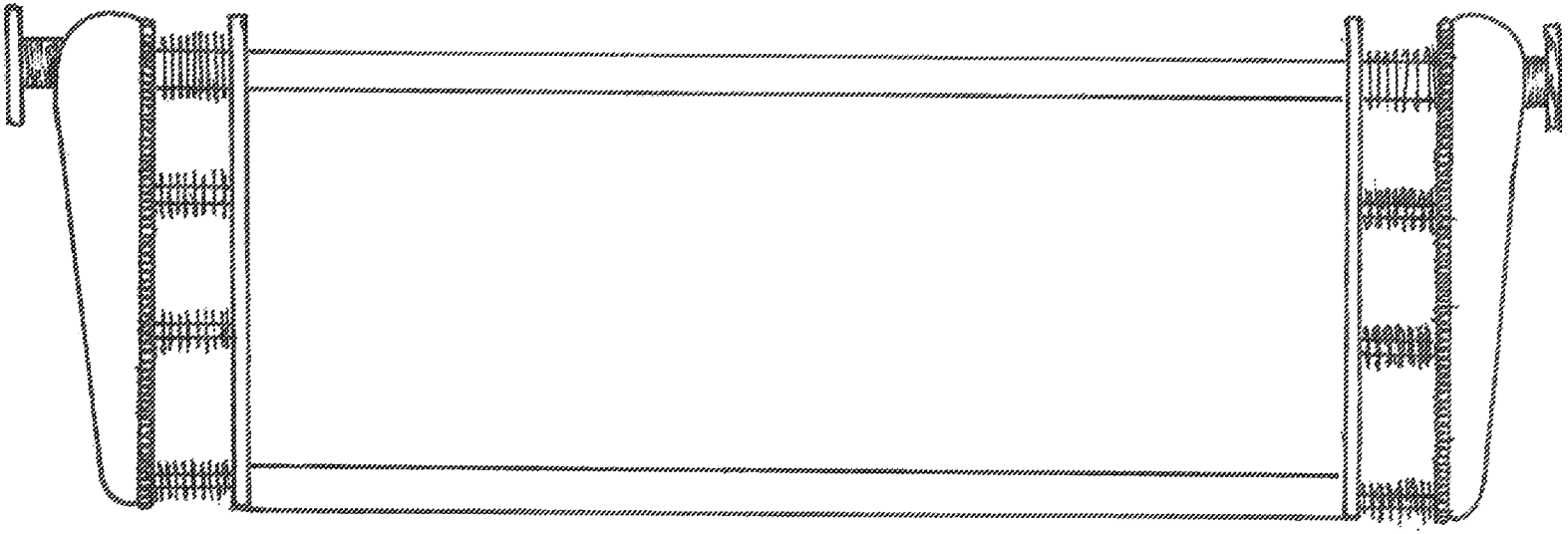
FIG. 4 illustrates the invention in an open position.
Figure 5:
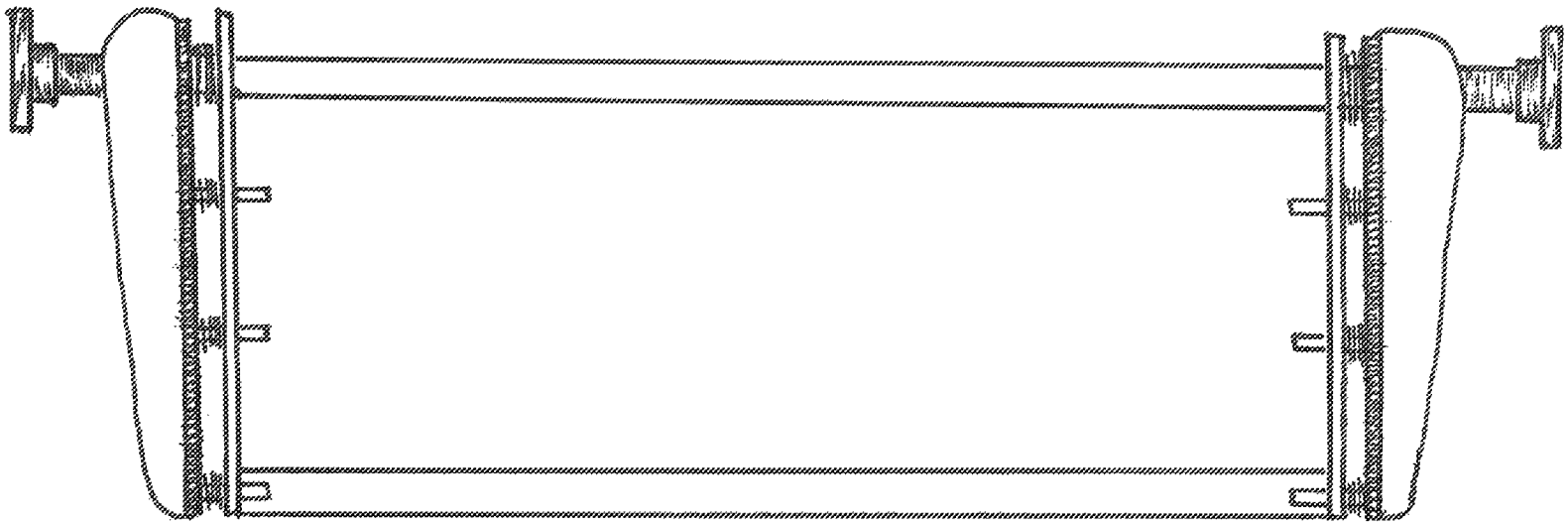
FIG. 5 illustrates the invention in the closed position.

FIG. 1 illustrates an embodiment of the present invention that can be constructed by readily obtainable parts that can be picked up at any hardware store. It has a right side section and a left side section that are interconnected to a top cylindrical stationary bar (1) that is % of an inch in width by a length of 4 feet however not being limited to that can be made of plastic, stainless steel or aluminum, that is partially threaded about 1 inch at its threaded end sections (2) that has end caps (3) and (3A) that could be made from P.V.C threaded end caps for housing the connective gear, that will be explained later about this invention. At the bottom is a stationary square tube brace (4) That is 1-inch by 3 ft ½ inch that can be made of plastic, stainless steel or aluminum. However not being limited to that is attached to a right and left side stationary braces (5) And (5A). FIG. 2 is illustrating the right side and its parts starting from right to left there is a glide arm (6) at the bottom of the glide arm at its most narrow point it could have a measuring width of around 1¼ inches however not being limited to it has a measuring length from the bottom up of around 14 inches with the top surface being round and dome shaped from the top and centered around 1½ inches from the top is a 1 inch orifice opening (3,) that can be bigger or smaller with a top width of around 3 inches and an overall circumference of 31 inches. The glide arm (6) could be made from a mold poured from plastic resin or foam, Velcro hooks and loops with the hooks (8,) can be attached to the unseen section (3D,) that will complement the loops (8A) section for attaching the glide arm (6) however not being limited to as it can also be attached with screws as well, to the zip pad (7) that could be made of suede, leather, cotton canvas, nylon and all synthetic fabrics it to is 14 inches in length rounded at the top 3 inches wide with a orifice (3,) in the center about 1½ inches from the top and it has a radius of 31 inches as well. With a continues zipper (4,) around the outside parameter or it could have a zipper sewn with stitching around the outside parameter on it. It will also have the complementary said loops (8A) section attached with stitching (2,) to the zip pad (7) so that the unseen hooks (8,) can be attached to the zip pad (7) it will then be attached to the glide brace (8) that can be made of ¼ inch plexiglass or acrylic sheeting as well as wood and or aluminum its measurements are the same as the stationary brace (9) except for the orifice opening (3,) on the stationary brace the orifice opening on the stationary brace is smaller and more snug were as the sliding brace (8) orifice opening is about 1/16 of an inch or greater for the purposes of sliding, both braces (8) and (9) at the bottom are 1¼ of an inch in width by a length of 14 inches with a width of 3 inches at the top with the tops being rounded off and centered with a 1 inch orifice opening that is larger for the one gliding brace (8) with both braces having a radius measurement of 31 inches. Screws (6B) and (6,) as well as (6A) have a length of 2½ inches but not being limited to with washers, that will then go through three smaller orifices that are evenly spaced around 4½ inches, but not being limited to starting first with screw (6B) it will piece first the zip pad (7) glide brace (8) slide tube (7,) spring (A) And then attaching to nut (9,) second screw (6,) will then piece first zip pad (7) second glide brace (8) slide tube (7A) spring (B) and attach to nut (9A) last screw (6A) will then pierce zip pad (7) then glide brace (8) slide tube (7B) and spring (C) piercing last stationary brace (9) and attaching to nut (9B) the stationary square brace (4A) is attached to stationary brace (9) this is now the connective gear right arm. The stationary bar (1,) will then be connected through stationary brace (9) spring (5C) glide brace (8) zip pad (7) glide arm (6) orifices (3,) Frame connector rod (10) that can be made of a combination of aluminum and brass it can have a measurement length of 4 feet 3 inches however not being limited to, as some of these units can be made larger or smaller it is used to connect the invention with wing nuts to other frames having orifices or no orifices it is also used as a conductor of electrical current. FIG. 3 illustrates the left side connective gear and all of its parts starting with the left side glide arm (11) at the bottom of the glide arm (11) at its most narrow point it could have a measuring width of around 1¼ of an inch however not being limited to it has a measuring length from the bottom up of around 14 inches with the top surface being rounded off and from the top and centered around 1½ inches from the top down is a 1 inch orifice opening (3") that can be bigger or smaller with a top width of around 3 inches wide and a overall circumference of 31 inches the glide arm (11) could be made from a mold poured from plastic resin or even be injection molded or formed from foam and have Velcro hooks and loops with the hooks (8B) attached to the flat unseen section, that will complement and be attached to the loops (8C) section that is attached with treading (2") to the zip pad (12) that is intern attached to the glide arm (11) that can also be attached by screws as well. The zip pad (12) could be made of suede, leather, cotton, canvas, nylon and all synthetic fabrics it to is rounded at the top with a 1 inch orifice opening (3") that can be bigger or smaller with a top width of around 3 inches wide with a measuring length of 14 inches and a measuring width at the very bottom of 1¼ inches and having an overall circumference of 31 inches the zip pad (12) is used to attach, other embodiments to the glide brace (13) and stationary brace (14) all have the same measurement and orifice openings (3") with the orifice opening of the stationary brace (14) being smaller and more snug about 1/16 of an inch braces (13) and (14) being made of plastic or aluminum and can very in thickness but not being limited to. Screws (6C) and (6D) as well as (6E) all having washers will then pierce through 3 smaller orifices, that set below larger orifices (3") starting with (6C) it will go through first zip pad (12) second glide brace (13) slide tube (7C) and spring (D) stationary brace (14) and last attach to nut (9C) next screw and washer (6D) will pierce first zip pad (12) second glide brace (13) slide tube (7D) spring (E) stationary brace (14) and attaching the nut (9D) last washer and screw (6E) will pierce zip pad (12) attaching zip pad (12) to glide brace (13) piecing glide brace (13) then slide tube (7E) and spring (F) and last stationary brace (14) and then attaching to nut (9E) compressing the glide brace (13) against the stationary brace (14) and the stationary square brace (4B) attached to the stationary brace (14) although not seen in this illustration it can have more stationary braces depending on its length as will be depicted in other figures. FIG. 3 illustrates the cylindrical stationary bar. (1A) is a bar that can be 4 feet or longer it will be threaded through orifices (3") of first the glide arm (11) second of zip pad (12) then orifice (3") of glide brace (13) spring (5B) and last orifice (3") of stationary brace (14) were the frame connector rod (10,) can have a measuring length of 4 feet 3 inches that is treaded up the center of the cylindrical stationary bar (1A) for the purposes of attaching this invention to the adjacent side. FIG. 4 illustrates this invention in an open position. FIG. 5 illustrates this invention in the closed position so that anything being attached to the zip pads using tensile strength generated from the springs when pushed back out it will tighten any flexible resistant materiel rendering the surface of the flexible material smooth.

Figure 7:
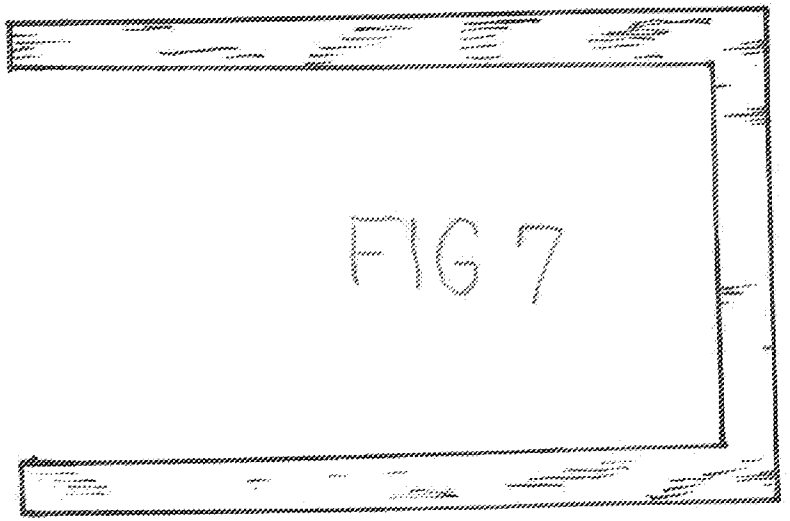
FIG. 7 illustrates the U-arm insert.
Figure 8:
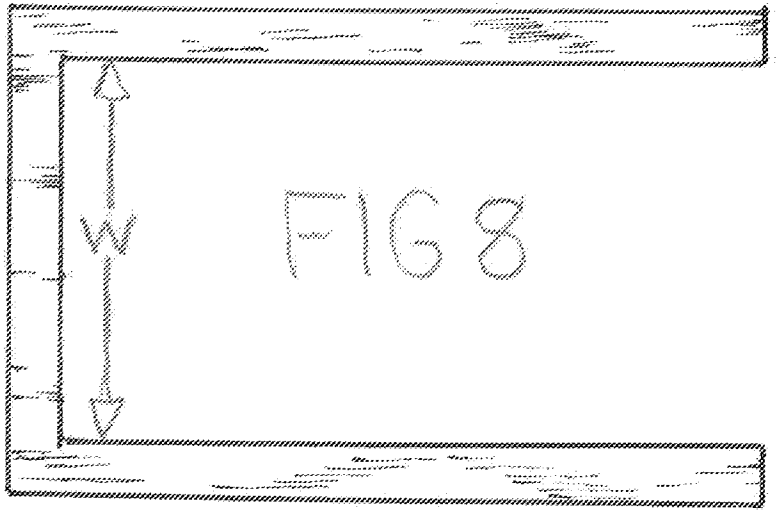
FIG. 8 illustrates the U-arm insert.
Figure 6:
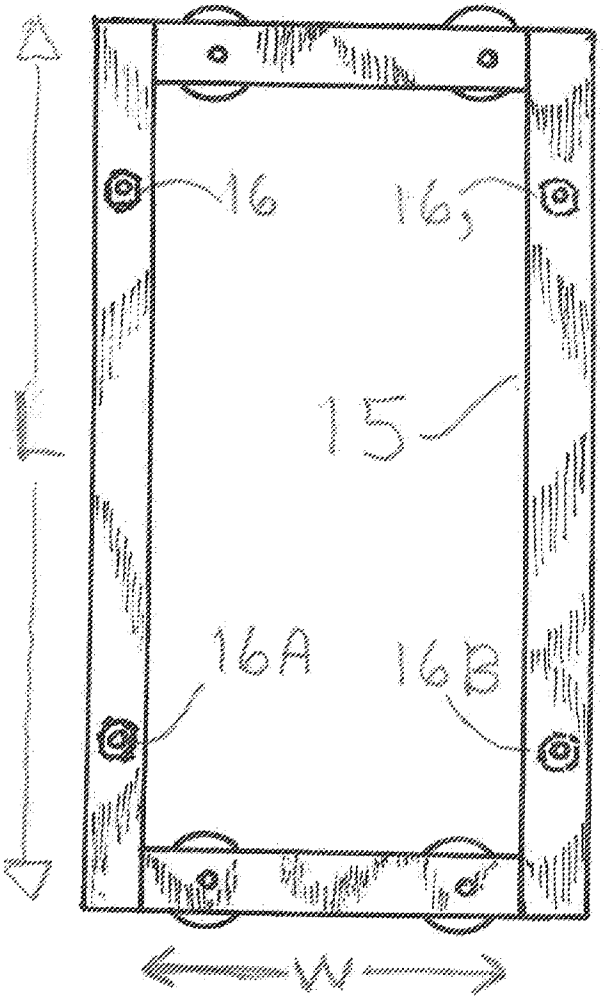
FIG. 6 illustrates the rectangle support frame.
Figure 9:
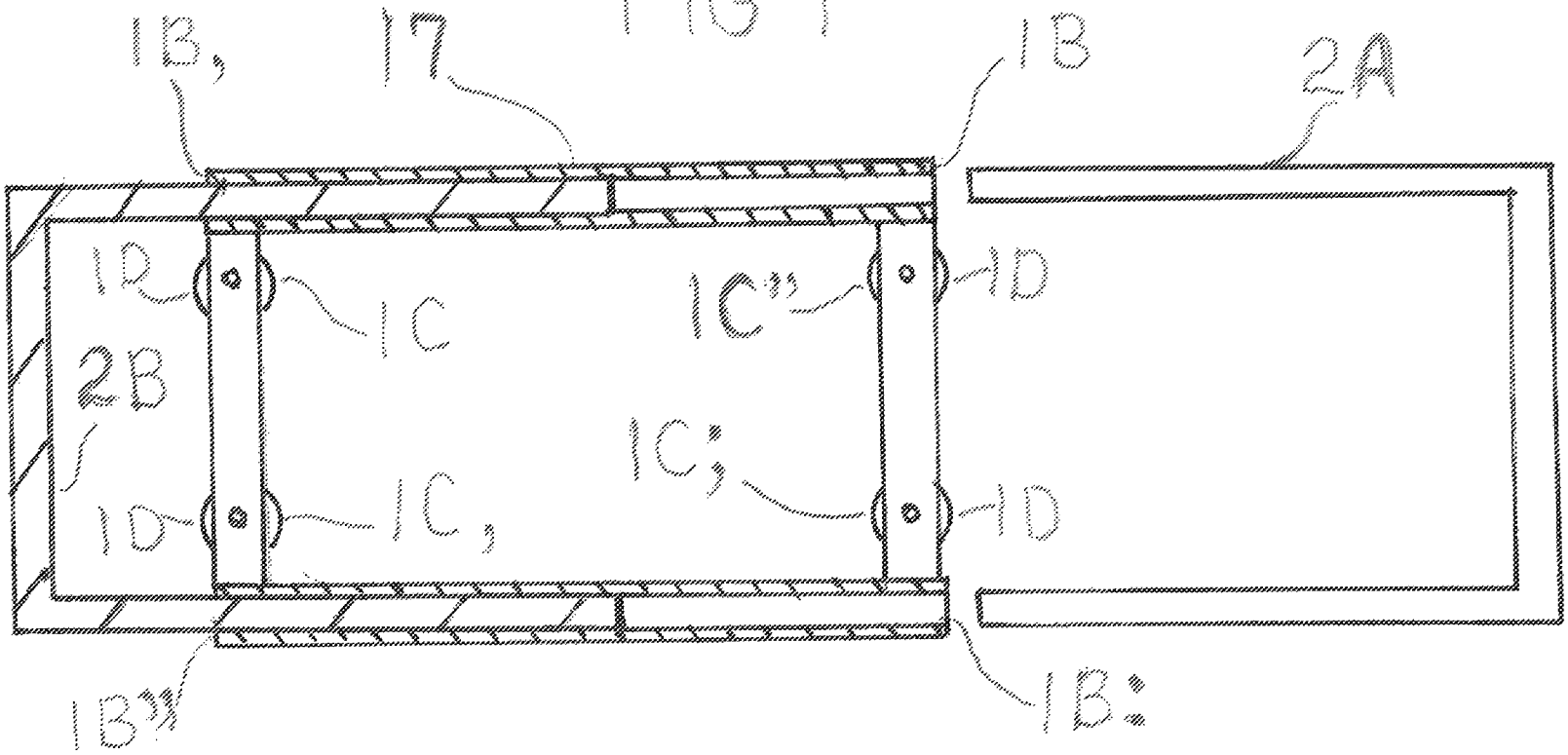
FIG. 9 illustrates the U-arm insertion area in the frame.

FIGS. 6-8 are illustrating a frame that can easily be made by someone skilled in the art just off these drawings alone. FIG. 6 illustrates a portion of the rectangle insert frame. The Insert Frame (15) can be made of round or square tubing that can be 1¼ in diameter and can be made from stainless steel, aluminum, plastic, brass or a combination thereof but not being limited to. The rectangle insert frame (15) that is made of 1¼ inch stainless steel square tubing is made up of four pieces two of them that are longer having a measuring length of 28 inches and another two that are shorter having a measuring width of 9 inches the four are welded together having a measuring length of 28 inches by 11½ inches there are four bolts (16) and (16,) as well as (16A) and (16B) that are centered and welded 5 inches from the edges on either side, that are used for the purposes of tightening the front and backside insert attaching arms. FIG. 7 illustrates one of the insert arms that could be made of plastic and be poured from a one piece mold having two sides being 20⅜ inch by a middle section being 11¼ inch or having a measuring radius of 52 inches or it could be comprised and made with 1 inch round or square steel tubing that has three sections two of these sections having a measuring length of 20⅜ inch that are both welded to a single 11½ inch shorter piece. FIG. 8 illustrates a mirroring image of another insert arm that has the same measuring lengths as the first with to pieces being 20⅜ inches that are welded at there but end sections to a single piece having a measuring width of 11¼ inch forming the U, Shape insert arm, that could be made of Aluminum. FIG. 9 illustrates the insertion areas in the frame. The frame (17) has four square orifice openings (1B) (1B,) (1B:) and (1B") these entry points have an orifice opening of 1⅛ inch were the U-shaped arm (2A) will penetrate orifices (1B) and (1B:) for the purposes of being the frame, the U-shaped arm (2B) is illustrating a fragmented view of the U-shaped arm (2B) already in the frame (17). On the frame (17) are four adjustable legs (1C) (1C,) (1C") and (1C;) that are attached to four unseen bolts (1D) that are welded over orifices 2 inches from the welded outside edges for adjusting the device up or down.

Figure 10:
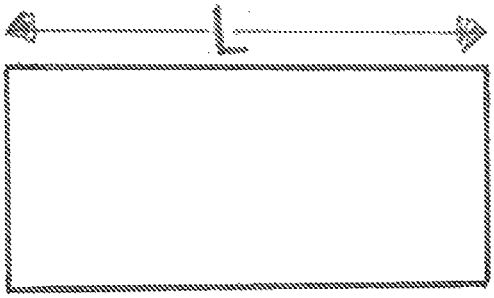
FIG. 10 illustrates a front view of a piece of square tubing.
Figure 10A:
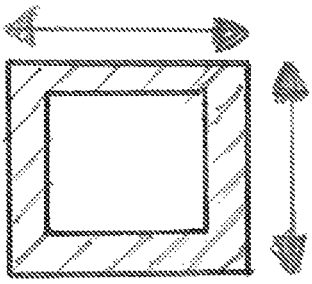
FIG. 10A illustrates a side view of the square tubing.
Figure 11:
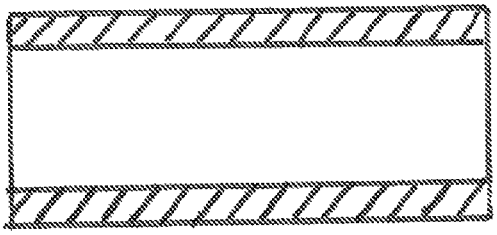
FIG. 11 illustrates a front sectional view of the former square tubing.
Figure 11A:
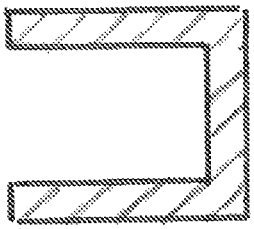
FIG. 11A illustrates a sectional side view of the former square tubing.
Figure 12:
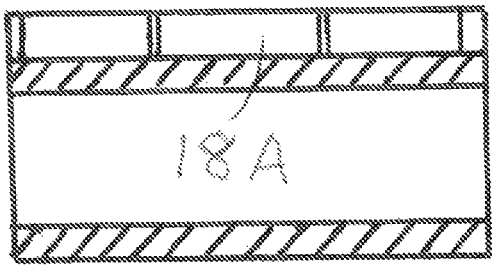
FIG. 12 illustrates a front view of the embodiment with a hinge welded on top.
Figure 12A:
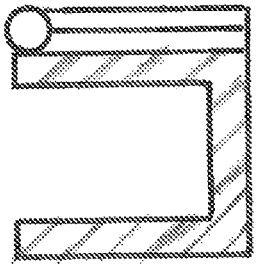
FIG. 12A illustrates a side view of the embodiment with a hinge welded to the top.
Figures 12B, 12C, 12D:
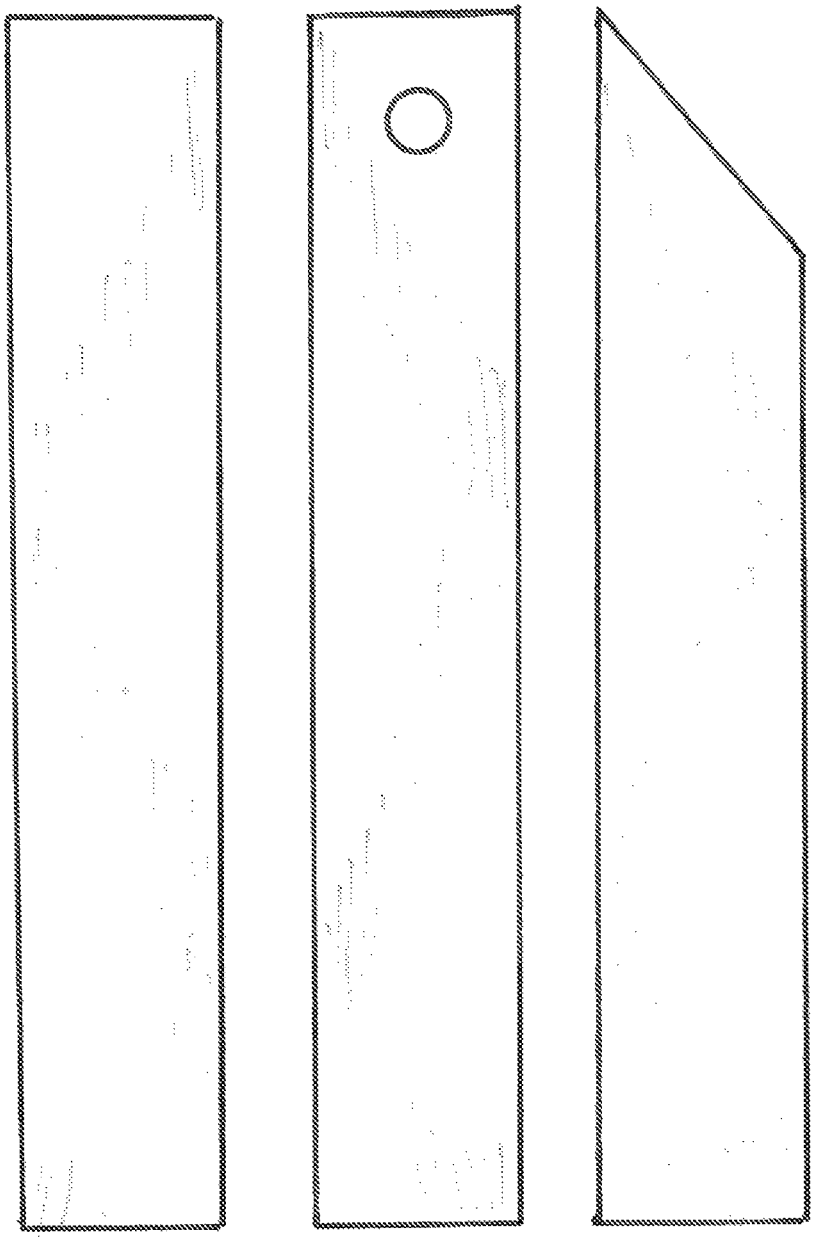
FIG. 12B illustrates a plane piece of square tubing.
FIG. 12C illustrates a plane piece of square tubing that has an orifice at the top.
FIG. 12D illustrates a square piece of tubing that has a 45 degree angle cut out.

FIG. 10 illustrates a front view of a piece of square steel tubing that is 4 inches in length. FIG. 10A illustrates a side view of the piece of square tubing that is ¼ inch thick by 2½ by 2½ inches squared. FIG. 11 illustrates a front view of the former square tubing that is 4 inches in length that could be made of steel or aluminum having a 2 inch section removed. FIG. 11A illustrates a side view of the formerly square tubing. FIG. 12 illustrates a front view of the former square tubing, the square tubing has a hinge (18A) welded to the top of the square tubing that has a 2½ inch by 4 inch hinge welded to the top. FIG. 12A illustrates the embodiment side view with a hinge welded to it. FIG. 12B illustrates square tubing that is 1 inch by a length of 15 inches. FIG. 12C illustrates square tubing that is 1 inch in width by a length of 15 inches with a orifice ¼ inch from the top edge and centered for the purposes of securing other embodiments. FIG. 12D illustrates the 1 inch by 15 inch square tubing turned to the side were a 45 degree angle square piece has been removed, for the purposes of attaching other embodiments such as a screw and bolt.

Figure 13:
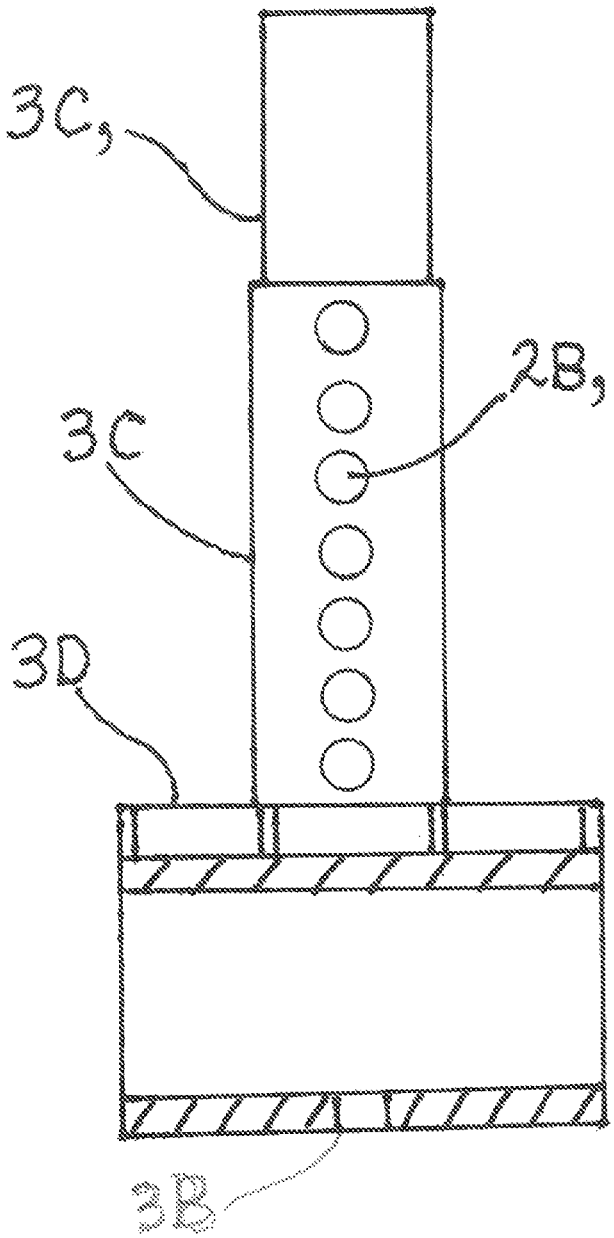
FIG. 13 illustrates the building of an attach and detachable arm.
Figure 13A:
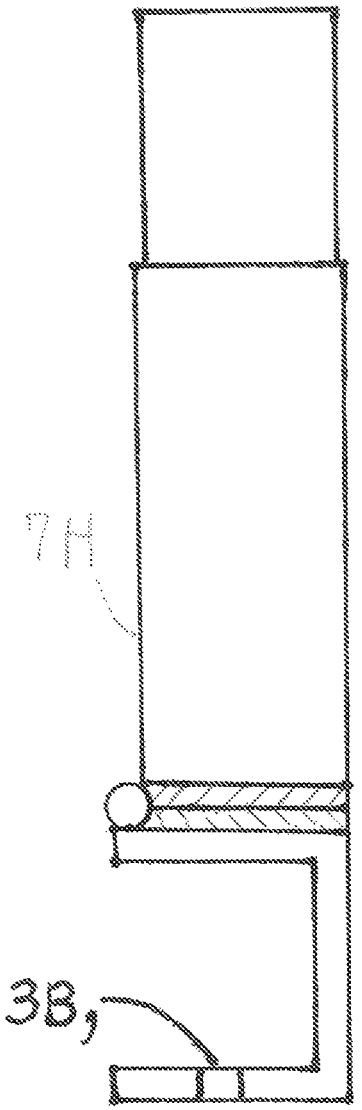
FIG. 13A illustrates a side view of the attach and detachable arm.
Figures 14, 14A:
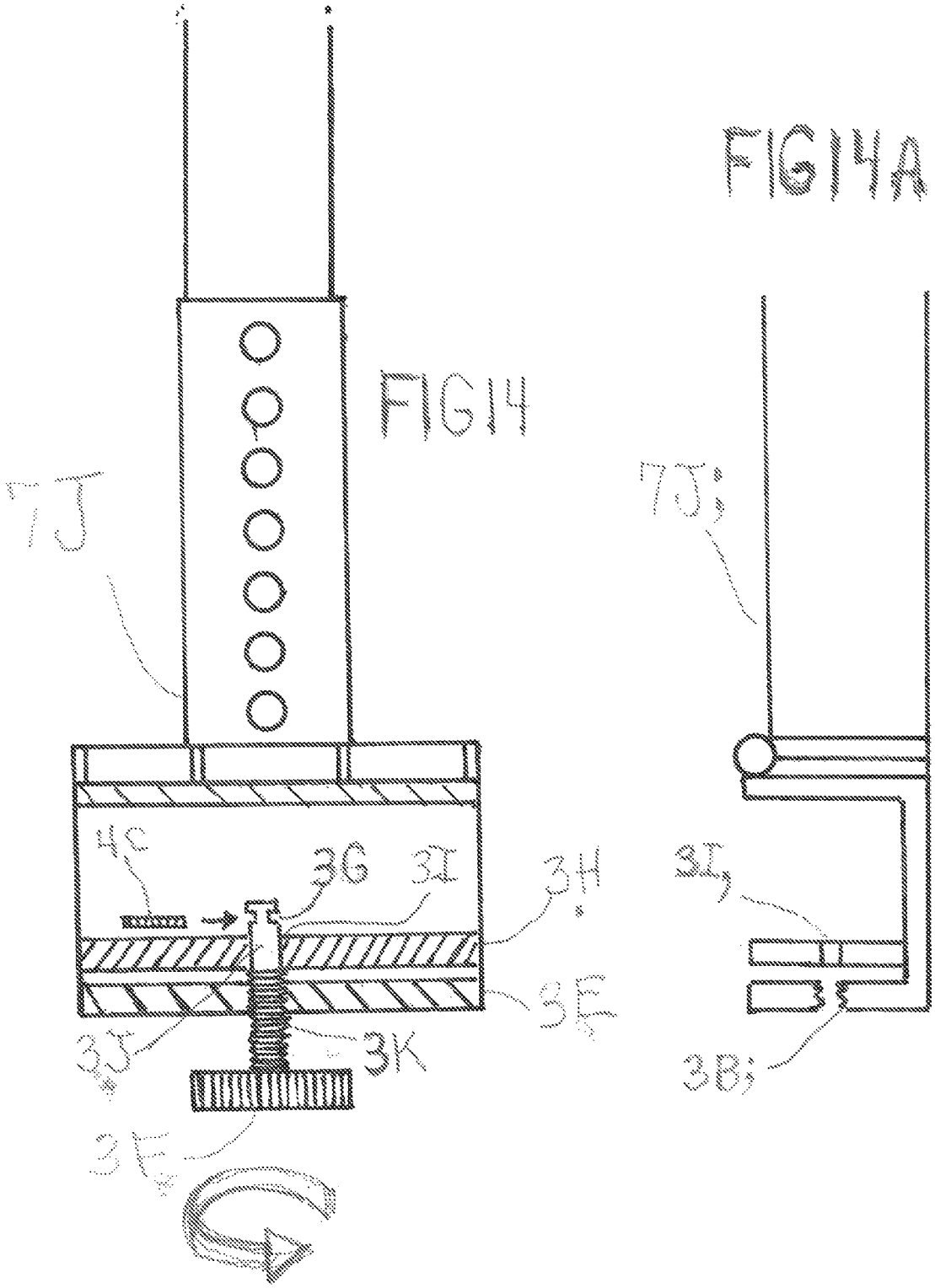
FIG. 14 illustrates what is to be a vice clamp section front view.
FIG. 14A illustrates a side view of the to be vice clamp.
Figure 15:
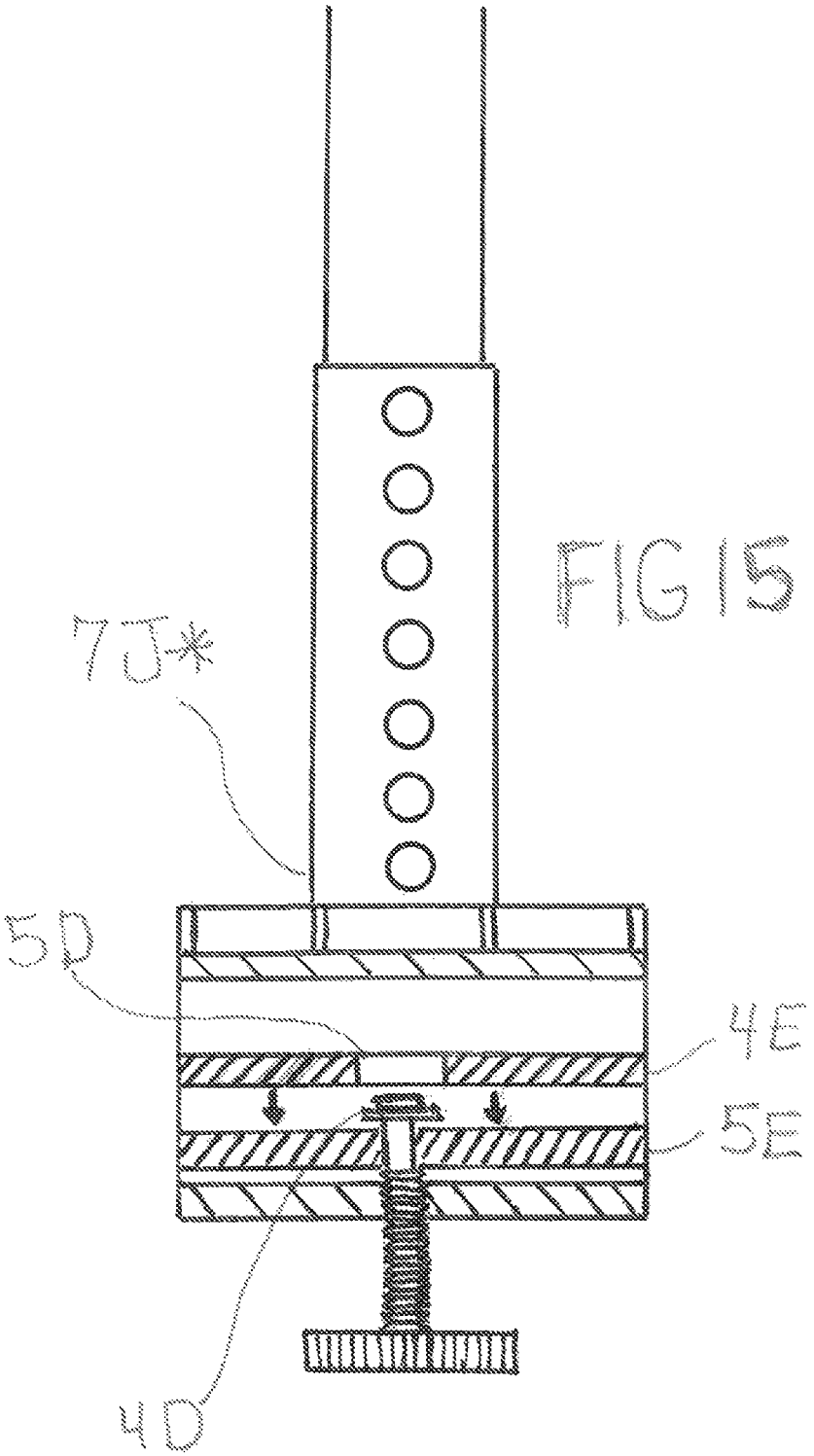
FIG. 15 illustrates the reminder screw being made flush.
Figure 16:
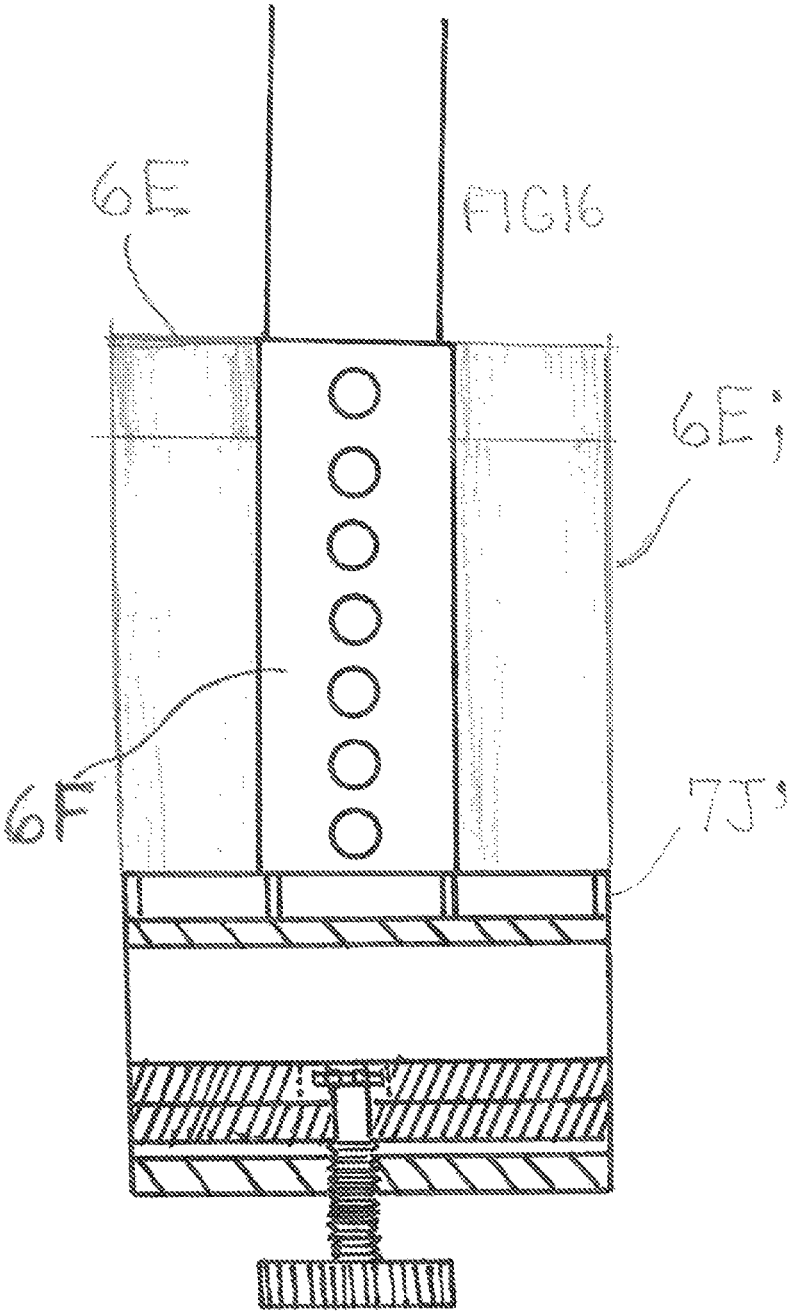
FIG. 16 illustrates the bottom section welded and two cylinders being attached.
Figure 16A:
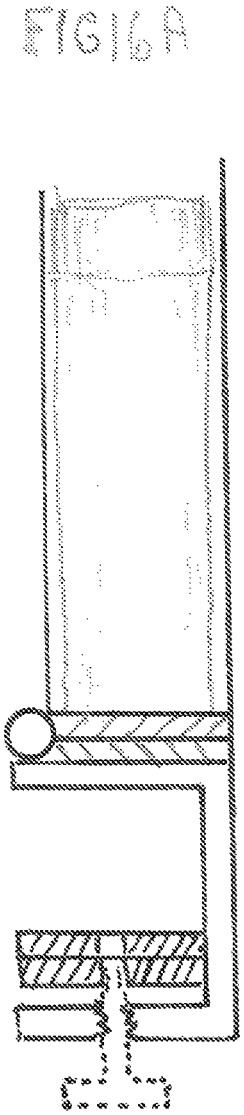
FIG. 16A illustrates a side view of the attaching arm.
Figure 17:
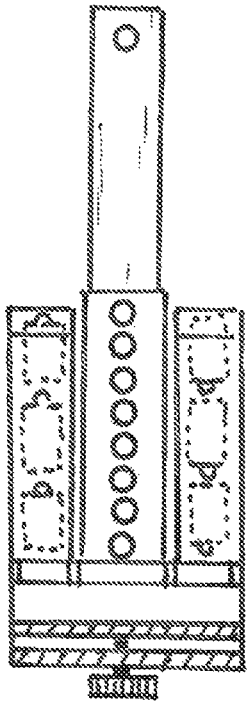
FIG. 17 illustrates the now attach and detachable arm backside.
Figure 17A:
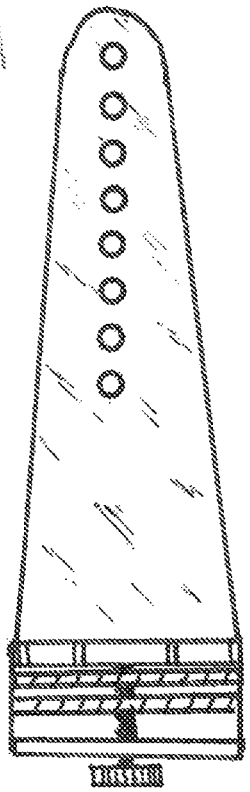
FIG. 17A illustrates a front side view of the arm it is also illustrating that the arm can be other geometric shapes and can be attached to other embodiments.

FIG. 13 illustrates square tubing that has been welded on top of the folding hinge. The square tubing (3C) has a 1¼ inch width by a length of 8 inches and a second piece of square tubing (3C,) that is 1 inch squared by a length of 15 inches both having matching orifices (2B,) alignments from the bottom orifice to the top orifice. The smaller in diameter square tubing (3C,) is inserted in the center of the outside larger (3C) tubing were both could be made of steel, stainless steel or aluminum were only the larger square tubing (3C) will be centered and welded to the top of the hinge (3D) for the purposes of folding down, a small orifice (3B) at the bottom can be drilled with a ¼ inch bit and threaded however not being limited to as it can be bigger or smaller and threaded depending on the square tubing size that is centered and drilled. FIG. 13A illustrates a side view of the embodiment (7H) and at the bottom the orifice (3B,)

that is centered for the purposes of clamping other embodiments to. FIG. 14 illustrates the building of the attach and detachable arm (7J). At the bottom section is a partially threaded screw (3F) where only the threaded section (3*k*) will thread up through the vice clamp section (3E) where only the unthreaded section (3J) will penetrate the steel plate (3H) that has a measuring length of 4 inches and a width of 2 inches and a orifice opening (3I) were the threaded and larger section (3*k*) will lift, the rectangular steel plate (3H) that is ¼ inch thick and the screw (3F) when turned clock wise it will lift the 2×4 inch steel plate (3H) the screw (3F) has a notched groove (3G) to receive a C-Clamp (4C) so that it stays attached. FIG. 14A illustrates a side view of the attach and detachable arm. The attaching arm or vice clamp (7J;) has a threaded orifice (3B;) section and non-threaded section (3I,) of the to be vice clamp (7J;). FIG. 15 illustrates an attaching arm, the attaching arm (7J*) is illustrating a 2×4 inch steel plate (4E) that is ¼ inch thick that has an orifice (5D) up the center that will be placed over the remainder section of the screw (4D) the steel plate (4E) will be welded from the sides to the bottom matching plate (5E) to create a smooth surface. FIG. 16 illustrates the round cylinders to the attaching arm, the attaching arm (7J') has these round cylinders (6E) and (6E;) that can be made of aluminum, plastic or stainless steel that are placed to the right and left of the middle pillar (6F) of the attaching arm (7J') they have a measuring length of 8 inches by a width of 1 inch however not being limited to for the purposes of holding batteries that power the illuminating element that can also be plugged in for power. FIG. 16A illustrates a side view of the attaching arm. FIG. 17 illustrates the now attach and detachable arm front side view with the clamp in the open position. FIG. 17A illustrates a front side view of the attach and detachable folding arm, that can be another geometric shape with the vice clamp in the closed position when the handle has been turned clock wise and can be attached to other embodiments.

Figure 18:
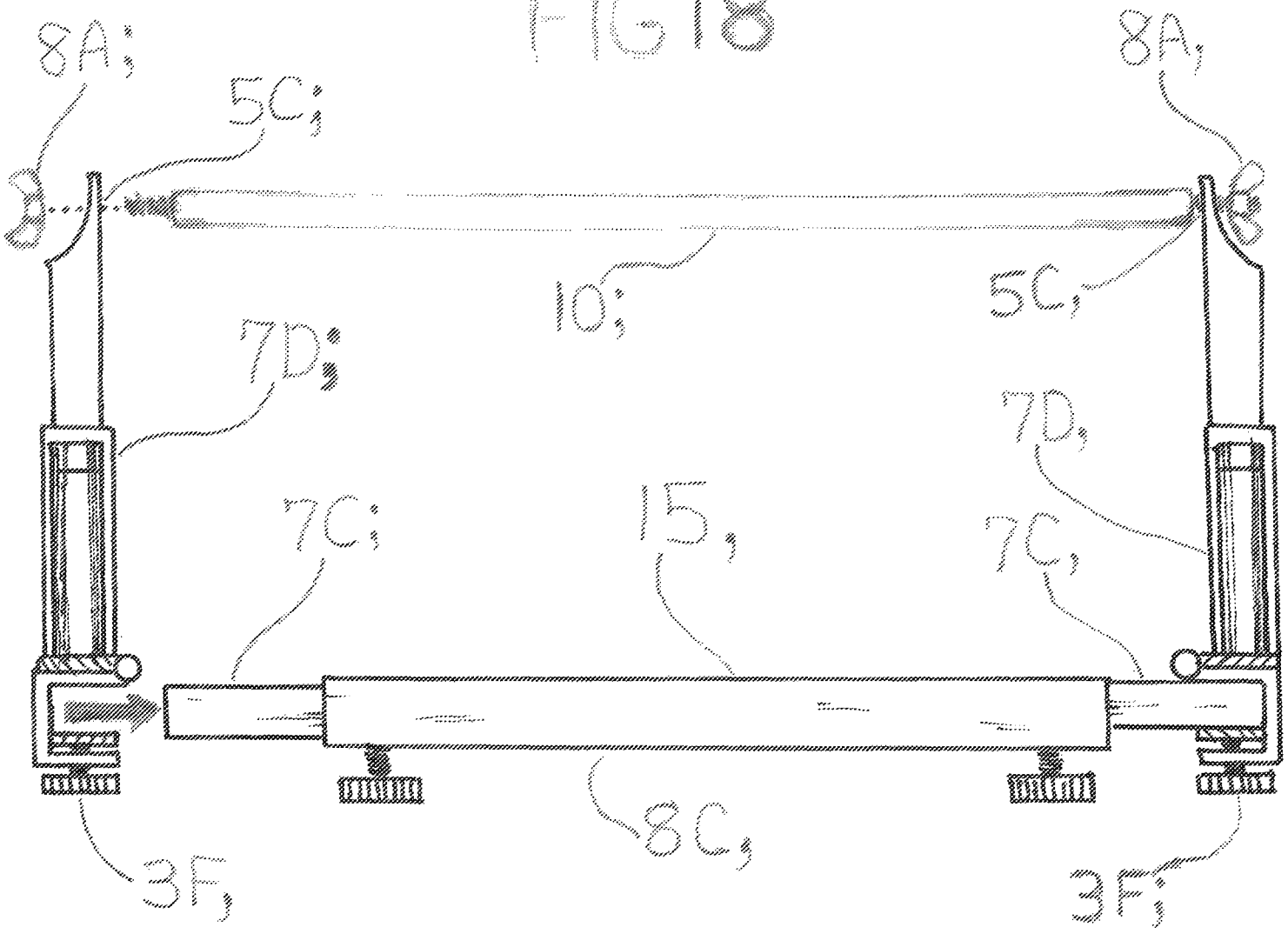
FIG. 18 illustrates the arm being attached.
Figure 19:
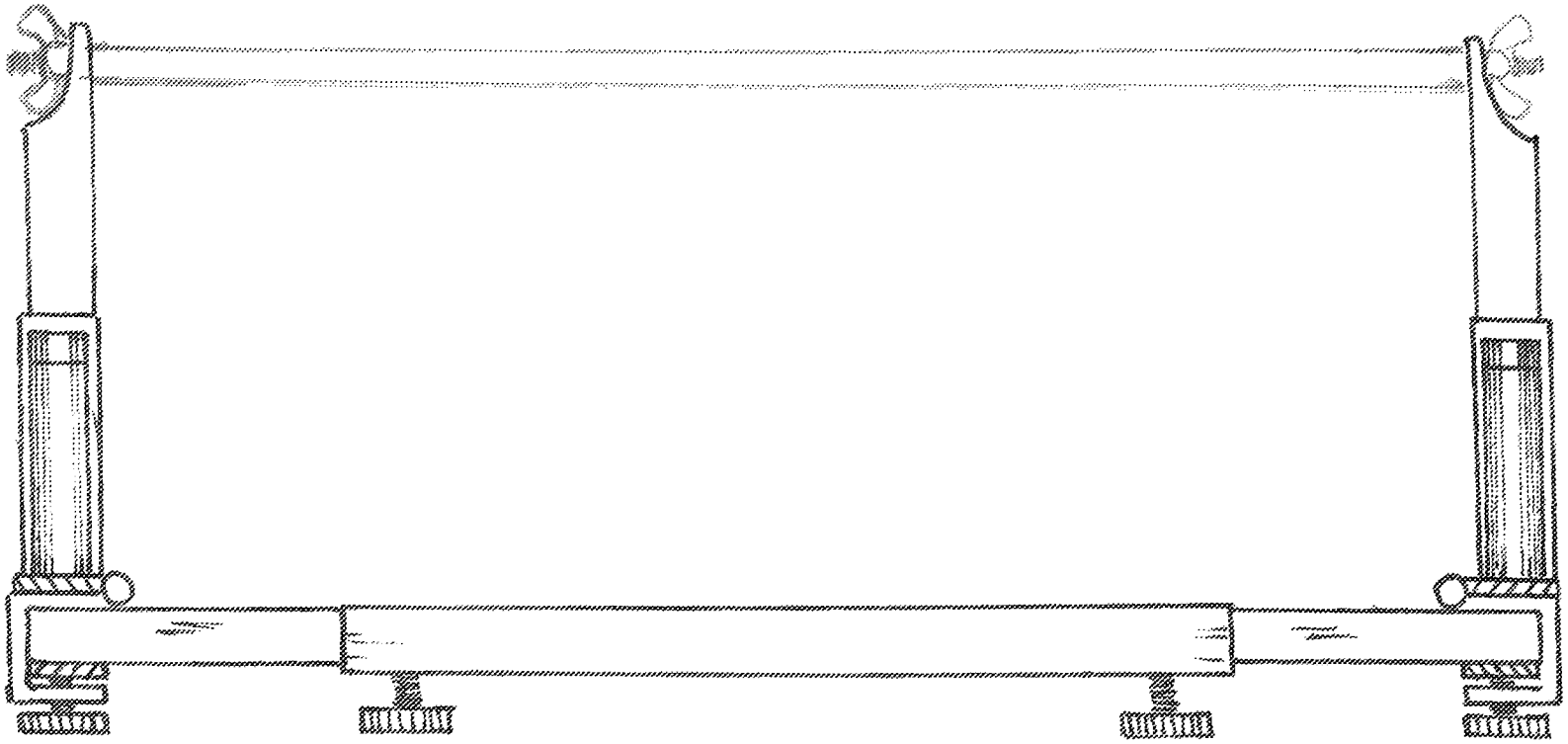
FIG. 19 illustrates the attaching frame.
Figure 20:
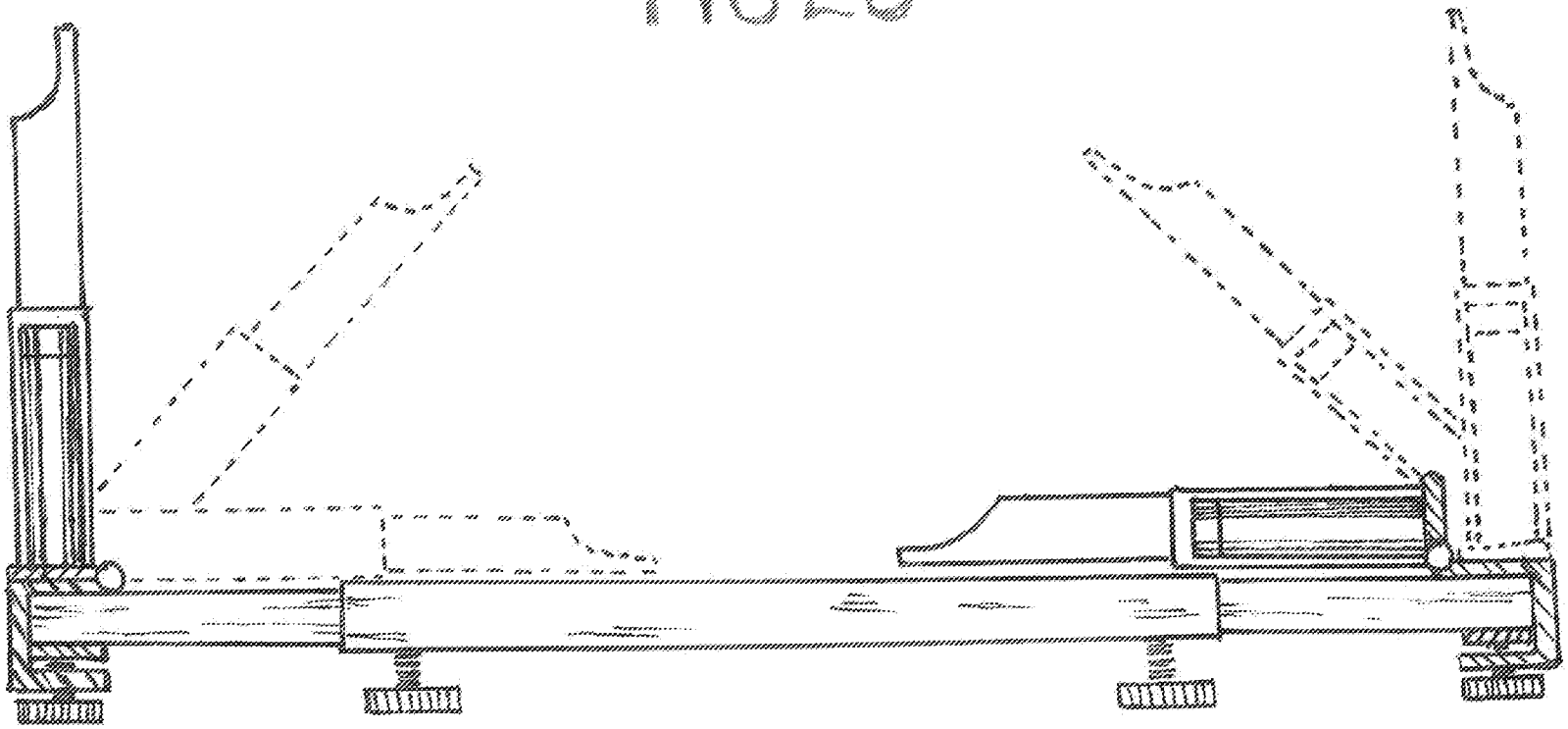
FIG. 20 illustrates the operational function of the frame.
Figure 21:
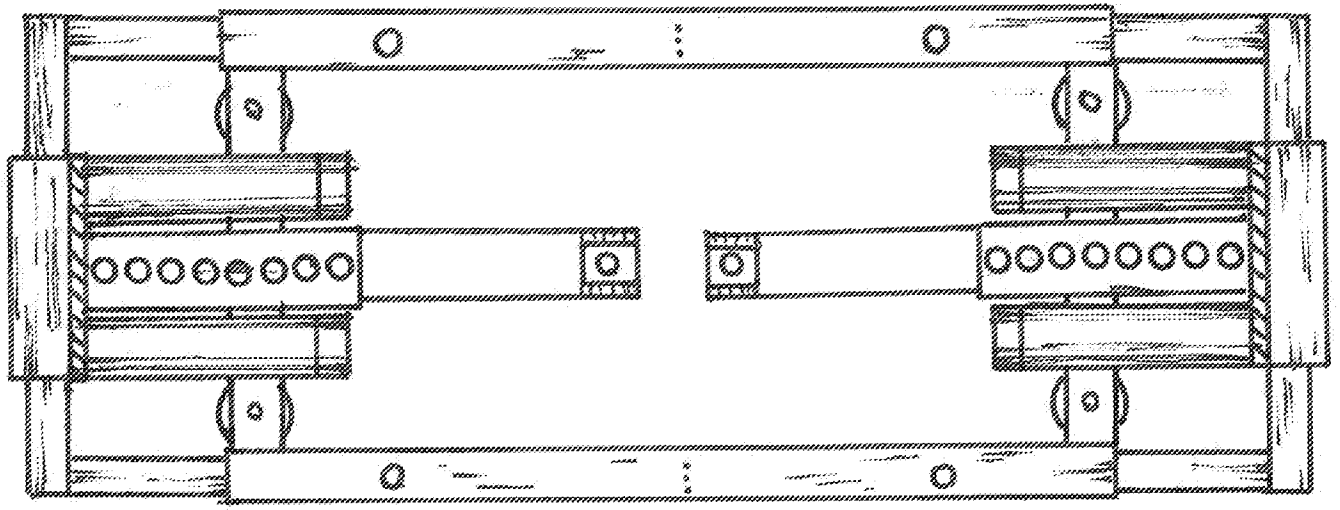
FIG. 21 illustrates the frame in the closed position with the arms folded down.
Figure 22:
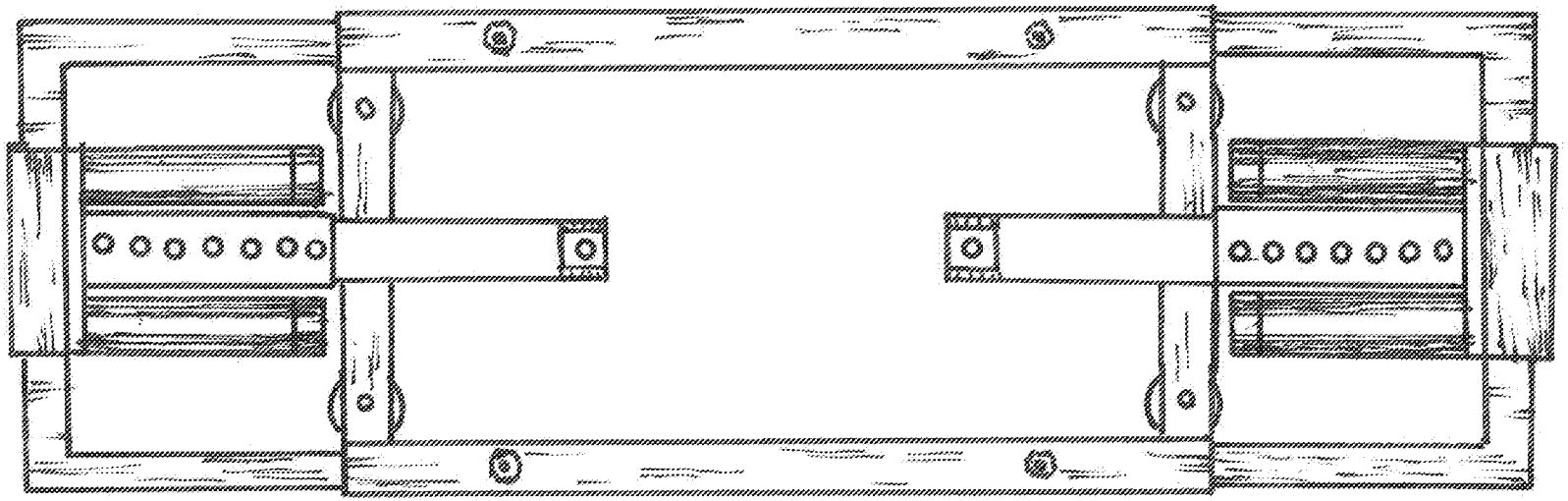
FIG. 22 illustrates the frame in the open position with the arms folded down.
Figure 23:
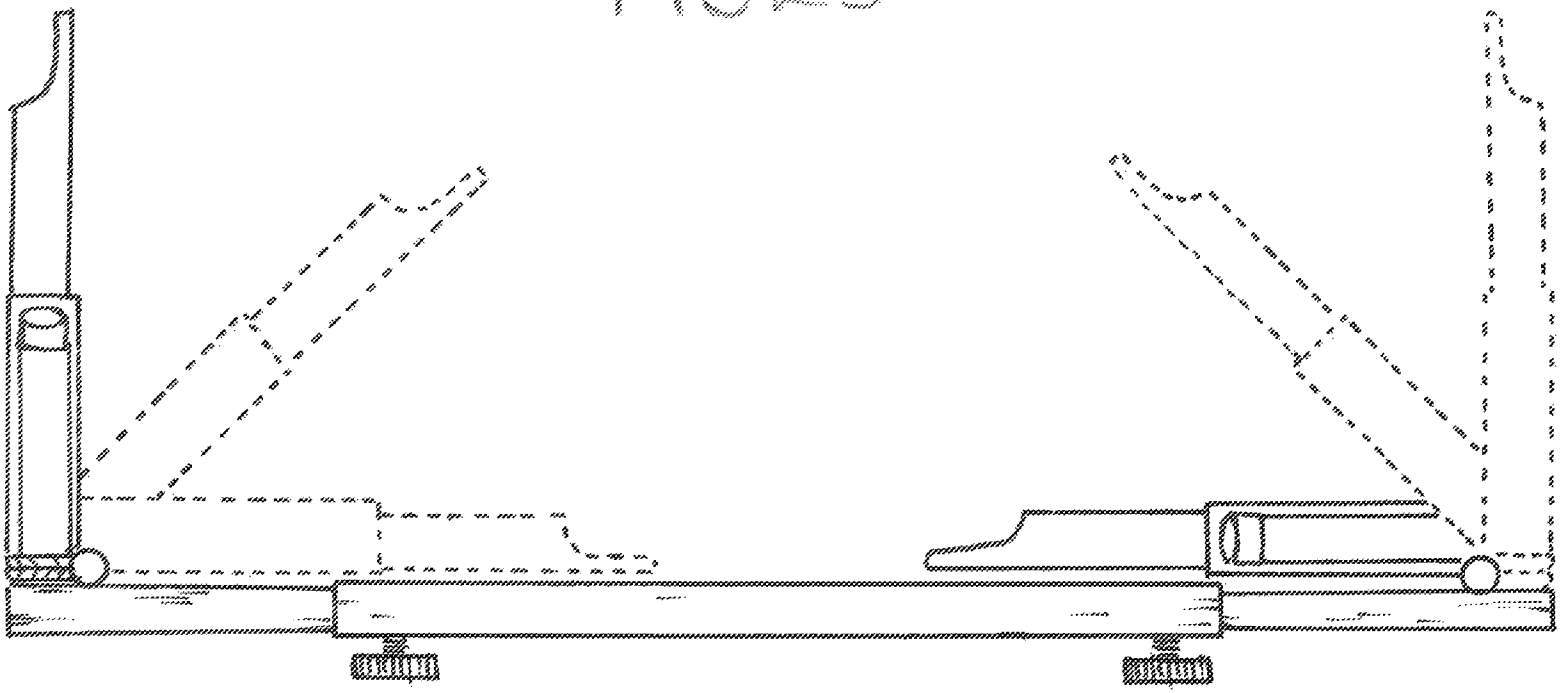
FIG. 23 illustrates the frame permanently welded and in operational mode.
Figure 24:
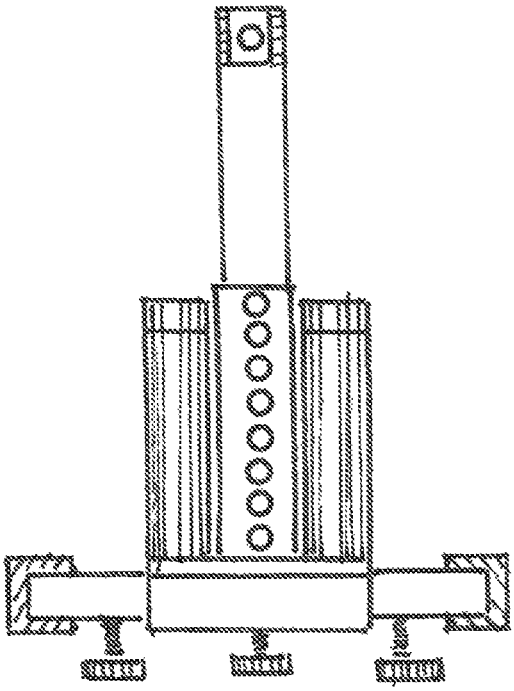
FIG. 24 illustrates a side view of the frame, and its height.
Figure 25:
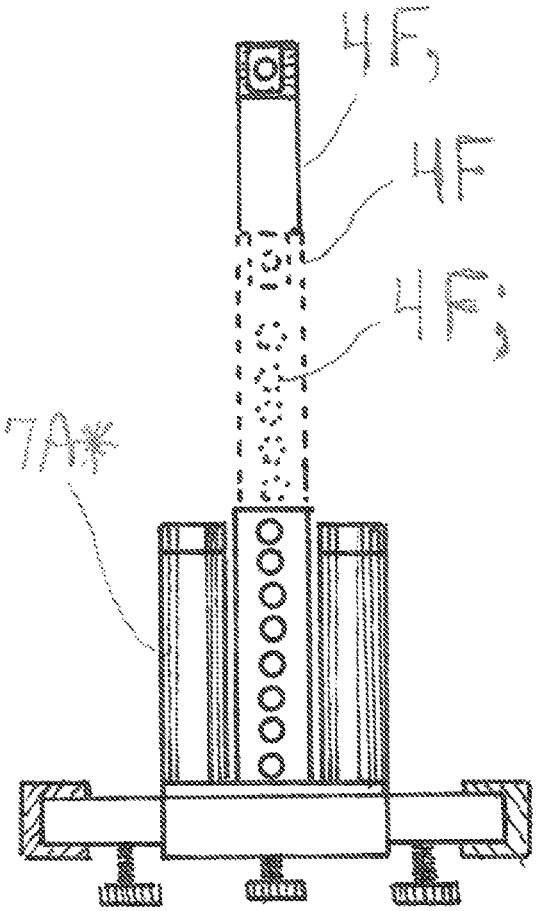
FIG. 25 illustrates a side view of the frame and its adjustment capability.

FIG. 18 illustrates a side view of the rectangle insert (15,) and said insert arms (7C,) and (7C;) that are attached to the rectangle insert (15,) these attach and detachable arms (7D,) and (7D;) are attached to these insert arms (7C;) and (7C,) the frame connector rod (10;) for holding and securing this invention, is attached to the attach and detachable arms (7D,) and (7D;) through the unseen orifices (5C,) and (5C;) attaching with wing nuts (8A,) and (8A;) to these arms (7D,) and (7D;) that are attached by turning screws (3F,) and (3F;) clockwise to tighten the arms (7D,) and (7D;) to the now frame (8C,). FIG. 19 illustrates the attaching frame. FIG. 20 illustrates that the arms can bend down or bend up. FIG. 21 illustrates an elevated view of the frame in the closed position with the arms folded down. FIG. 22 illustrates an elevated view of the frame in the open position with the arms folded down. FIG. 23 illustrates a side view of the frame permanently welded and the operational function of the arms. FIG. 24 illustrates a side view of the frame and the varying heights as shown in FIG. 25, of the detachable arm. FIG. 25 illustrates a side view of the frame, (7A*) it is illustrating the current heights (4F) and towards the top it is illustrating the extended height (4F,) it is adjusted by a series of orifices (4F;).

Figure 26:
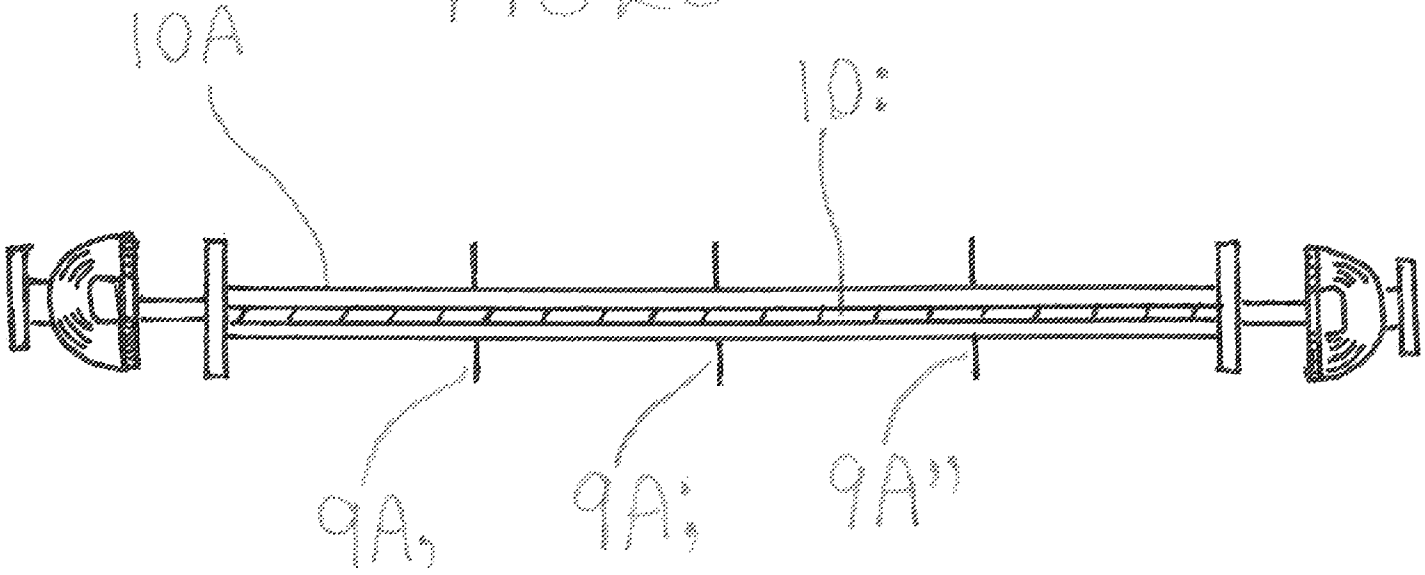
FIG. 26 illustrates the illuminating element being attached.
Figure 27:
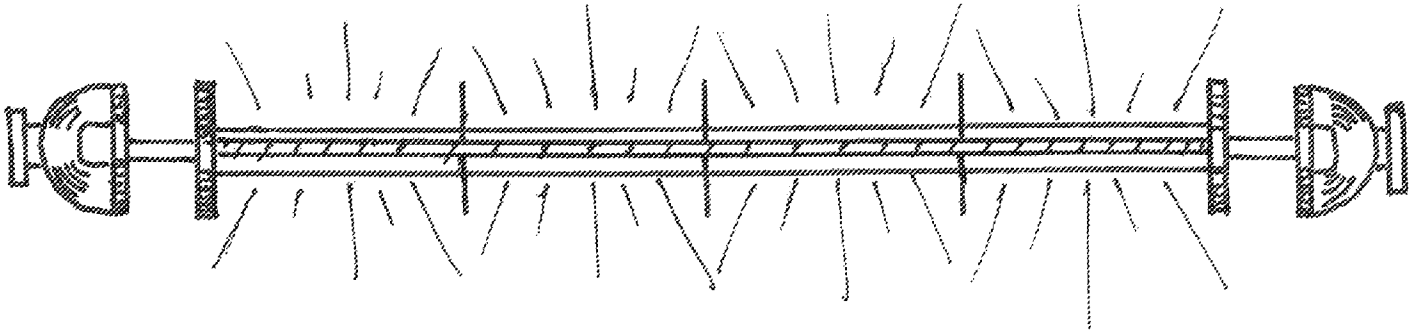
FIG. 27 illustrates that the lights can shine in opposite directions.
Figure 28:
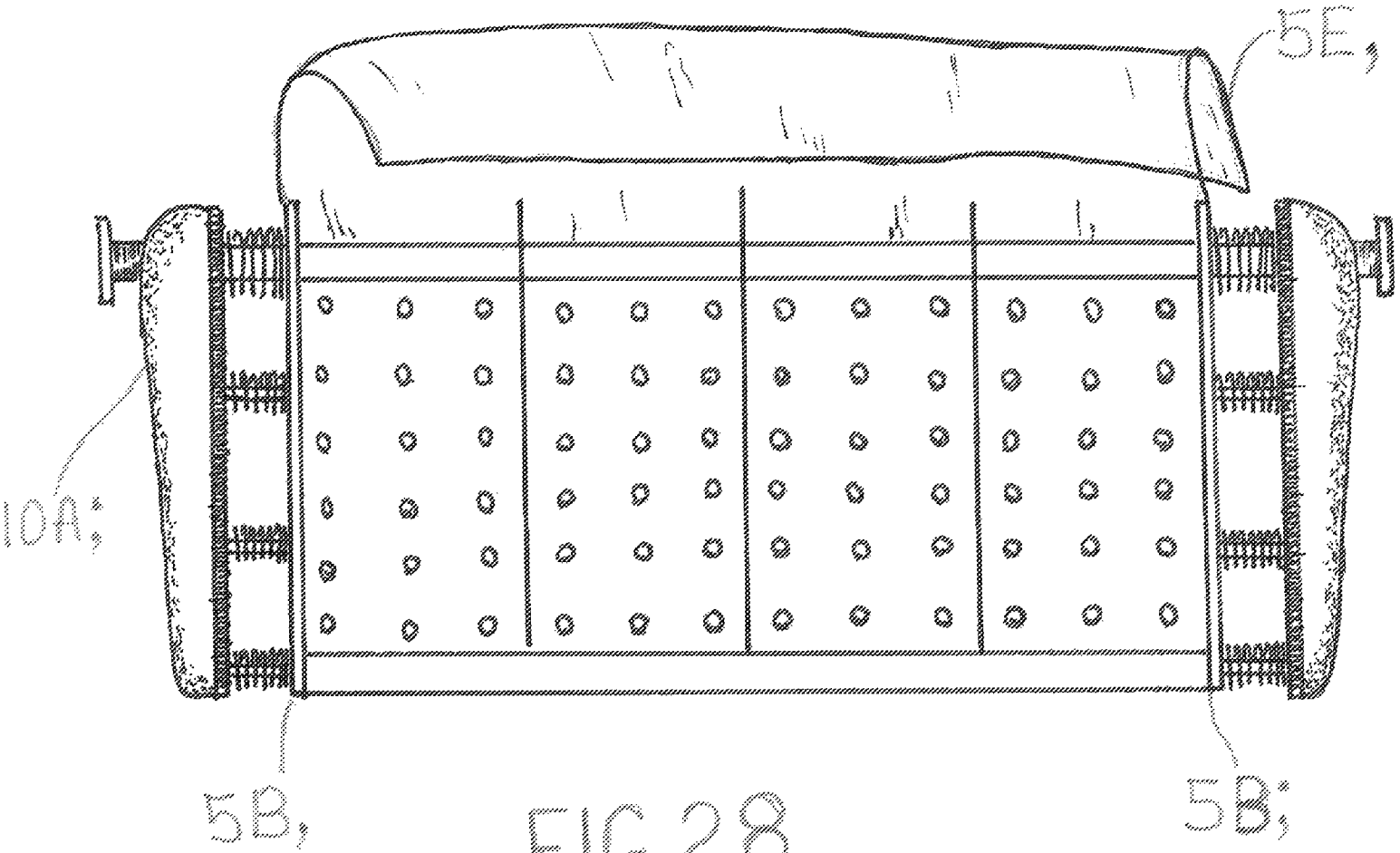
FIG. 28 illustrates a plastic shield draped over the invention.
Figure 29:
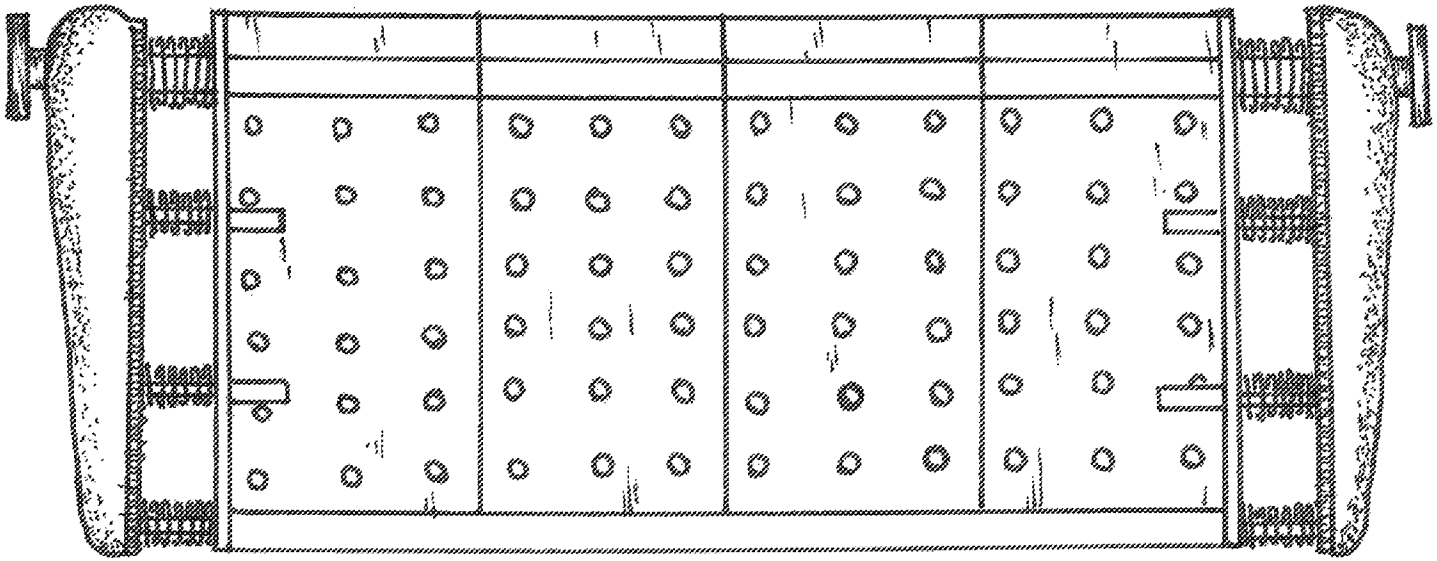
FIG. 29 illustrates the now advertising wing.
Figure 30:
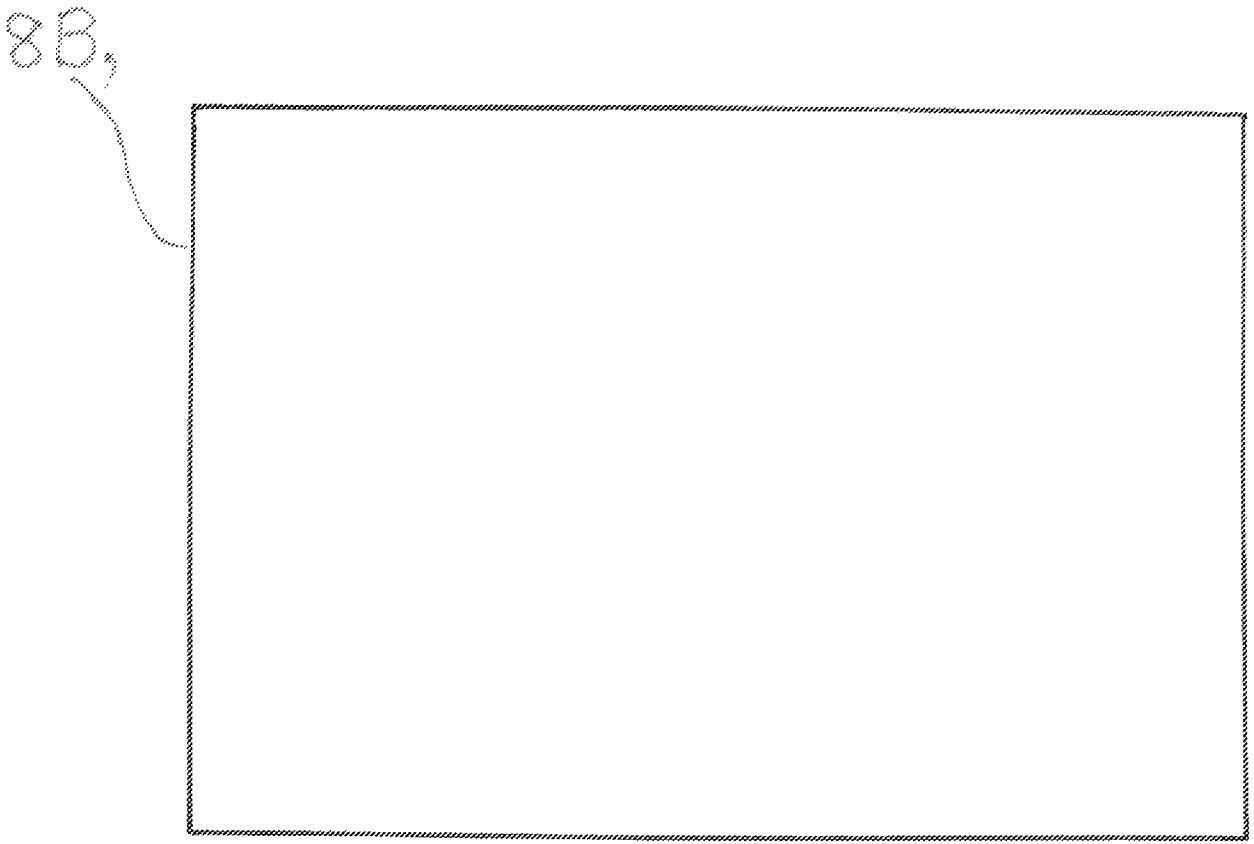
FIG. 30 illustrates a piece of cloth, fabric or cellophane plastic.
Figure 33:
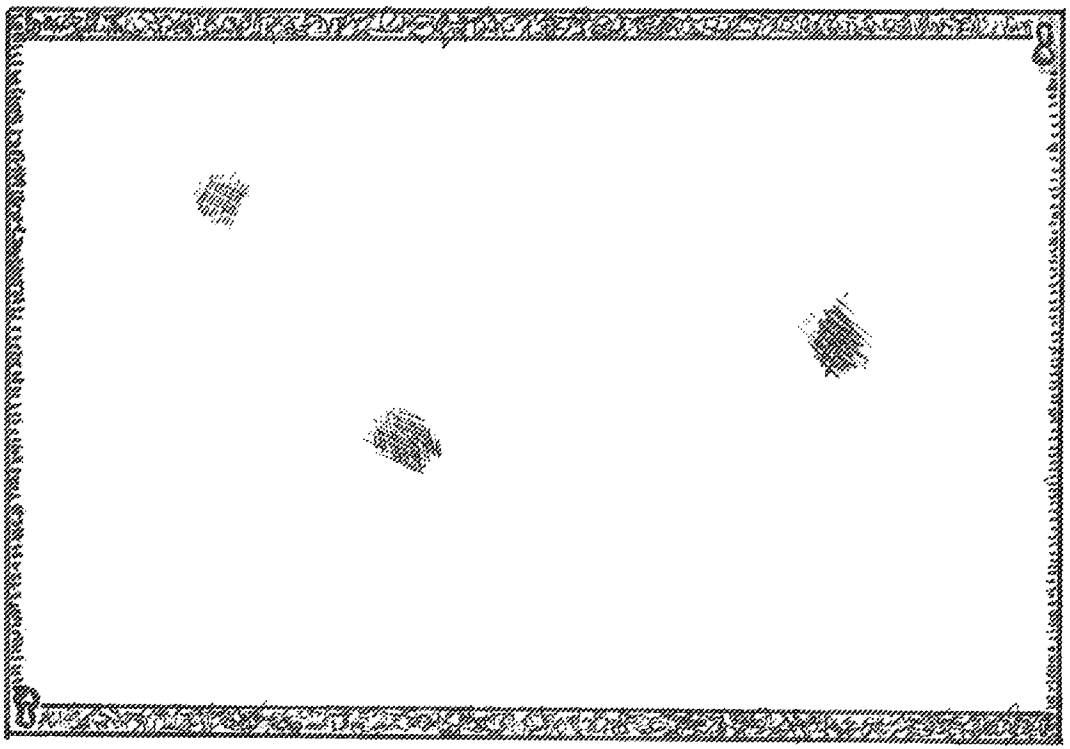
FIG. 33 illustrates an advertising means.
Figure 34:
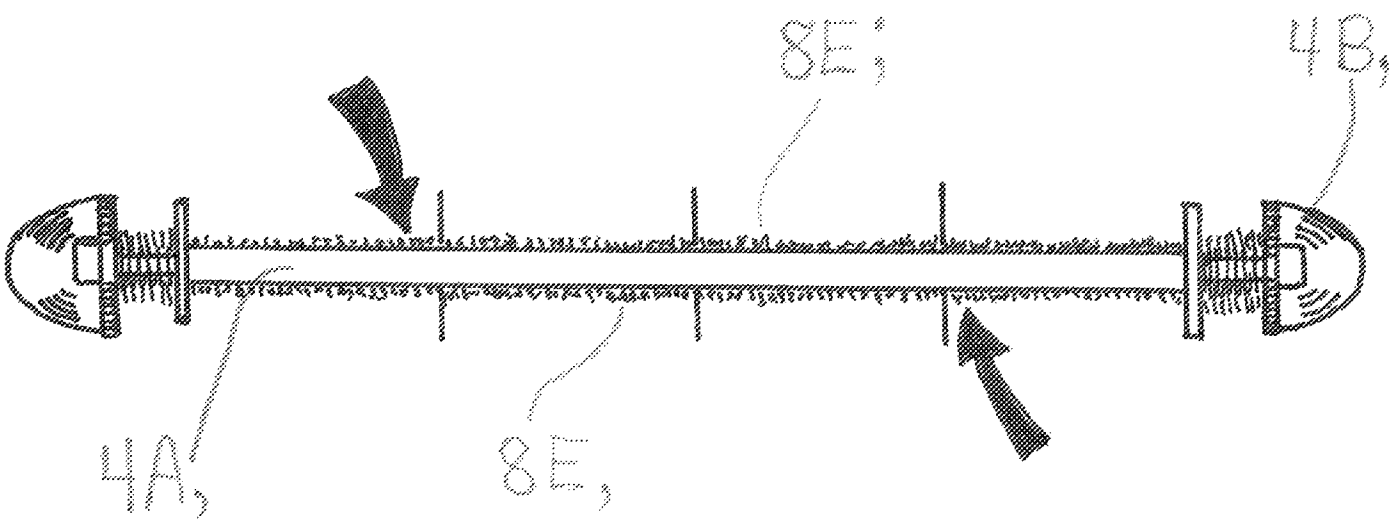
FIG. 34 illustrates a bottom view looking up at one of the attaching means.
Figure 35:
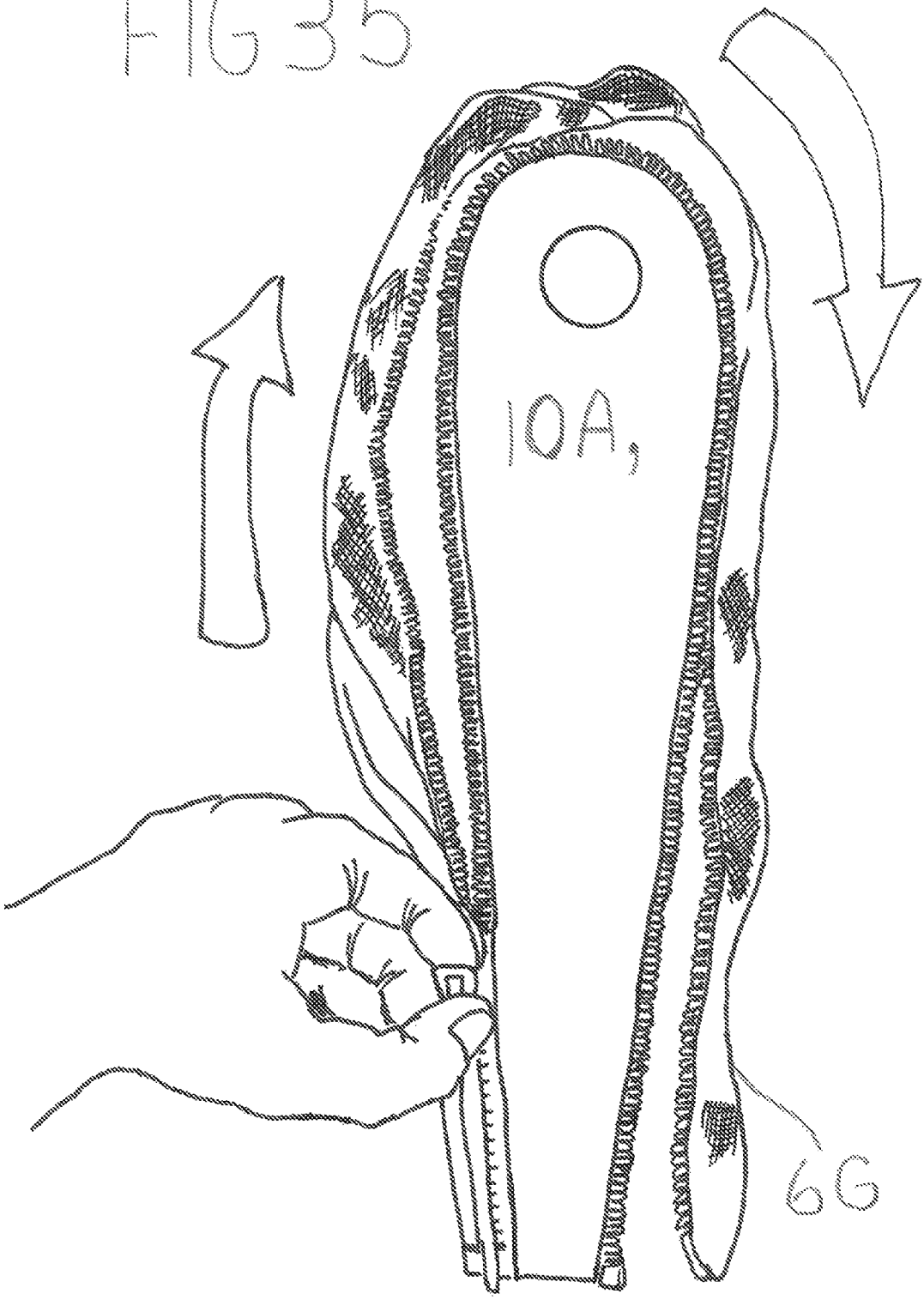
FIG. 35 illustrates the attaching means being attached from left to right.
Figure 36:
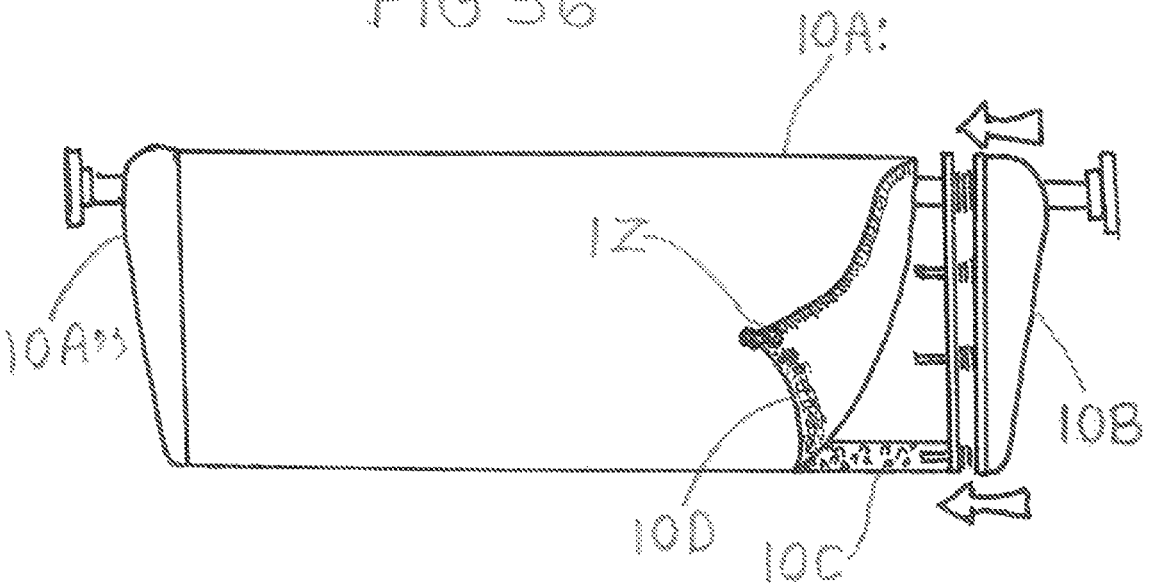
FIG. 36 illustrates the right side being attached to the advertising wing.
Figure 37:
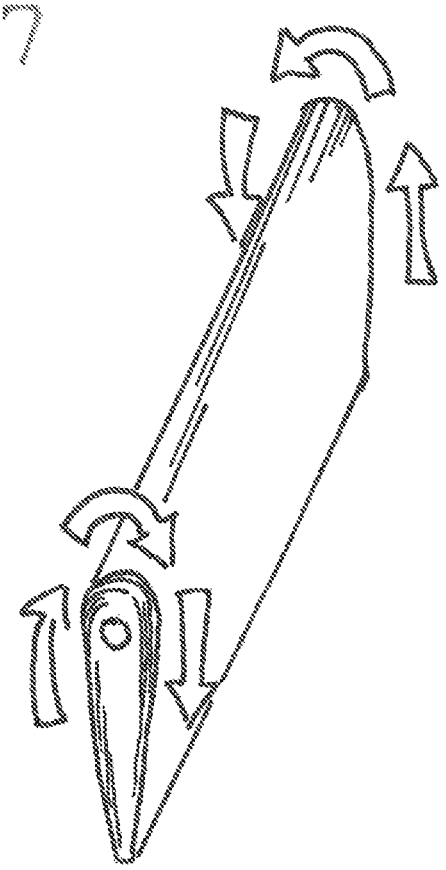
FIG. 37 illustrates the proper attachment method for attaching.
Figure 38:
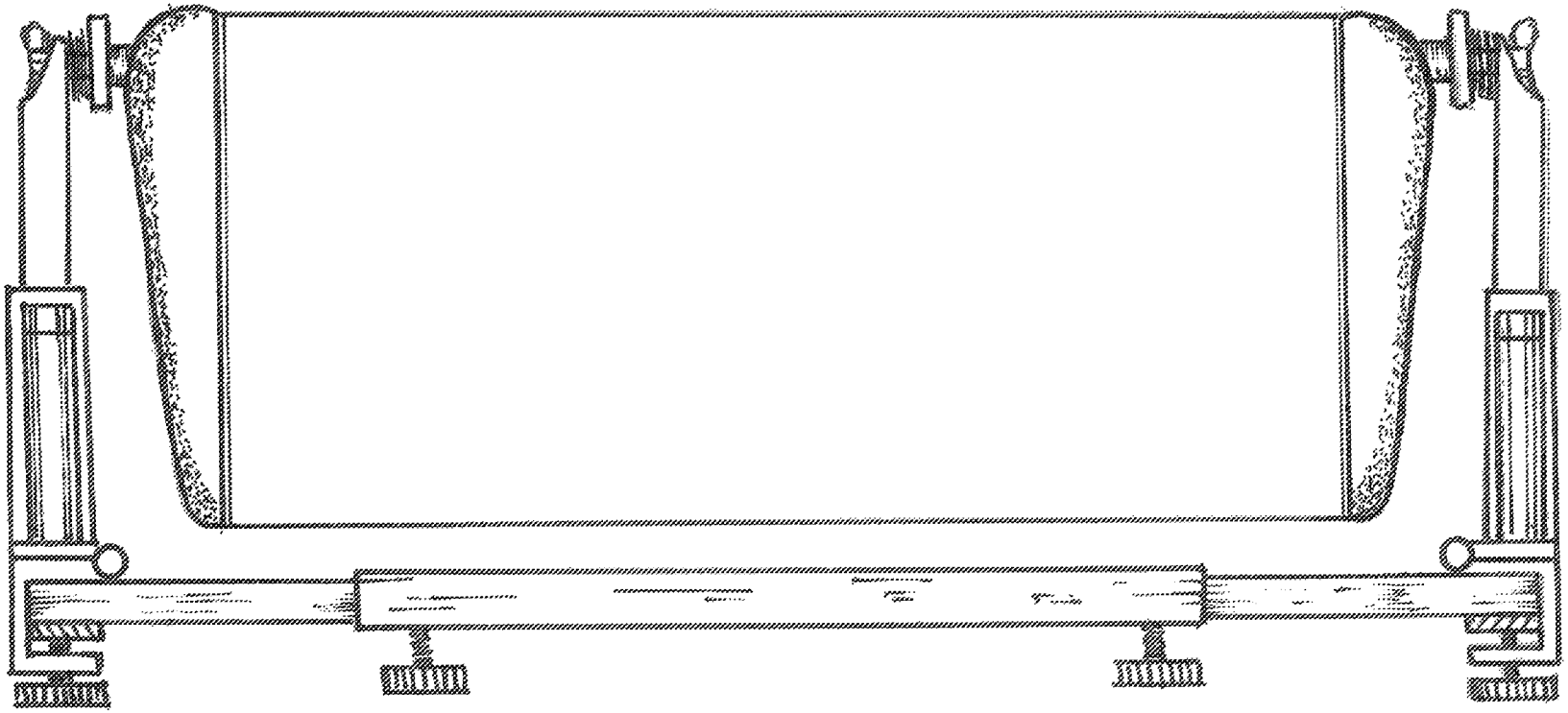
FIG. 38 illustrates the attaching frame and advertising wing.

FIG. 26 illustrates a bottom view looking up at this invention, it is illustrating this invention (10A) with three additional stationary braces (9A,) (9A;) and (9A") for stabilizing the illuminating element (10:) that is fixed up the center of the braces (9A,) (9A;) and (9A") or invention (10A) that can be made of plastic computer board and have flat L.E.D. lights attached to the front and backside of the illuminating element (10:) that could also be used as a flash board that could be used for enhancing other attaching embodiments. FIG. 27 illustrates a bottom view looking up at the middle illuminating element shining in both directions for the purposes of enhancing or illuminating a cloth or plastic element or other such similar embodiments for display. FIG. 28 illustrates this invention (10A;) this invention has a thin plastic shield (5E,) that is around 1 mm thick that has a measuring width and length of 30 by 40 inches however not being limited to, that is fixed to stationery braces (5B,) and (5B;) from the backside to the front side for keeping the invention water resistant. FIG. 29 illustrates an advertising wing. FIG. 30 illustrates a piece of thin plastic, fabric or cloth that could be made out of suede, cotton, leather, canvas nylon and all synthetic fabrics and sheeting. The piece of fabric (8B,) could have a measuring length and width of 41 by 34 inches the fabric (8B,) will be folded down so that it has a measuring length and width of 30 by 40 inches however not being limited to. FIG. 31 illustrates the backside of the fabric (8B;) that has a length of 40 inches by a width of 30 inches this will then have Velcro, hook and loops with this loops (8D) and (8D,) section sewn to the fabric (8B;) with stitching (2:) and (2;) from end to end on the backside section. FIG. 32 illustrates the backside section of the fabric. The fabric (8E) could have a measuring length and width of 30 by 40 inches, however not being limited to. The width side will then have zippers (8C:) and (8C;) sewn to the fabric (8E) with stitching (2B;) and (2B:) from end to end. FIG. 33 illustrates the attaching and advertising mean's that can now be printed on. FIG. 34 illustrates from the bottom looking up at the Advertising wing (4B,) it illustrates the bottom bar or square tube (4A,) with one of the three attaching means, Velcro hooks and loops, with the hooks (8E,) and (8E;) attached on both sides of the Advertising wing (4B,) bottom bar (4A,). FIG. 35 illustrates the left side partial view of the Advertising wing, (10A,) it is illustrating from left to right how to attach the display or advertising means (6G) to the advertising wing (10A,) being attached. FIG. 36 illustrates the advertising wing (10A") partially connected to the advertising cover (10A:) to attach the right side, the connective gear (10B) right-side arm is pushed in, and then the advertising cover (10A:) is pulled over the connective gear (10B) attaching the Velcro, hooks and loops, to both the hooks (10C) to the loops (10D) on both sides allowing the zipper (1Z) to be zipped from left to right attaching the advertising cover (10A:) to the connective gear right arm (10B). FIG. 37 illustrates how the advertising cover is attached from left to right on both sides. FIG. 38 illustrates the frame connected to the Advertising wing.

Figure 39:
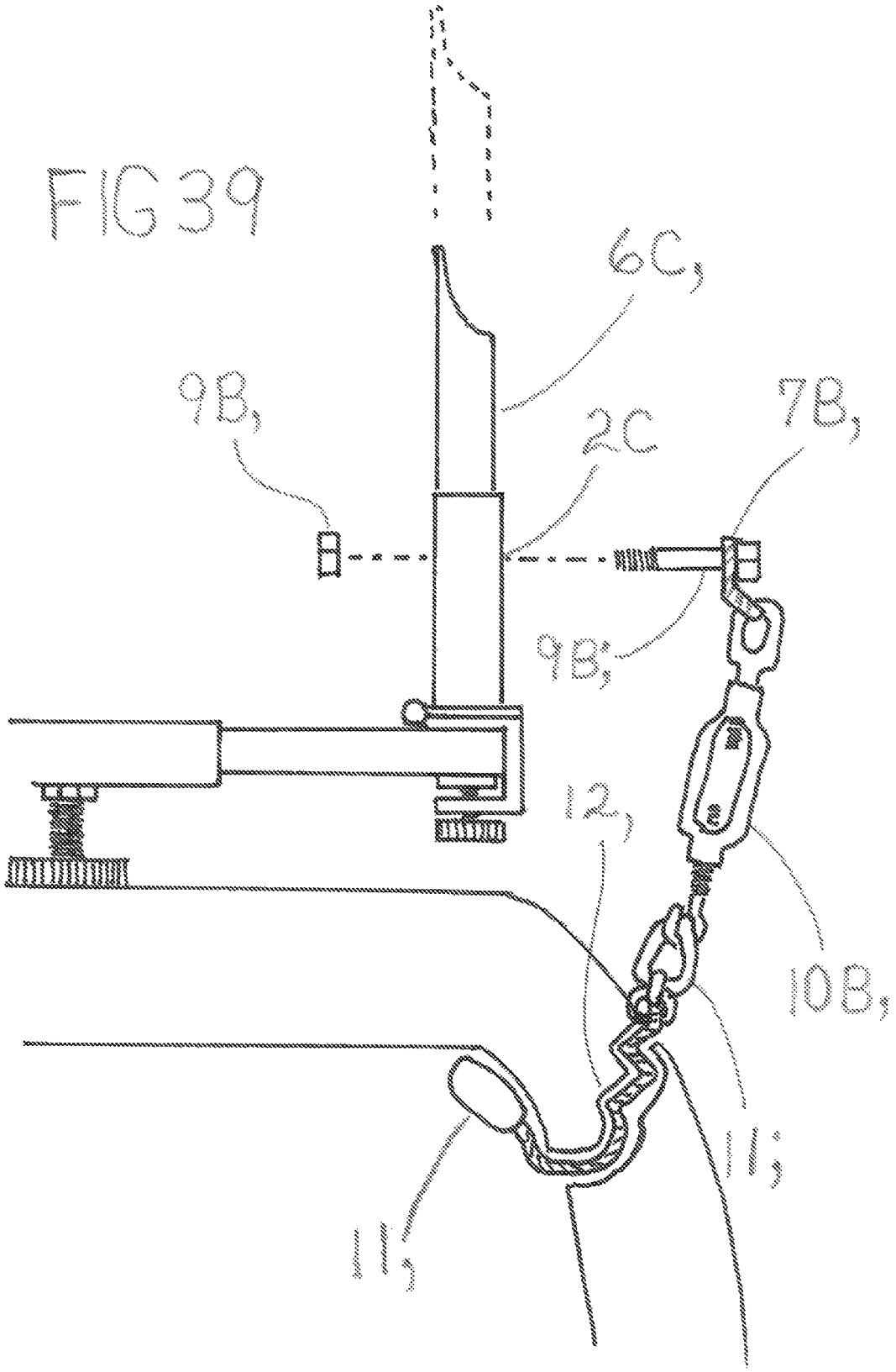
FIG. 39 illustrates the attaching of the invention on top of a car.
Figure 39A:
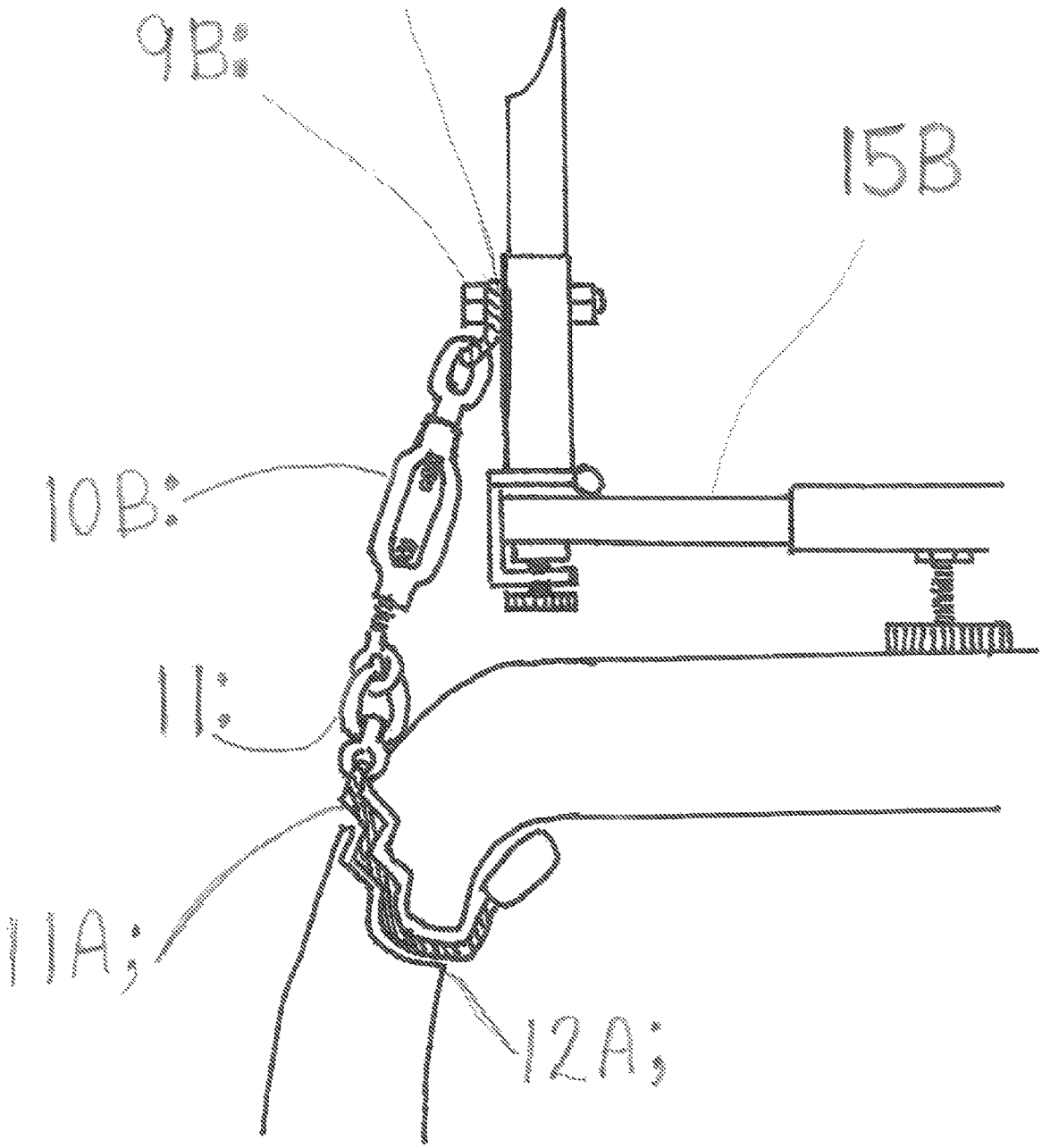
Figure 40:
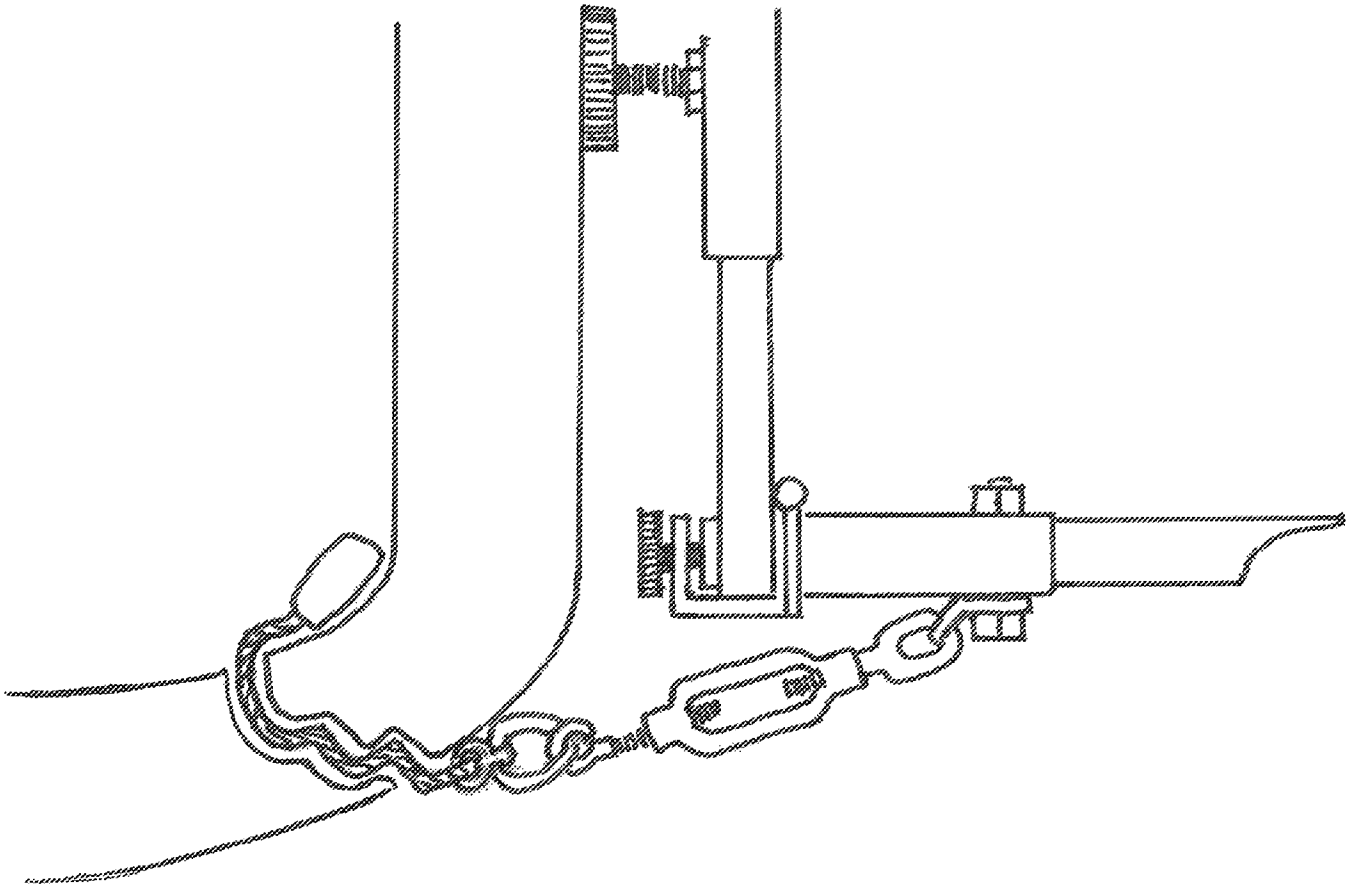
FIG. 40 illustrates the frame attached.
Figure 41:
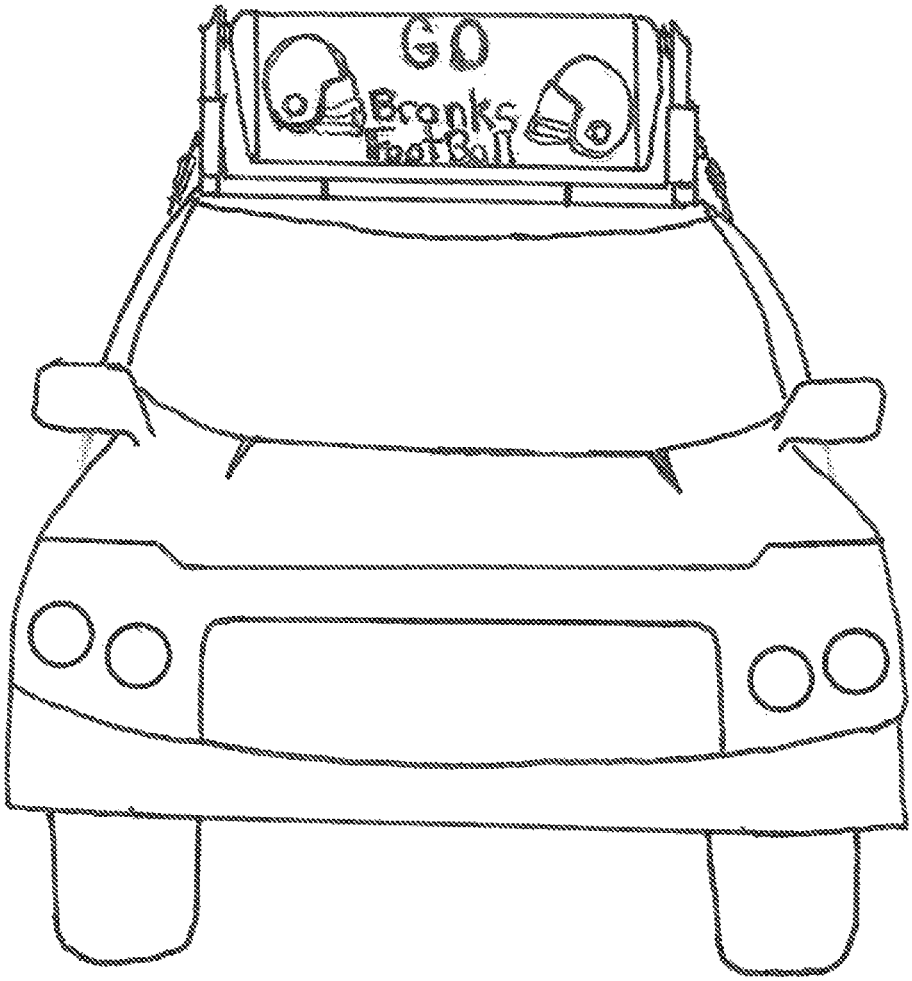
FIG. 41 illustrates the advertising wing and frame attached on top of a car.
Figure 42:
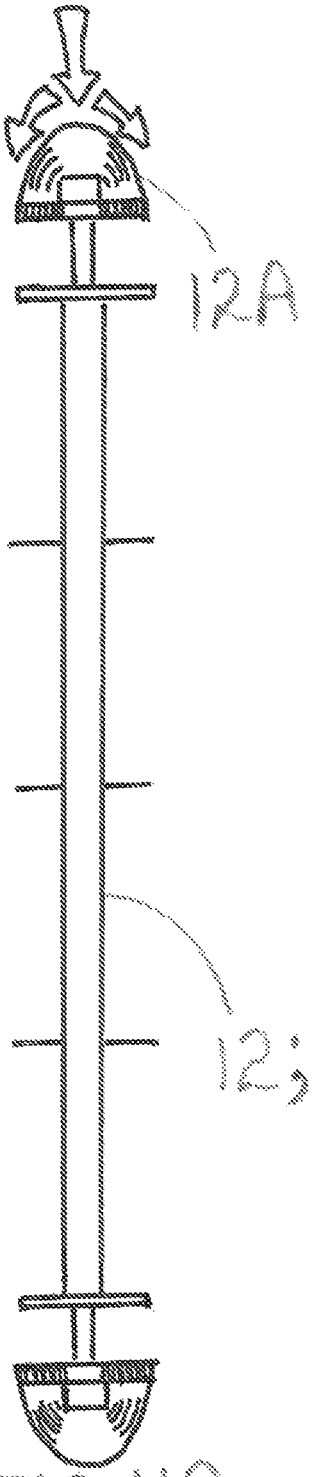
FIG. 42 illustrates the aerodynamic attributes of the invention.
Figure 43:
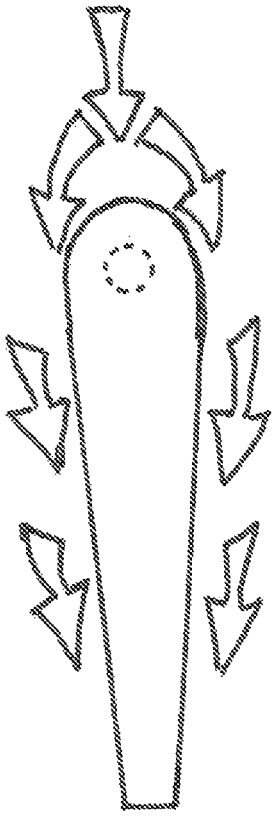
FIG. 43 illustrates a side view of the invention and the aerodynamic attributes.
Figure 44:
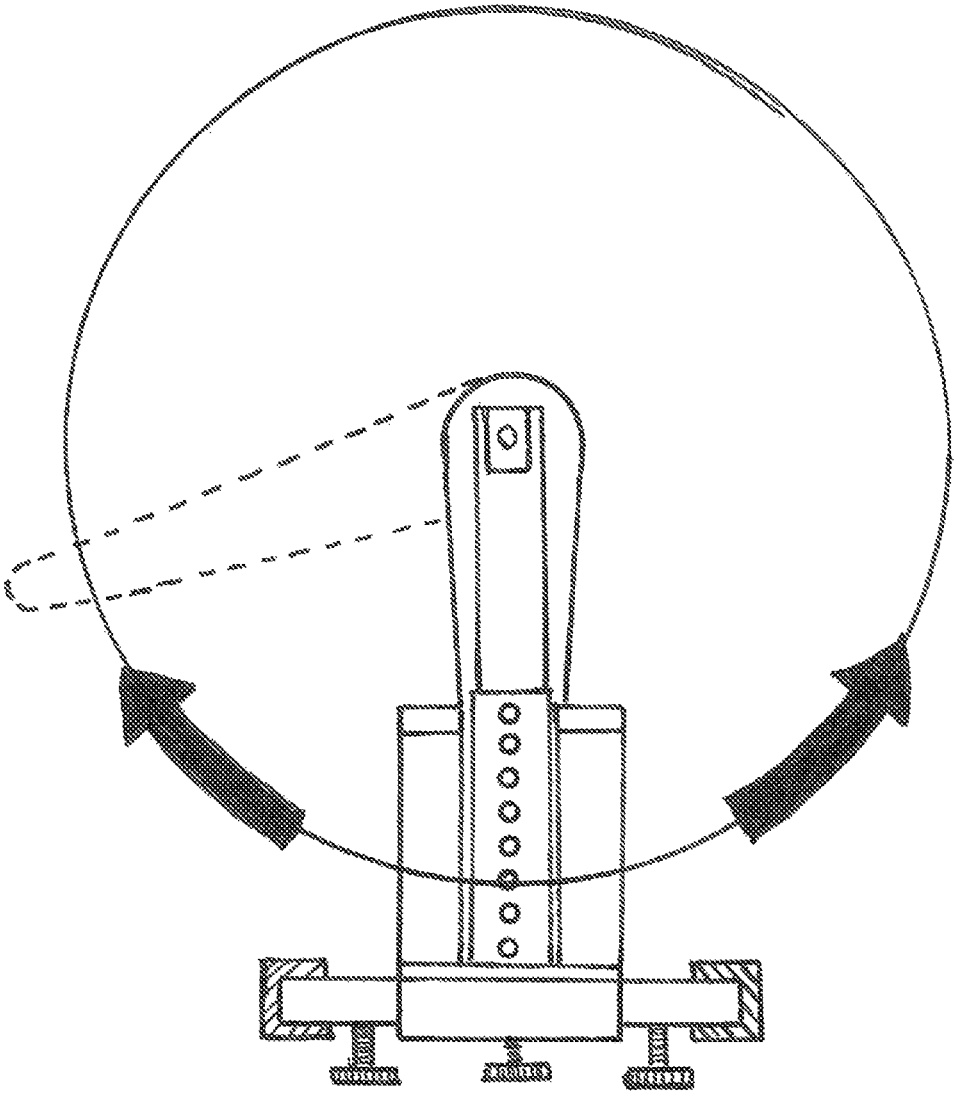
FIG. 44 illustrates that the invention can rotate 365 degrees clock wise or counter clock wise.
Figure 44A:
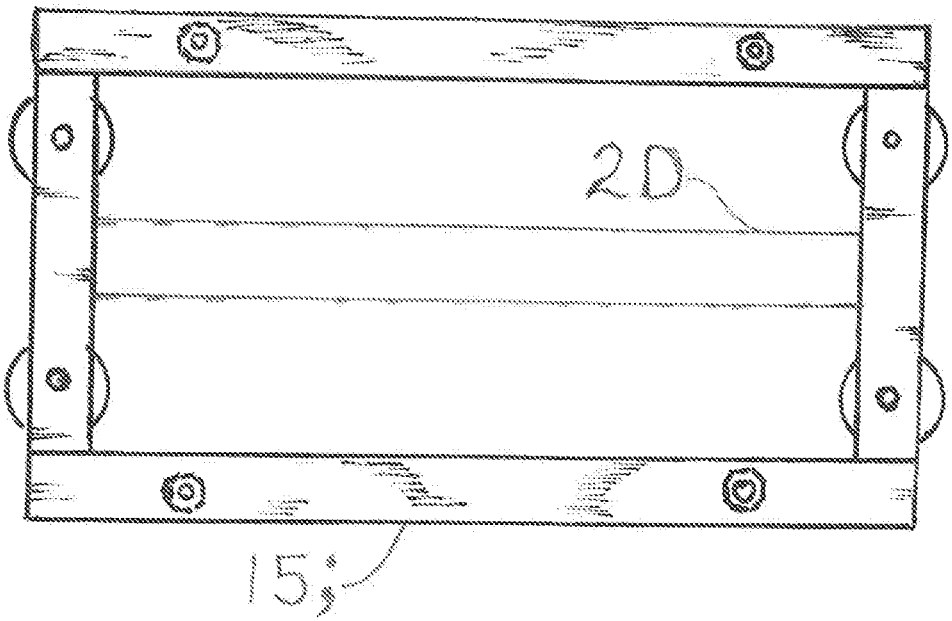
FIG. 44A illustrates the rectangle insert parcel frame with the removable magnetized stabilizer bar.
Figure 44B:
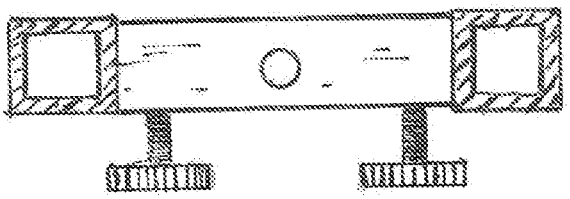
FIG. 44B illustrates the placing of the orifice right side view.
Figure 44C:
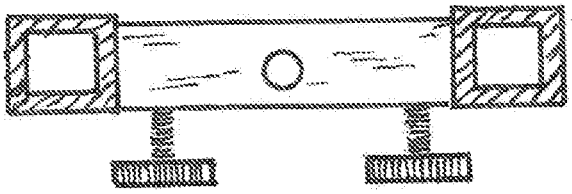
FIG. 44C illustrates the placing of the orifice left side view.
Figure 4D:
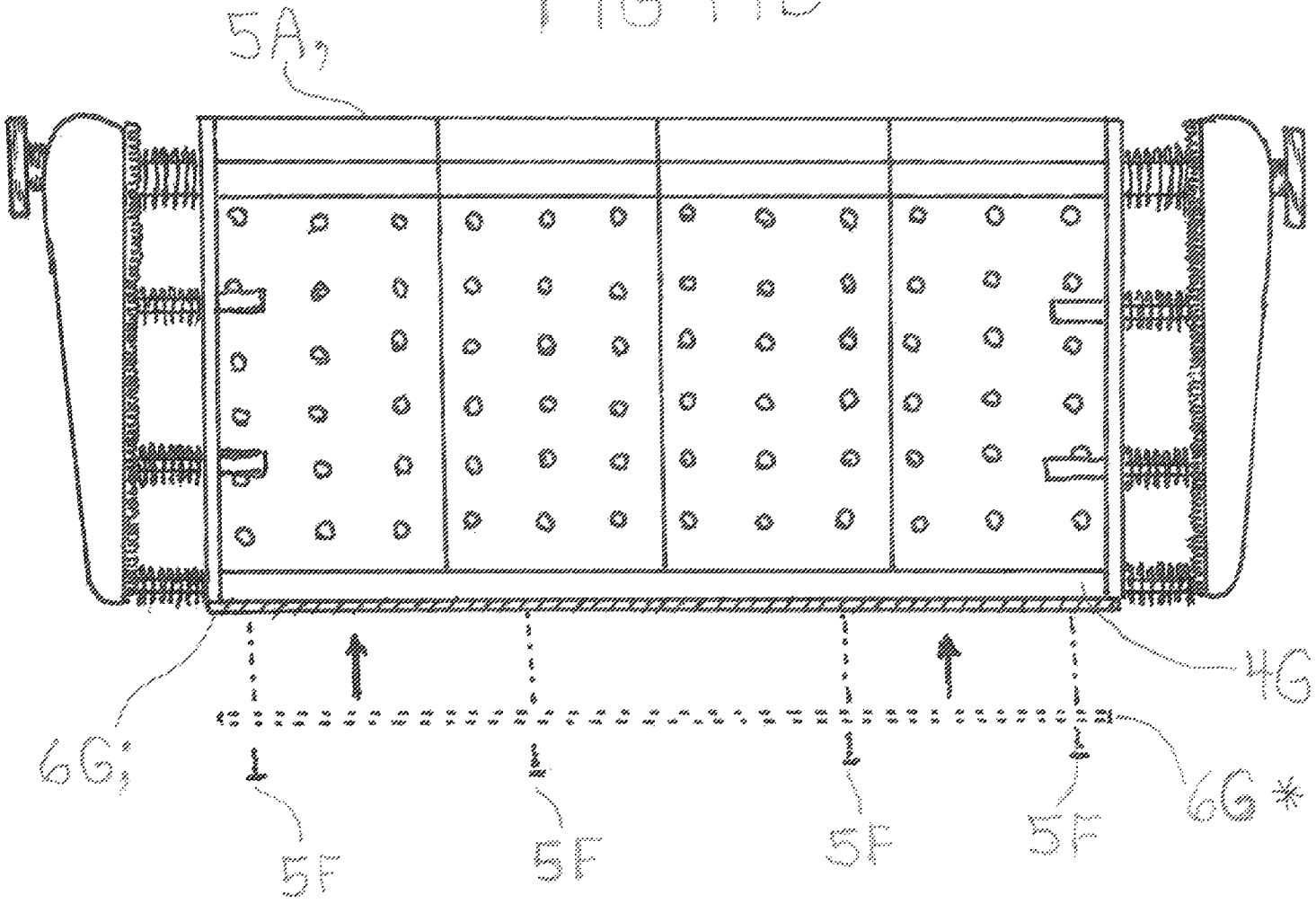
Figure 44E:
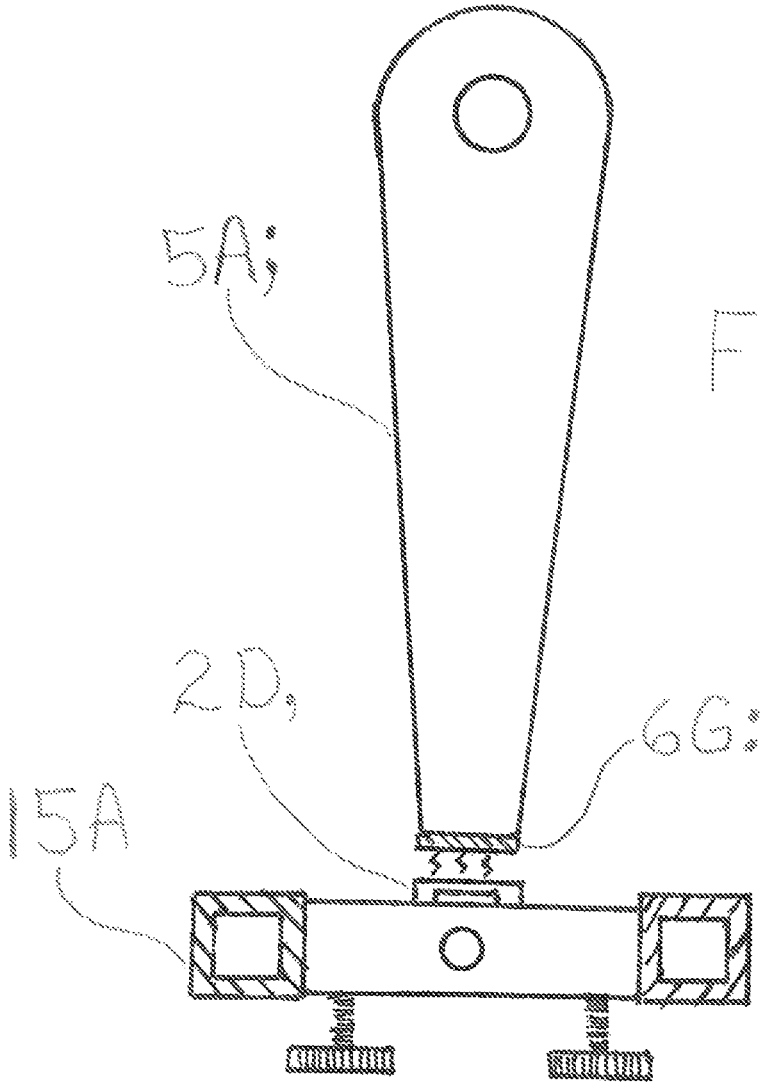
FIG. 44E illustrates a partial side view of the advertising wing being stabilized by a removable magnetized rectangle bar.
Figure 44F:
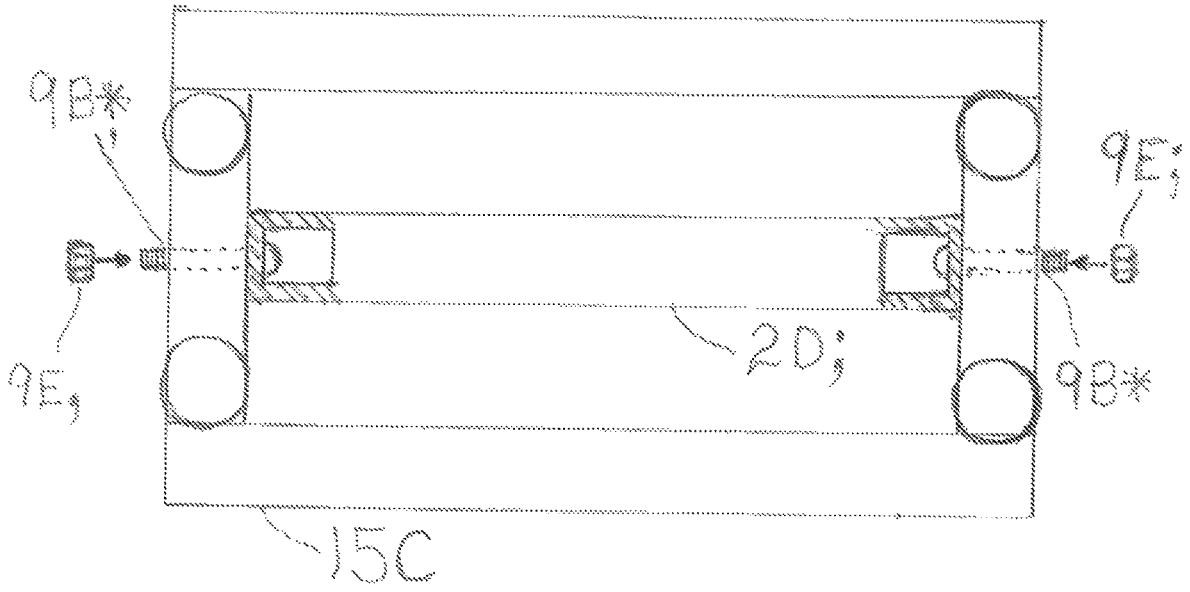
FIG. 44F illustrates the attach and adjustment nut and bolts.
Figure 44G:
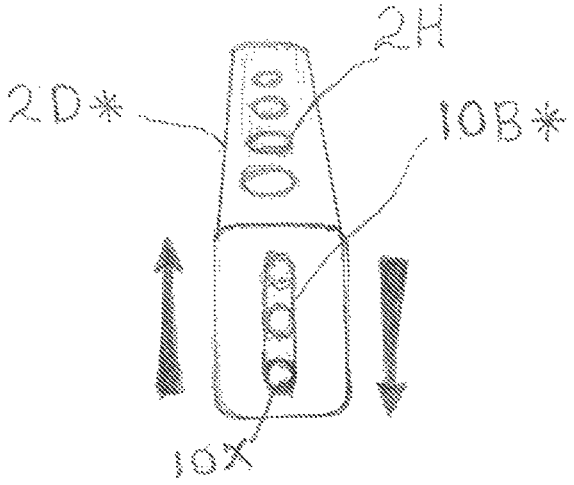
FIG. 44G illustrates the magnets and elongated orifice for adjusting up or down.

FIG. 39 illustrates how the frame can temporarily be attached on the hood of a vehicle. In this illustration it is illustrating a detachable adjusting arm (6C,) that can fold down for the purposes of storing the frame away, the detachable arm (6C,) and frame that can adjust up or down for the purposes of attaching to different size embodiments when aligned with inner and outer unseen orifices (2C) however not being limited to the bolt (9B;) will then penetrate these orifices (2C) of the arm (6C,) having attached to the bolt (9B;) is a attaching bracket (7B,) that in turn has attached to it a turnbuckle (10B,) and chain link (11;) were the T, stabilizer (11,) will match and aligned with the car door jamb (12,) and the bolt (9B;) will then attach to the nut (9B,) securing the frame and arm (6C,) that can attach to other embodiments to the car and door jam. (12,). FIG. 40 illustrates the frame attached. FIG. 39A illustrates how the left side attaching arm is attached starting with the frame (15B) that is attached to the bolt (9B:) that is in turn attached to the bracket (7B;) that is in turn attached to the turnbuckle (10B:) and the turnbuckle is then attached to the chain link (11:) and the chain link is intern attached to the T, stabilizer (11A;) that is attached to the car door jamb (12A;). FIG. 41 illustrates the advertising wing and frame attached on top of a vehicle, for the purposes of advertising. FIG. 42 illustrates a bottom view looking up at the advertising wing (12;). The advertising wing is illustrating the aerodynamic attributes of the glide arm (12A) side view for the purposes of reducing air foliage for blowing in the wind. FIG. 43 illustrates a side view and the aerodynamic properties of the sphere or advertising wing having one end bigger at the top and a smaller more narrow end at the bottom for wind resistance and foliage. FIG. 44 illustrates the properties of the unseen orifice at the top that enables this embodiment to spin 365 degrees clock wise or counter clock wise for the purposes of adapting to wind resistance. FIG. 44A illustrates the rectangle insert (15;) it is illustrating the removable multifunctional magnetized stabilizer bar (2D) that can be adjusted up or down by orifices to the right and left sides that can be seen in FIGS. 44B and 44C. FIGS. 44B and 44C include right and left side view, respectively, for the purposes of attaching the rectangle insert (15;) to the magnetize stabilizer bar (2D) with screws. FIG. 44F illustrates a bottom view of the rectangle insert (15C) with the magnetized stabilizer bar (2D;) being attached with bolts (9B*) (9B,*) as well as nut (9E,) and (9E;) to the rectangle insert (15C). FIG. 44G illustrates the magnetized stabilizer bar (2D*) it is illustrating the round magnets (2H) that can be adjusted up or down by turning them clock wise or counter clock wise however not being limited to that can also be adjusted up and or down by the elongated orifice (10B*) by screws or bolt placings being represented by circles (10*x*) being at the top, middle, or bottom of the elongated orifice (10B*). FIG. 44D illustrates the advertising wing. The Advertising wing (5A,) at the bottom it is illustrating a piece of thin plate steel (6G;) and its former placing, (6G*) that is ⅛ inch thick by 1 inch in width by a length of 37½ inches, however not being limited to that is then attached to the advertising wing (5A,) bottom stationary square tube brace (4G) and is secured with screws (5F). FIG. 44E illustrates a partial side view of the frame, the frame (15A) and advertising wing (5A;) at the bottom of it, it is illustrating the thin plate steel (6G:) that is used to attract the removable magnetized stabilizer bar (2D,) that can be adjusted up or down to control pivot and or swinging of the advertising wing (5A;) when in motion by a moving vehicle.

Figure 45:
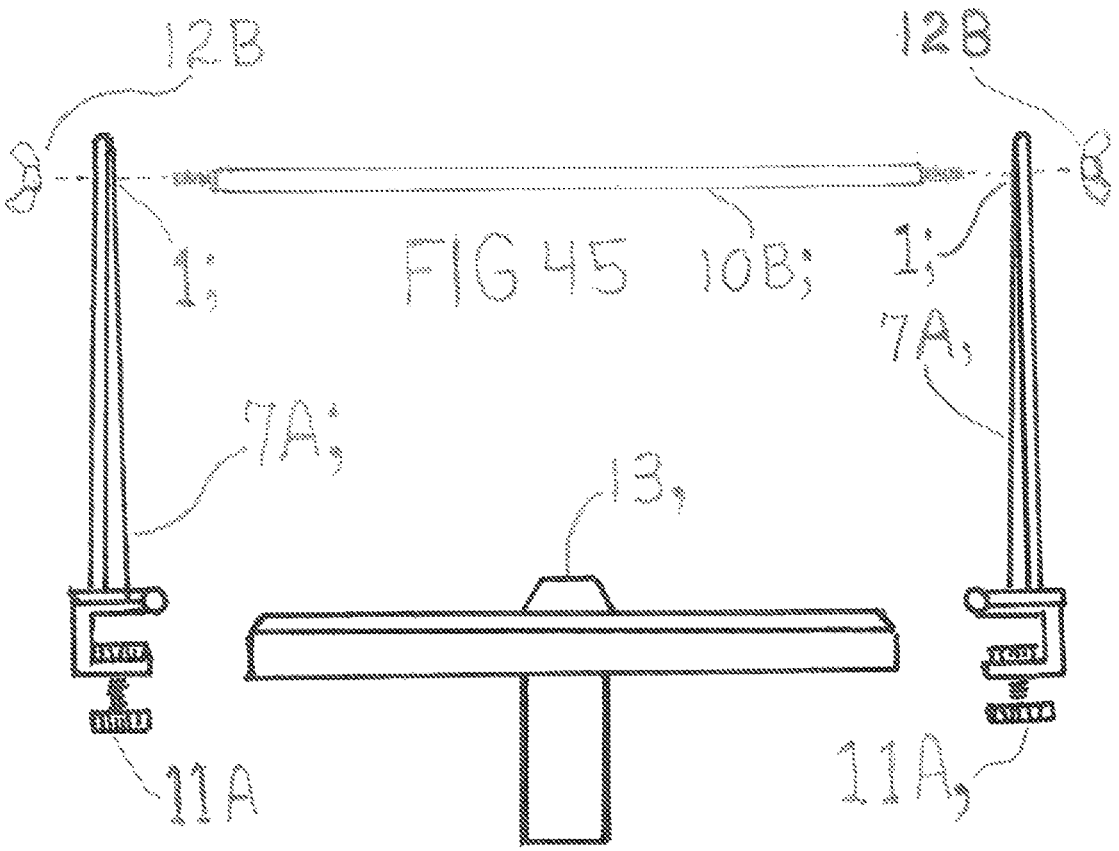
FIG. 45 illustrates the right and left side attach and detachable arms to be attached to a middle embodiment that is attached to a vehicle.
Figure 46:
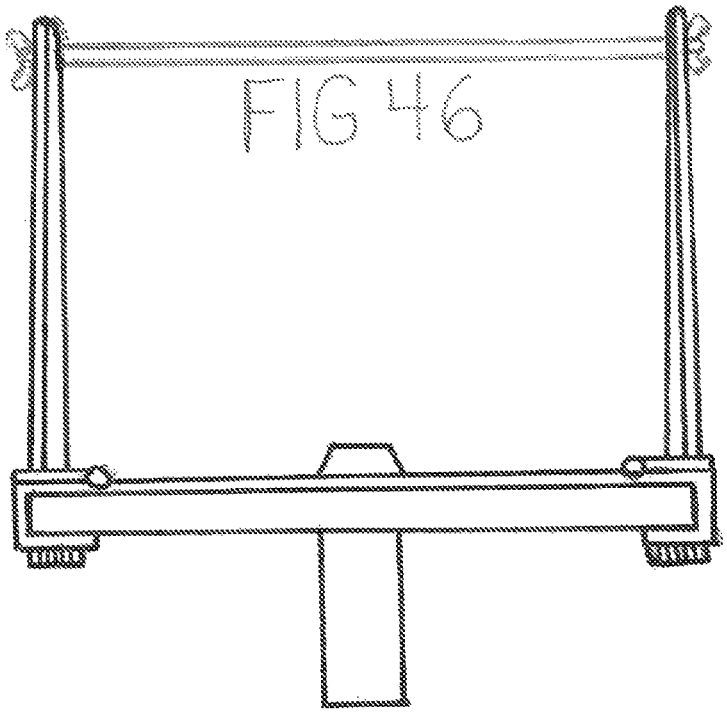
FIG. 46 illustrates these attach and detachable arms now attached that comprise the now frame.
Figure 47:
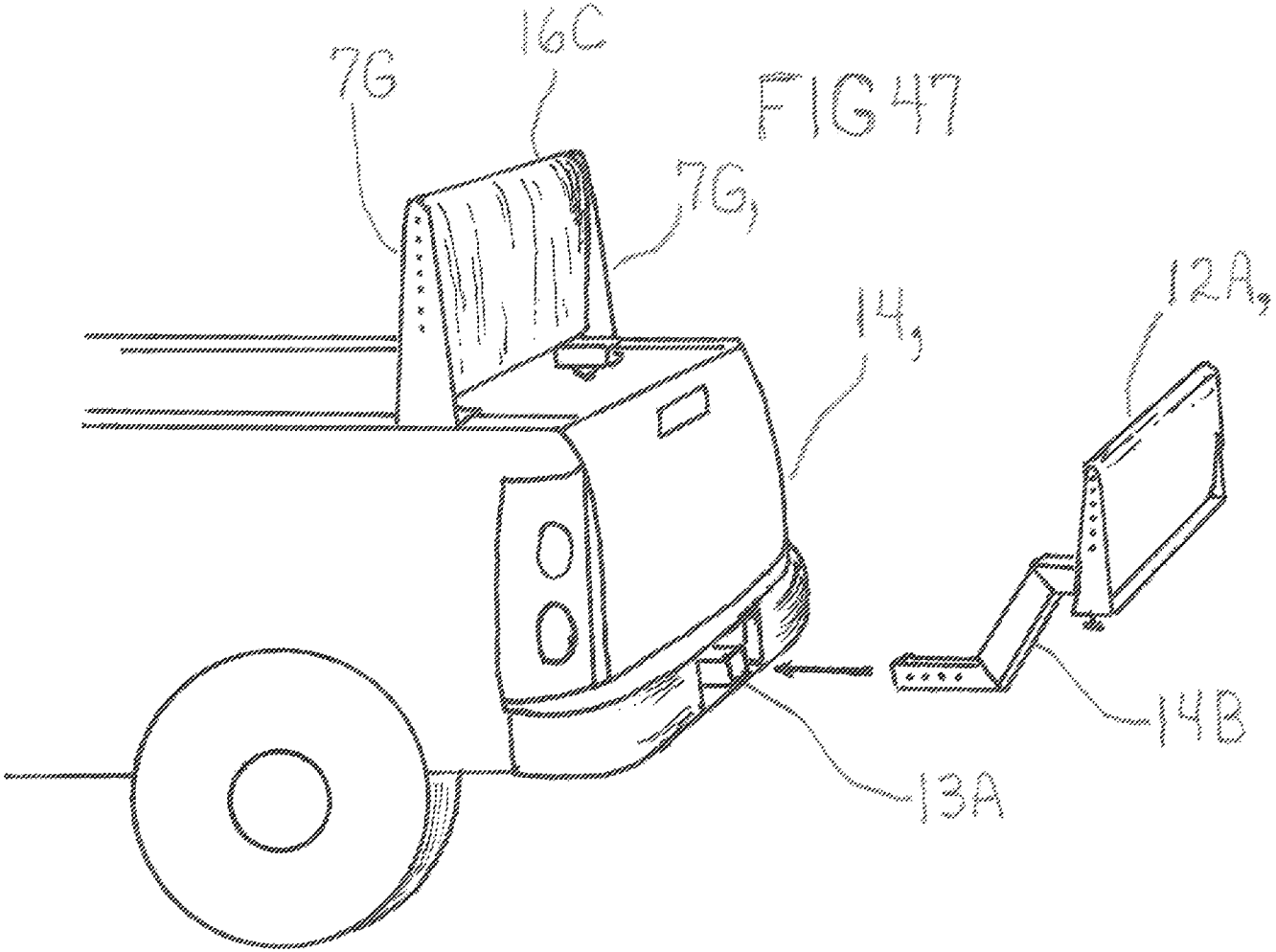
FIG. 47 illustrates the invention in the stages of being attached.
Figure 47A:
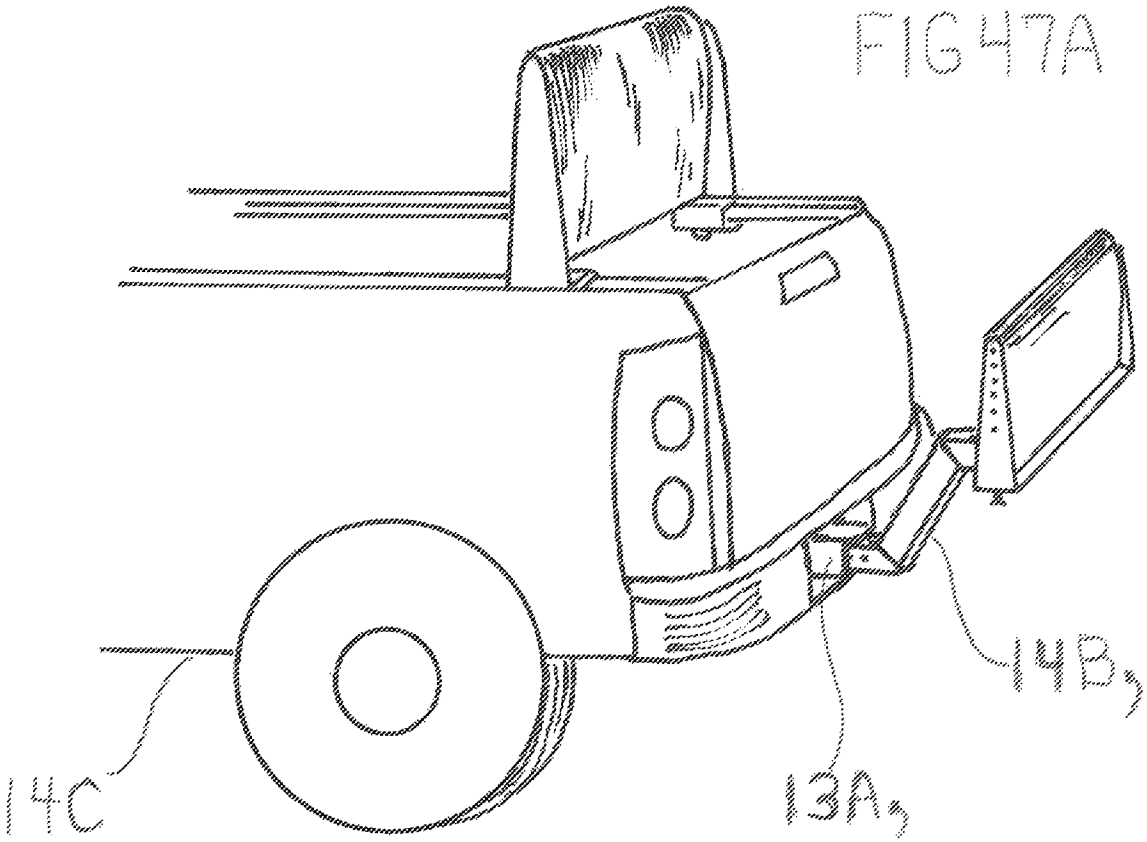
FIG. 47A illustrates the invention attached to the bumper pull.
Figure 48:
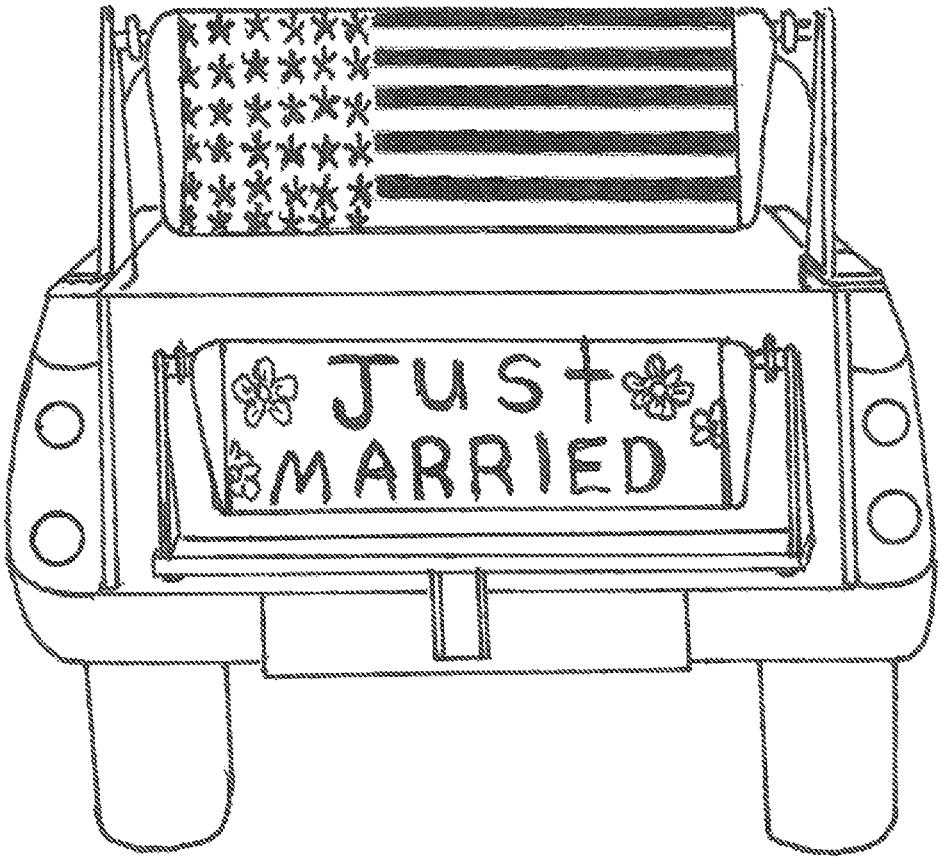
FIG. 48 illustrates from top to bottom attached, the advertising means.
Figure 49:
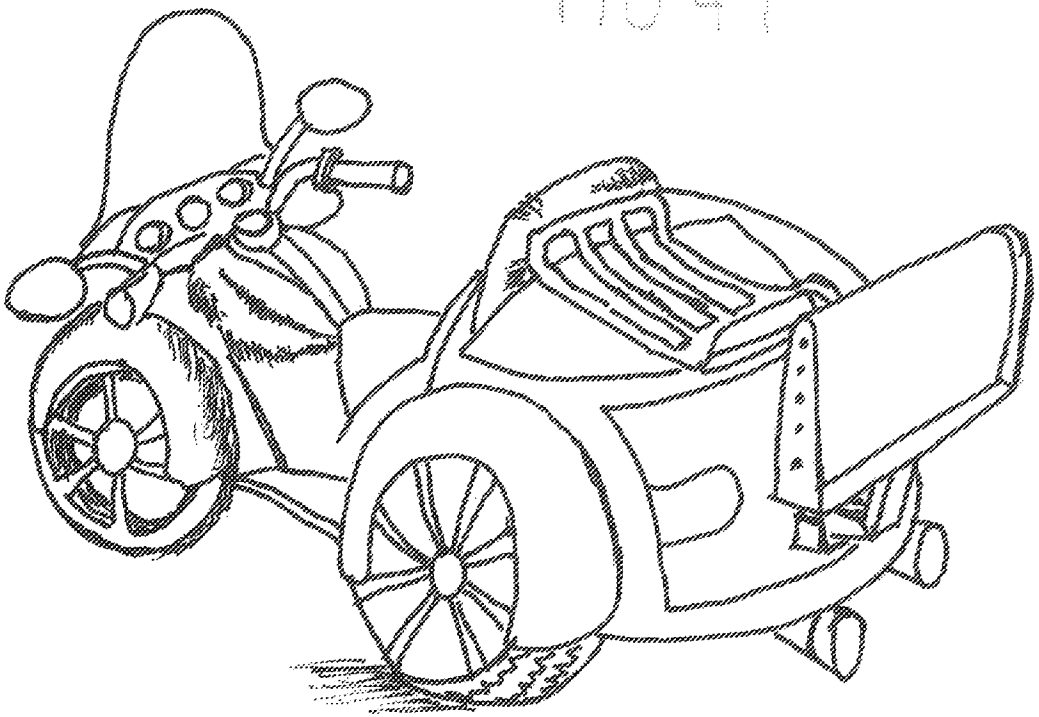
FIG. 49 illustrates the device attached to a three wheeled motorcycle.
Figure 50:
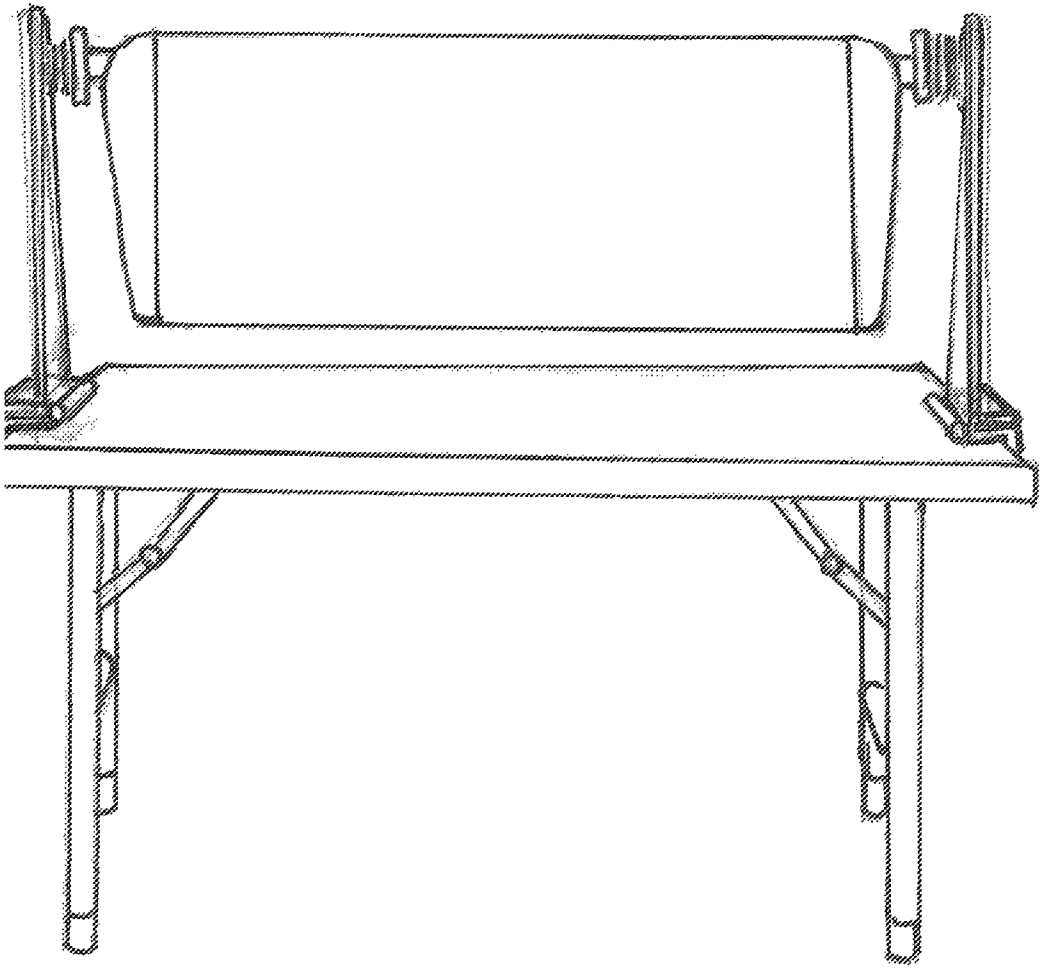
FIG. 50 illustrates the invention with the arms attached to a table.
Figure 51:
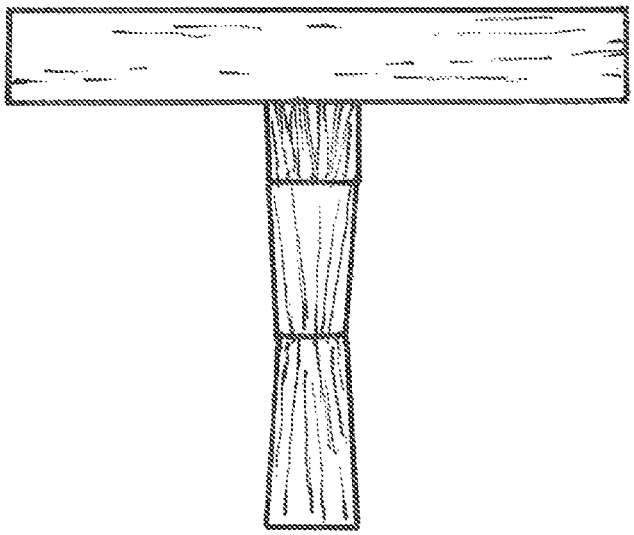
FIG. 51 illustrates an elevated view looking down on the hitch frame connector.
Figure 52:
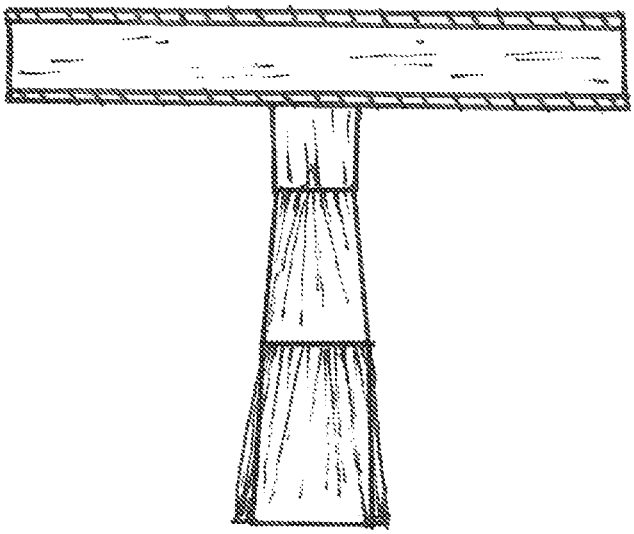
FIG. 52 illustrates a bottom view looking up at the hitch frame connector.
Figure 53:
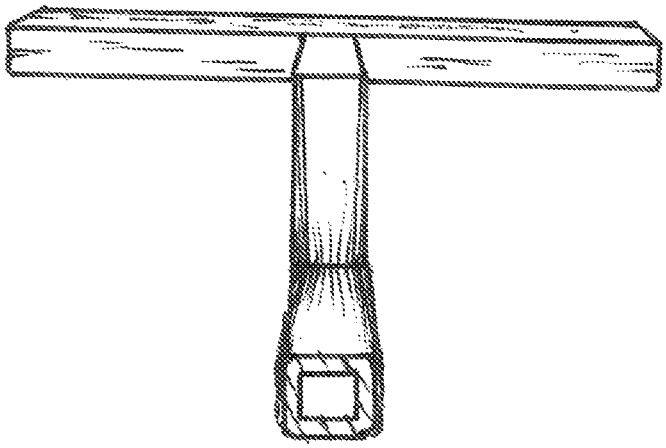
FIG. 53 illustrates a rear view of the hitch frame connector.
Figure 54:
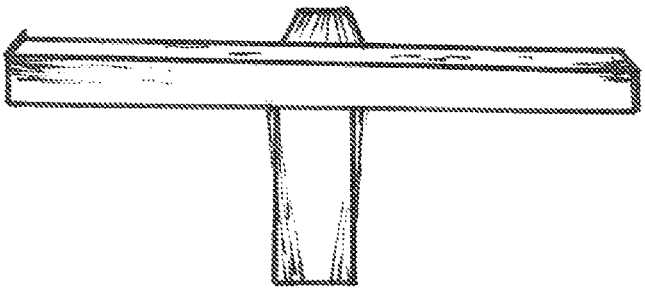
FIG. 54 illustrates a front view of the hitch frame connector.
Figure 57:
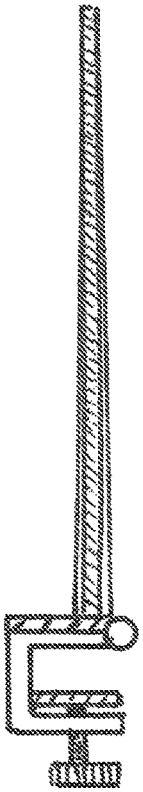
FIG. 57 illustrates a right side view of the attach and detachable arm.
Figure 58:
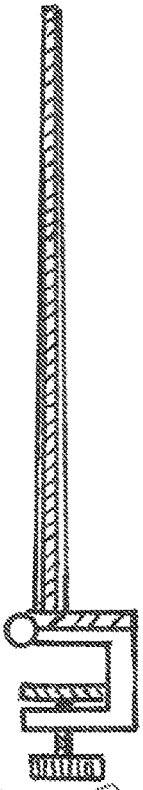
FIG. 58 illustrates a left side view of the attach and detachable arm.
Figure 59:
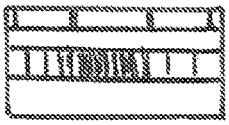
FIG. 59 illustrates an elevated view of the attach and detachable arm.
Figure 61:
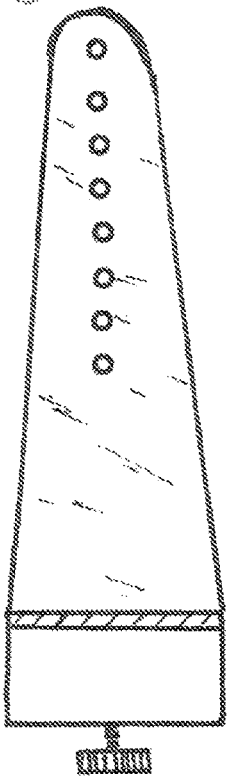
FIG. 61 illustrates a back view of the attach and detachable arm.
Figure 62:
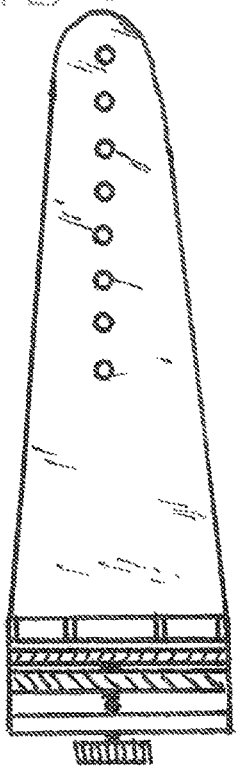
FIG. 62 illustrates a front view of the attach and detachable arm.
Figure 60:
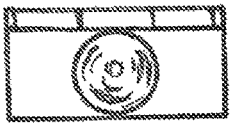
FIG. 60 illustrates a bottom view looking up at the attach and detachable arm.
Figure 63:
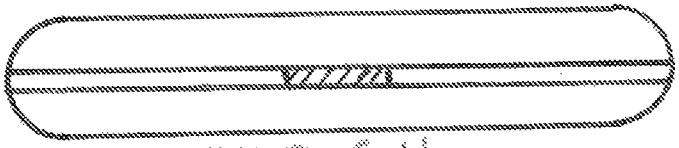
FIG. 63 illustrates a bottom view looking up at the T stabilizer.
Figure 64:
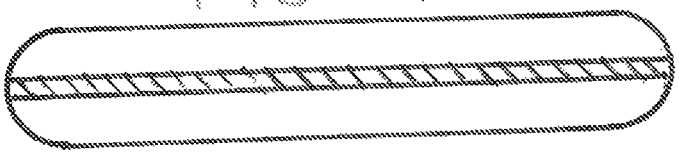
FIG. 64 illustrates a top view looking down on the T stabilizer.
Figure 65:
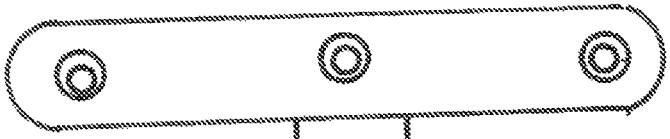
FIG. 65 illustrates a bottom view looking up on the T stabilizer.
Figure 68:
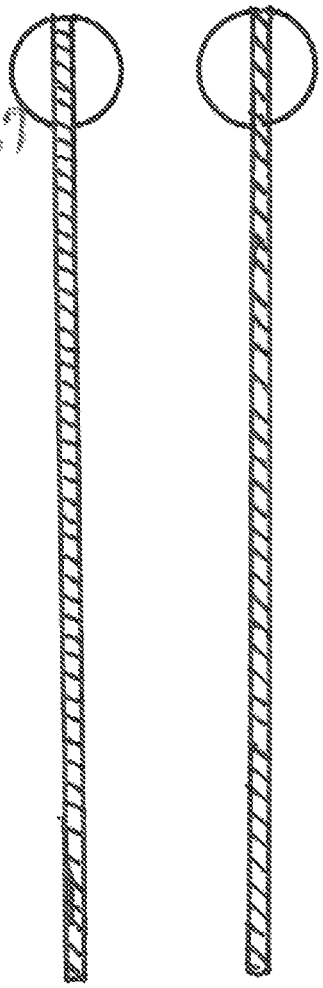
FIG. 68 illustrates a left side view of the T stabilizer.
Figure 67:
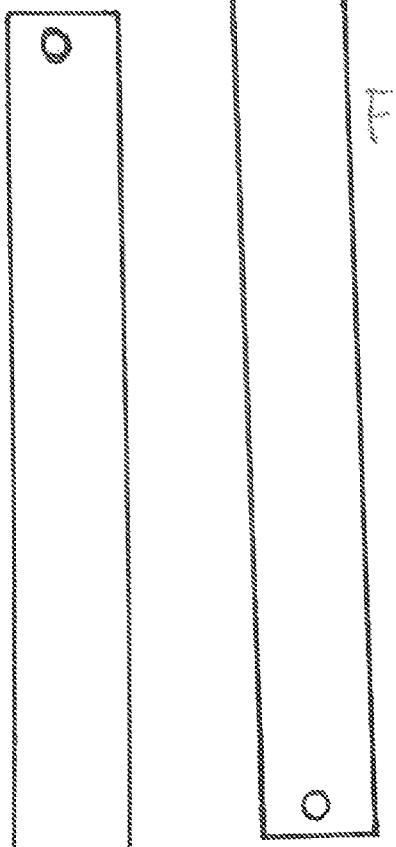
FIG. 67 illustrates a right side view of the T stabilizer.
Figure 66:
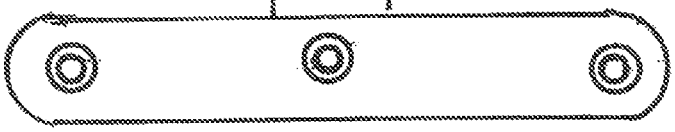
FIG. 66 illustrates a top side view looking down on the T stabilizer.
Figure 69:
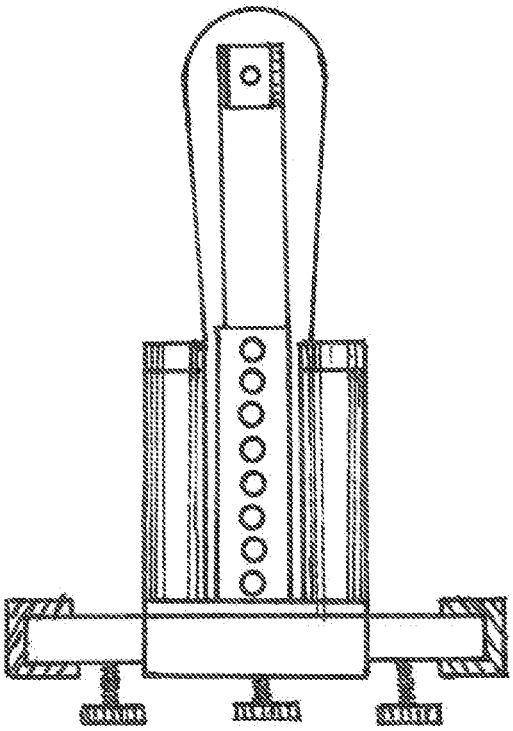
FIG. 69 illustrates a right side view of the Advertising wing.
Figure 70:
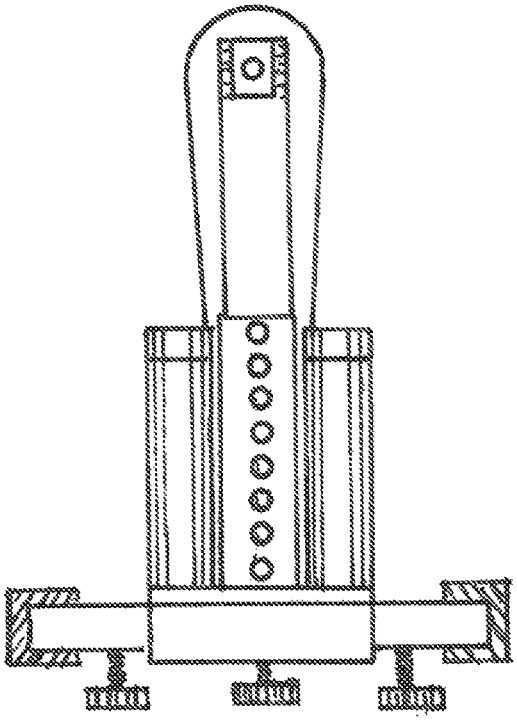
FIG. 70 illustrates a left side view of the Advertising wing.
Figure 71:
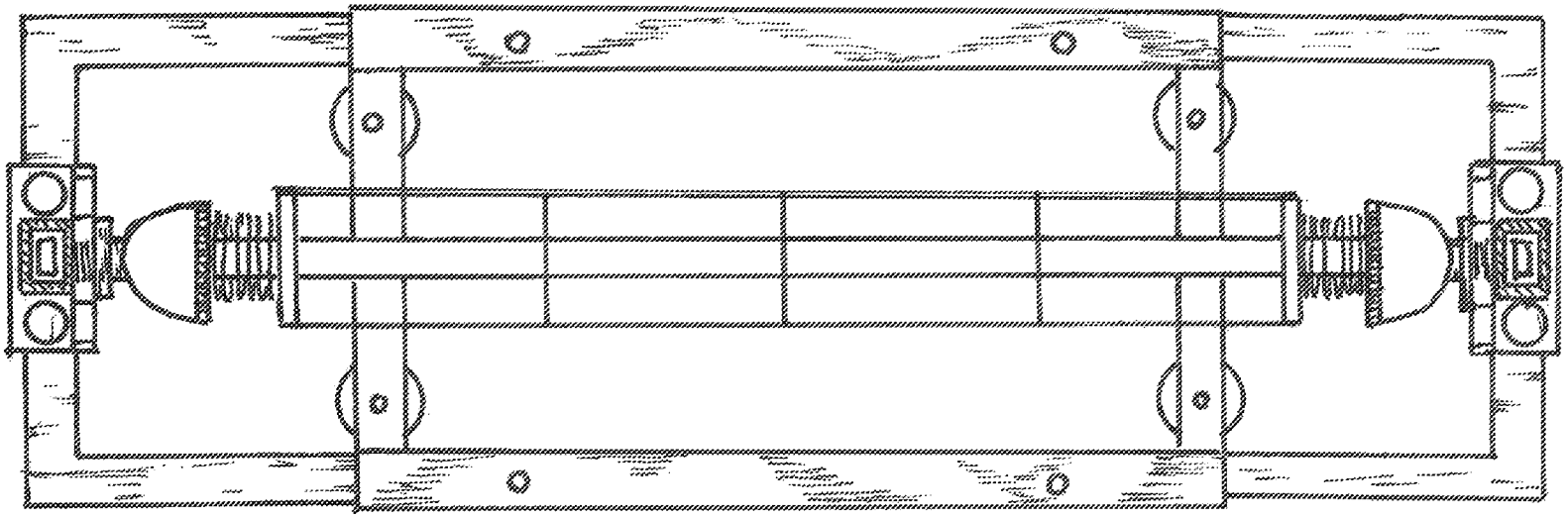
FIG. 71 illustrates an elevated view looking down on the Advertising wing.
Figure 72:
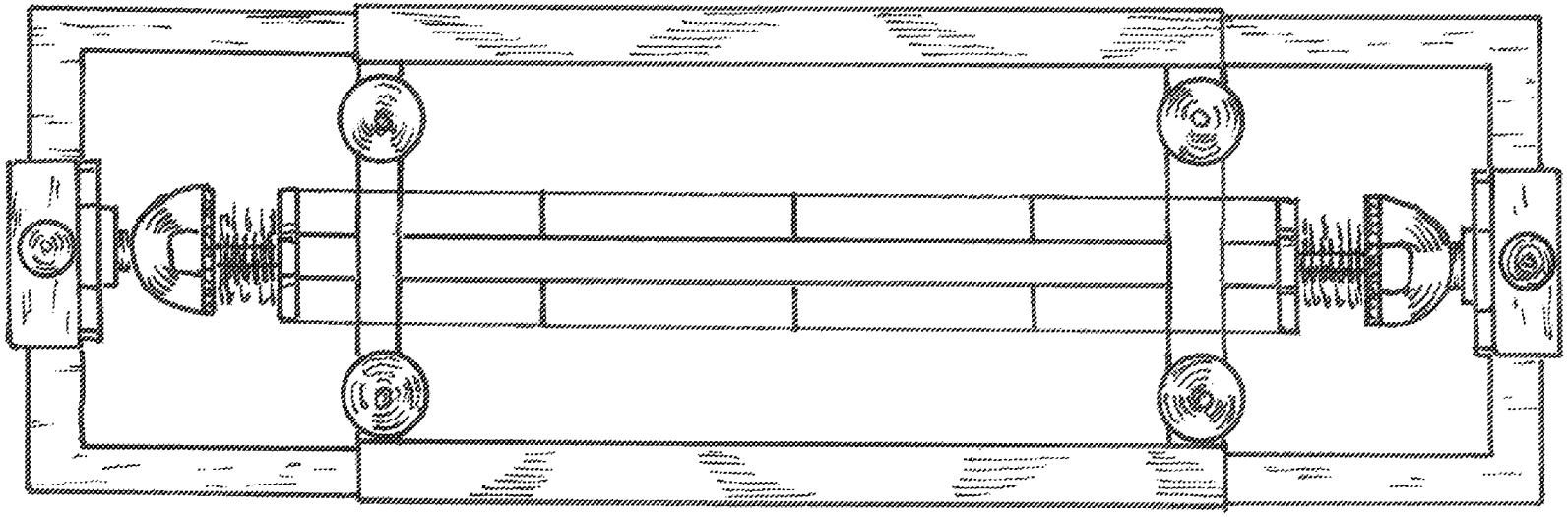
FIG. 72 illustrates a bottom view looking up at the Advertising wing.
Figure 73:
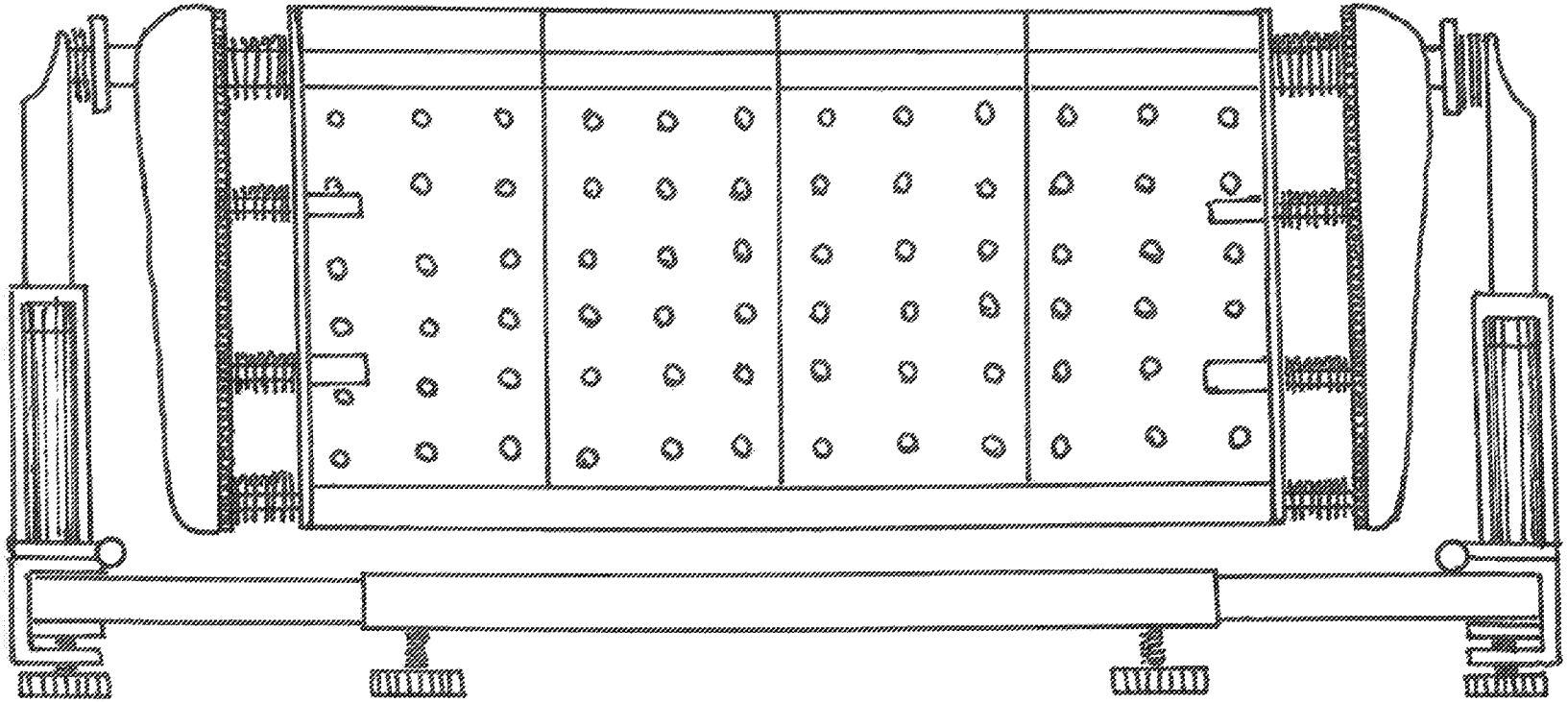
FIG. 73 illustrates a front side view of the Advertising wing.
Figure 74:
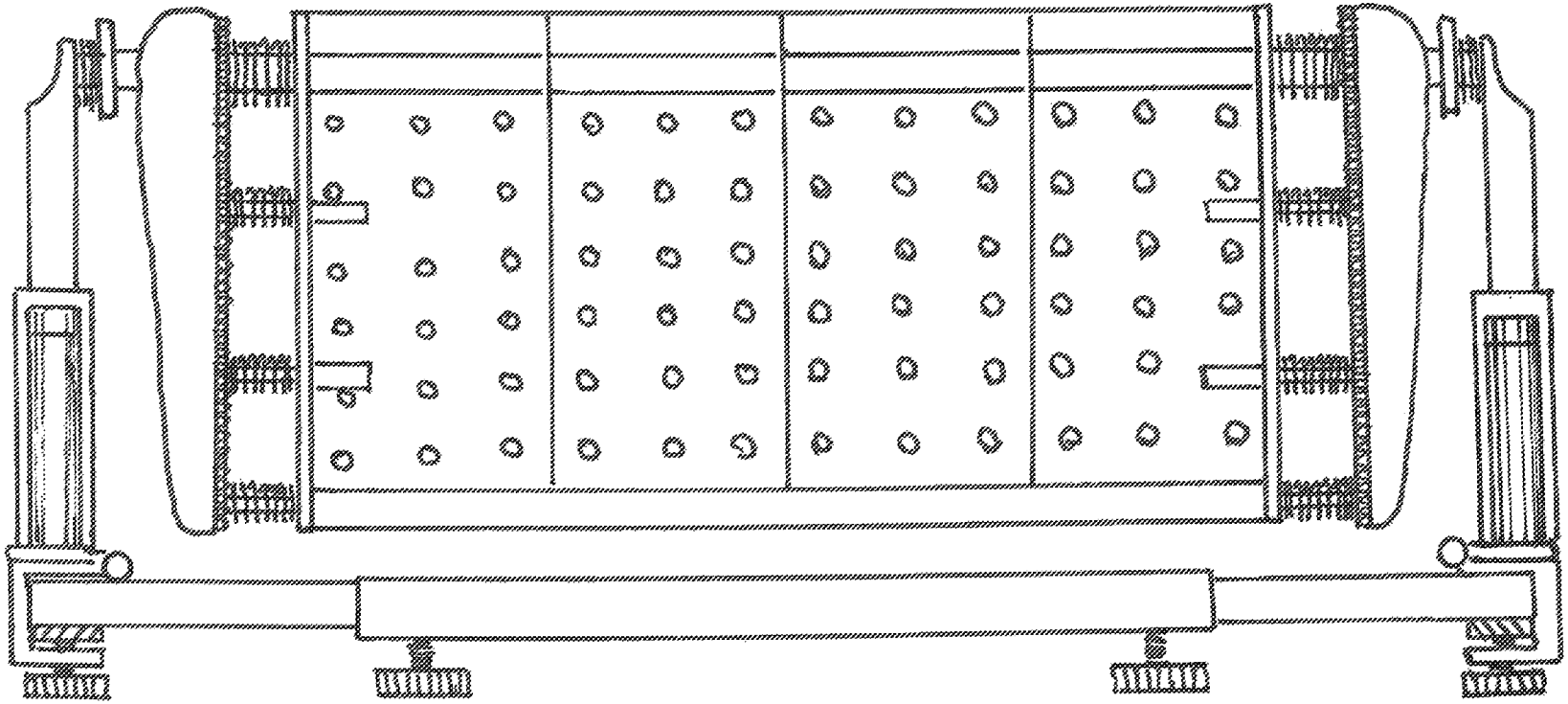
FIG. 74 illustrates a back side view of the Advertising wing.

FIG. 45 illustrates an exploded view of a to be frame. It illustrates the hitch attachment (13,) wherein the attaching right arm (7A,) and left side attaching arm (7A;) that will be attached to the middle hitch attachment (13,) when the right and left attach and detachable arms (7A,) and (7A;) that will now be attached to the middle hitch attachment (13,) by turning the bottom screw handles (11A) and (11A,) clock wise until tight. Attaching the frame connector rod (10B;) through the orifices (1;) of attach and detachable arms (7A,) and (7A;) securing the connector rod (10B;) with wing nuts (12B) right and left side. FIG. 46 illustrates the attach and detachable right and left side attaching arms, that when attached to other embodiments they comprise a frame. FIG. 47 illustrates these attach and detachable arms and top frame, attached to a vehicle. The attach and detachable arms that are attached to the back bed of the truck (14,) are illustrating attaching left arm (7G) and attaching right arm (7G,) attached to the back bed of the truck (14,) with the advertising wing (16C) attached between them. It is also illustrating the attaching hitch frame (14B) and advertising wing (12A,) in motion to be attached to the hitch pull (13A) of the vehicle (14,) for the purposes of advertising. FIG. 47A illustrates the advertising means attached to a vehicle and is illustrating the hitch pull (13A,) attached to the pickup truck (14C) for the purposes of advertising on the advertising wing and hitch frame (14B,). FIG. 48 illustrates top and bottom printed advertising material rear view. FIG. 49 illustrates the Advertising wing attached to a three wheeler motor cycle hitch. FIG. 50 illustrates these arms attached to a table that could be displayed at a trade show for promotions and other advertising means it could also be used for advertising a food menu at an outdoor venue as well as advertising a business or your favorite team whether it be professional or amateur.

In one embodiment, an advertising wing frame can include, but is not limited to, a rectangular frame, a first U-shaped arm, a second U-shaped arm, a first attach and detachable arm, and a second attach and detachable arm. The rectangular frame can include a plurality of adjustable legs. The first U-shaped arm can be removably coupled to a first side of the rectangular frame. The second U-shaped arm can be removably coupled to a second side opposite the first side of the rectangular frame. The first attach and detachable arm can be coupled to the first U-shaped arm. The second attach and detachable arm can be coupled to the second U-shaped arm. The first attach and detachable arm and the second attach and detachable arm can each be defined by, but are not limited to, a vise assembly, a first square tube, and a second square tube. The first square tube can be coupled to the vise assembly and can include a plurality of orifices. The second square tube can be sized to fit within the first square tube and can include a plurality of orifices. The advertising wing frame can further include a frame connector rod. The first square tube can be rotatably coupled to the vise assembly. The advertising wing frame can further include an advertising wing adapted to couple to the first attach and detachable arm and the second attach and detachable arm. The first U-shaped arm can be adapted to slide in and out of the first side of the rectangular frame. The second U-shaped arm can be adapted to slide in and out of the second side of the rectangular frame. An overall height of the first and second attach and detachable arms is adjustable.

In another embodiment, an advertising wing frame can include, but is not limited to, a first attach and detachable arm, a second attach and detachable arm, and a frame connector rod. The first attach and detachable arm can be adapted to be coupled to an object. The second attach and detachable arm can be adapted to be coupled to the object. The frame connector rod cab be adapted to couple between and to the first attach and detachable arm and the second attach and detachable arm. The first attach and detachable arm and the second attach and detachable arm can each be defined by, but are not limited to, a vise assembly, a first square tube, and a second square tube. The first square tube can be coupled to the vise assembly and can include a plurality of orifices. The second square tube can be sized to fit within the first square tube and can include a plurality of orifices. The frame connector rod can couple to the second square tubes of the first and second attach and detachable arms. The frame connector rod can be adapted to pass through and couple to an advertising wing. The object can be a modified trailer hitch. The advertising wing frame can further include an advertising wing adapted to display and pull taut a piece of material. An advertising wing can be defined by, but is not limited to, a frame, a first end member, a second end member, a first set of compression springs, and a second set of compression springs. The frame can have a substantially rectangular shape. The first end member can include an attachment means and can be located proximate a first side of the frame. The second end member can include an attachment means and can be located on a second side of the frame opposite the first side of the frame. The first set of compression springs can be located between the first end member and the first side of the frame. The second set of compression springs located between the second end member and the second side of the frame. The advertising wing can have an open position and a closed position. In the closed position the first end member and the second end member can be proximate ends of the frame and the first set of compression springs and the second set of compression springs can be substantially compressed. In the open position the first end member and the second end member can be located away from ends of the frame and the first set of compression springs and the second set of compression springs can be slightly compressed. A piece of material for advertising can be coupled to the attachment means of the first end member and the attachment means of the second end member.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

REFERENCE NUMERALS

Adjusting arm: (6C,)
Advertising cover: (10A:)
Advertising wing: (4B,) (10A,) (10A") (12;) (5A,) (5A;) (16C) (12A,)
Advertising means: (6G)
Adjustable legs: (1C) (1C,) (1C") (1C;)
Attaching arm: (7A,) (7A;) (7J') (7G) (76,) (7J*)
Attach and detachable arms: (7J) (7J*) (7J')
Bolt: (16) (16,) (16A) (16B) (1D) (9B;) (9B:) (9B*) (9B*,)
Bracket: (7B,) (7B;)
Car door jam: (12,) (12A;)
C-clamp: (4C)
Chain link: (11;) (11:)
Circles: 10*x*
Connective gear: (10B)
Continues Zipper: (4,)
Cylindrical stationary bar: (1) (1,) (1A)
Detachable arms: (7D,) (7D;)
Embodiment: (7H)
End caps: (3) (3A)
Elongated Orifice: (10B*)
Fabric: (8E)
Former placing: (6G,)
Frame: (15) (17) (8C,) (7A*) (15A) (15B)
Frame connector rod: (10) (10,) (10;) (10B;)
Glide arm: (6) (11)
Glide brace: (8) (13)
Hinge: (3D) (18A)
Hitch frame (14B) (14B,)
Hitch attachment: (13*) (13,)
Hitch pull (13A) (13A,)
Illuminating element: (10:)
Insert arms: (7C,) (7C;)
Invention or Advertising wing: (10A) (10A;) (4B,) (10A,)
Left attaching arm: (7A;) (7G)
Magnets (2H)
Magnetize stabilizer bar: (2D) (2D,) (2D;) (2D*)
Matching steel plate: (5E)
Matching orifices: (2B,)
Middle pillar: (6F)
Non threaded section: (3I,)
Notched groove: (3G)
Nut: (9,) (9A) (9B) (9C) (9D) (9E) (9B,) (9E,) (9E;)
Orifice: (3B) (3B,) (5D)
Orifices: (4F;) (2C) (1;)
Orifice opening: (3,) (3") (3I) (3L)

Orifice opening: (1B) (1B,) (1B") (1B:)
Outside diameter square tubing: (3C)
Partially threaded screw: (3F)
Piece of fabric: (8B,) (8B;)
Plastic shield: (5E,)
Previous height: (4F)
Extended height: (4F,)
Rectangle insert: (15,) (15;) (15C)
Right attaching arm: (7A,) (7G,)
Round cylinders: (6E,)
Round magnets: (2H)
Screw: (4D)
Screws (66) (6,) (6A) (6C) (6D) (6E) (5F)
Screw knob: (3F) (3F,) (3F;)
Side tube: (7,) (7A) (7B) (7C) (7D) (7E)
Spring A B C D E F
Spring (5C) (5B)
Square tubing: (3C) (3C,)
Square tube brace: (4) (4A) (4B) (4G)
Stationary brace: (9) (14)
Stationary braces: (5) (5A)
Stationary bar (1,) (1A)
Steel plate: (3H) (4E)
Thin plate steel: (6G;) (6G:) (6G,)
Stitching (2,) (2:) (2;) (2B;) (2B:)
Threading: (2") FIG. 3>
Threaded end section: (2) (2*)
Threaded orifice: (3B;)
Threaded section: (3*k*)
Truck: (14,) (14C)
T-stabilizer (11,) (11A;)
Turnbuckle: (10B,) (10B:)
U Arm or insert arms: (2A) (2B)
Unseen bolts: (1D)
Unseen orifices; (5C,) (5C;)
Unthreaded section: (3J)
Unseen section: (3D,)
Vice clamp (3E) (7J;)
Velcro Hooks: (8,) (8B) (8E,) (8E;) (10C)
Velcro loops: (8A) (8C) (8D) (8D,) (10D)
Wing nuts: (8A,) (8A;) (12B)

I claim:

1. An advertising wing frame comprising:
a rectangular frame including a plurality of adjustable legs;
a first U-shaped arm removably coupled to a first side of the rectangular frame;
a second U-shaped arm removably coupled to a second side opposite the first side of the rectangular frame;
a first attach and detachable arm coupled to the first U-shaped arm;
a second attach and detachable arm coupled to the second U-shaped arm;
wherein the first attach and detachable arm and the second attach and detachable arm are each defined by:
a vise assembly;
a first square tube coupled to the vise assembly, the first square tube including a plurality of orifices; and
a second square tube sized to fit within the first square tube, the second square tube including a plurality of orifices.

2. The advertising wing frame of claim 1, further including a frame connector rod.

3. The advertising wing frame of claim 1, wherein the first square tube is rotatably coupled to the vise assembly.

4. The advertising wing frame of claim 1, further including an advertising wing adapted to couple to the first attach and detachable arm and the second attach and detachable arm.

5. The advertising wing frame of claim 1, wherein (i) the first U-shaped arm is adapted to slide in and out of the first side of the rectangular frame; and (ii) the second U-shaped arm is adapted to slide in and out of the second side of the rectangular frame.

6. The advertising wing frame of claim 1, wherein an overall height of the first and second attach and detachable arms is adjustable.

7. An advertising wing frame comprising:
a first attach and detachable arm adapted to be coupled to an object;
a second attach and detachable arm adapted to be coupled to the object;
a frame connector rod adapted to (j) couple between and to the first attach and detachable arm and the second attach and detachable arm and (ii) pass through and couple to an advertising wing;
wherein the first attach and detachable arm and the second attach and detachable arm are each defined by:
a vise assembly;
a first square tube rotatably coupled to and extending vertically from the vise assembly, the first square tube including a plurality of orifices; and
a second square tube sized to fit within the first square tube, the second square tube including a plurality of orifices.

8. The advertising wing frame of claim 7, wherein the frame connector rod couples to the second square tubes of the first and second attach and detachable arms.

9. The advertising wing frame of claim 7, wherein the object is a modified trailer hitch.

10. The advertising wing frame of claim 7, further including an advertising wing adapted to display and pull taut a piece of material.

11. The advertising wing frame of claim 7, further including an advertising wing defined by:
a frame having a substantially rectangular shape;
a first end member including an attachment means, the first end member located proximate a first side of the frame;
a second end member including an attachment means, the second end member located on a second side of the frame opposite the first side of the frame;
a first set of compression springs located between the first end member and the first side of the frame;
a second set of compression springs located between the second end member and the second side of the frame;
wherein the advertising wing has an open position and a closed position.

12. The advertising wing frame of claim 11, wherein in the closed position the first end member and the second end member are proximate ends of the frame and the first set of compression springs and the second set of compression springs are substantially compressed.

13. The advertising wing frame of claim 12, wherein in the open position the first end member and the second end member are located away from ends of the frame and the first set of compression springs and the second set of compression springs are slightly compressed.

14. The advertising wing frame of claim 11, wherein a piece of material for advertising is coupled to the attachment means of the first end member and the attachment means of the second end member.

* * * * *